US011335310B2

(12) United States Patent
Suitor

(10) Patent No.: US 11,335,310 B2
(45) Date of Patent: May 17, 2022

(54) INSTRUMENT TRIGGER AND INSTRUMENT TRIGGER MOUNTING SYSTEMS AND METHODS

(71) Applicant: Rare Earth Dynamics, Inc., Radcliff, KY (US)

(72) Inventor: Stephen Riley Suitor, Radcliff, KY (US)

( * ) Notice: Subject to any disclaimer, the term of this patent is extended or adjusted under 35 U.S.C. 154(b) by 229 days.

(21) Appl. No.: 16/532,453

(22) Filed: Aug. 5, 2019

(65) Prior Publication Data

US 2020/0074970 A1 Mar. 5, 2020

Related U.S. Application Data

(63) Continuation-in-part of application No. 16/397,131, filed on Apr. 29, 2019.

(60) Provisional application No. 62/738,931, filed on Sep. 28, 2018, provisional application No. 62/714,596, filed on Aug. 3, 2018, provisional application No. 62/686,657, filed on Jun. 18, 2018.

(51) Int. Cl.
*G10H 3/14* (2006.01)
*G10D 13/065* (2020.01)

(52) U.S. Cl.
CPC ..... *G10H 3/143* (2013.01); *G10D 13/065* (2013.01); *G10H 2220/525* (2013.01)

(58) Field of Classification Search
CPC .... G10D 13/024; G10D 13/065; G10H 3/143; G10H 3/146; G10H 3/18; G10H 3/183; G10H 3/186; G10H 2220/525; G10H 2230/305
See application file for complete search history.

(56) References Cited

U.S. PATENT DOCUMENTS

| | | | |
|---|---|---|---|
| 1,176,943 | A | 9/1913 | Bollinger |
| 2,655,071 | A | 10/1953 | Levay |
| 2,666,848 | A | 1/1954 | Goodwin |
| 2,808,522 | A | 10/1957 | Dranetz |
| 3,053,949 | A | 9/1962 | Johnson |
| 3,170,076 | A | 2/1965 | Thomas |
| 3,198,872 | A | 8/1965 | Finkenbeiner |
| 3,375,747 | A | 4/1968 | Posey |
| 3,439,568 | A | 4/1969 | Griffith |
| 3,453,920 | A | 7/1969 | Scherer |
| 3,509,264 | A | 4/1970 | Green |
| 3,510,566 | A | 5/1970 | McKenzie |
| 3,553,339 | A | 1/1971 | Dominguez et al. |
| 3,634,595 | A | 1/1972 | Pasquali |
| 3,659,032 | A | 4/1972 | May |
| 3,665,490 | A | 5/1972 | Oskar |
| 3,677,126 | A | 7/1972 | Pierce |

(Continued)

FOREIGN PATENT DOCUMENTS

| | | |
|---|---|---|
| EP | 0264782 | 4/1988 |
| EP | 2437253 | 4/2012 |

(Continued)

*Primary Examiner* — Jeffrey Donels
(74) *Attorney, Agent, or Firm* — Kevin T. Duncan; Duncan Galloway Greenwald PLLC

(57) ABSTRACT

An apparatus, system, and method for a magnetically and releaseably attachable trigger for an instrument is provided. Additionally, the trigger provides for an increased sensitivity of sound by being in direct physical contact with the surface on which it is attached.

19 Claims, 42 Drawing Sheets

(56) References Cited

U.S. PATENT DOCUMENTS 3,680,423 A 8/1972 Lander
3,725,561 A * 4/1973 Paul ..... G10H 3/146 84/726
3,731,022 A 5/1973 Loftus
3,733,425 A 5/1973 Chaki
3,748,367 A 7/1973 Lamme et al.
3,956,958 A 5/1976 Nash et al.
3,956,959 A 5/1976 Ebihara
4,030,396 A 6/1977 Mariner
4,141,273 A 2/1979 Austin
4,168,646 A 9/1979 May
4,178,823 A 12/1979 McCoskey
4,189,969 A 2/1980 Katayama et al.
4,200,025 A 4/1980 Currier
4,201,107 A 5/1980 Barber, Jr
4,226,156 A 10/1980 Hyakutake
4,227,049 A 10/1980 Thomson et al.
4,242,937 A 1/1981 Pozar
4,245,539 A 1/1981 Jones
4,279,188 A 7/1981 Scott
4,290,331 A 9/1981 Izdebski
4,341,140 A 7/1982 Ishida
4,368,400 A 1/1983 Taniguchi et al.
4,371,804 A 2/1983 Peng et al.
4,378,721 A 4/1983 Kaneko et al.
4,415,181 A 11/1983 Hartry et al.
4,418,598 A 12/1983 Ulynas
4,479,412 A 10/1984 Klynas
4,491,050 A 1/1985 Franzmann
4,562,740 A 1/1986 Webber et al.
4,567,805 A 2/1986 Clevinger
4,570,522 A 2/1986 May
4,581,972 A 4/1986 Hoshino
4,581,973 A 4/1986 Hoshino
4,630,465 A 12/1986 Hatton
4,648,302 A 3/1987 Bozzio
4,657,114 A 4/1987 Shaw
4,660,410 A 4/1987 Asano et al.
4,669,349 A 6/1987 Hyakutake
4,672,839 A 6/1987 Takeuchi et al.
4,700,602 A 10/1987 Bozzio
4,737,676 A 4/1988 Engel et al.
4,744,279 A 5/1988 Livingston
4,750,397 A 6/1988 Ashworth-Jones
4,753,146 A 6/1988 Seiler
4,776,253 A 10/1988 Downes
4,809,337 A 2/1989 Scholz et al.
4,817,485 A 4/1989 Bozzio et al.
4,819,536 A 4/1989 Lombardi
4,837,836 A 6/1989 Barcus
4,860,625 A 8/1989 Mathews
4,867,027 A 9/1989 Barbera
4,867,028 A 9/1989 Jones
4,899,633 A 2/1990 Lombardi
4,909,117 A 3/1990 Reiling et al.
4,947,725 A 8/1990 Nomura
4,984,498 A 1/1991 Fishman
5,001,959 A 3/1991 Kimpara
5,042,356 A 8/1991 Karch
5,056,403 A 10/1991 Yamashita
5,063,821 A 11/1991 Battle
5,085,119 A 2/1992 Cole
D324,687 S 3/1992 Olson
5,095,799 A 3/1992 Wallace et al.
5,105,710 A 4/1992 Rothmel
5,105,711 A 4/1992 Barnard
5,115,706 A 5/1992 Aluisi
5,121,668 A 6/1992 Segan
5,123,325 A 6/1992 Turner
5,134,920 A * 8/1992 Clark ..... G10H 3/146 84/477 R
5,140,887 A 8/1992 Chapman
5,157,213 A 10/1992 Kashio
5,204,487 A 4/1993 Turner
5,223,658 A 6/1993 Suzuki
5,235,891 A 8/1993 Klein
5,293,000 A 3/1994 Adinolfi
5,322,969 A 6/1994 Aaroe et al.
5,345,037 A 9/1994 Nordelius
5,371,830 A 12/1994 Wachenheim
5,403,972 A 4/1995 Valentine, Sr.
5,430,245 A 7/1995 Rogers
5,449,964 A * 9/1995 Snyder ..... G10H 1/0556 310/327
5,455,381 A 10/1995 Juszkiewicz et al.
5,463,185 A 10/1995 Fishman
5,499,541 A 3/1996 Hopf et al.
5,550,321 A 8/1996 Brann
5,583,307 A 12/1996 Tobia, Jr.
5,602,353 A 2/1997 Juszkiewicz et al.
5,602,354 A 2/1997 Martin
5,614,688 A 3/1997 Donnell
5,627,336 A 5/1997 Stevens
5,796,025 A 8/1998 Haake
5,811,709 A * 9/1998 Adinolfi ..... G10D 13/26 84/723
5,817,966 A 10/1998 Fishman
5,866,829 A 2/1999 Pecoraro
5,866,836 A 2/1999 Bergstrom
5,878,359 A 3/1999 Takeda
5,900,573 A 5/1999 Bames
5,977,473 A 11/1999 Adinolfi
6,031,176 A 2/2000 Tanaka
6,075,198 A 6/2000 Grant et al.
6,094,490 A 7/2000 Kim
6,121,528 A 9/2000 May
6,166,307 A 12/2000 Caulkins et al.
6,215,055 B1 4/2001 Saravis
6,369,308 B1 4/2002 Orr
6,441,293 B1 8/2002 LaBarbera
6,794,569 B2 * 9/2004 Kamijima ..... G10H 3/146 84/746
D497,935 S * 11/2004 Kamijima ..... D17/22
6,979,770 B2 12/2005 Hampton, Jr.
6,982,376 B2 1/2006 Wise
7,015,391 B2 3/2006 Tomoda
7,038,117 B2 5/2006 Yoshino
7,115,805 B1 10/2006 Vandervoort
7,179,985 B2 2/2007 Pickens
7,259,317 B2 8/2007 Hsien
7,282,633 B1 10/2007 Coolidge
7,396,991 B2 7/2008 Susami
7,470,847 B2 12/2008 Kitagawa
7,488,887 B2 2/2009 Mori
7,525,032 B2 4/2009 Mishima
7,608,776 B2 10/2009 Ludwig
7,667,130 B2 2/2010 Mishima
7,723,592 B1 5/2010 Dixson
7,754,956 B2 7/2010 Gain et al.
8,039,724 B1 10/2011 Normam et al.
8,121,300 B1 2/2012 LoDuca et al.
8,173,886 B2 5/2012 Hashimoto
8,178,768 B1 5/2012 Shepherd
8,258,392 B2 9/2012 Mori
8,354,581 B2 1/2013 Eventoff et al.
8,373,052 B2 2/2013 Yoshino
8,461,446 B1 6/2013 Gibson
8,546,676 B2 10/2013 Hashimoto
8,563,843 B1 10/2013 Shemesh
8,884,151 B1 11/2014 Lee
9,761,212 B2 * 9/2017 Suitor ..... G10H 3/183
2002/0056357 A1 5/2002 Kassabian
2002/0152872 A1 10/2002 O'Donnell
2003/0004603 A1 1/2003 Hagemeister et al.
2003/0131721 A1 7/2003 Minakuchi et al.
2003/0161493 A1 * 8/2003 Hosier ..... G10H 3/181 381/353
2004/0025663 A1 2/2004 Harada et al.
2004/0134332 A1 * 7/2004 Kamijima ..... G10H 3/146 84/411 R
2004/0149120 A1 8/2004 Maruhashi et al.
2004/0211310 A1 10/2004 Hagiwara
2005/0016367 A1 1/2005 Hasenmaier
2005/0022655 A1 2/2005 Wise

(56) References Cited

U.S. PATENT DOCUMENTS

| | | | | |
|---|---|---|---|---|
| 2005/0039593 | A1* | 2/2005 | Wachter | G10H 3/146 84/730 |
| 2005/0150366 | A1 | 7/2005 | Susami | |
| 2006/0000341 | A1 | 1/2006 | Steele | |
| 2006/0021495 | A1 | 2/2006 | Freitas | |
| 2006/0219092 | A1 | 10/2006 | Mishima | |
| 2007/0107587 | A1 | 5/2007 | Lee | |
| 2007/0234888 | A1 | 10/2007 | de Moraes | |
| 2008/0034946 | A1 | 2/2008 | Aimi | |
| 2008/0071958 | A1 | 3/2008 | Honda et al. | |
| 2009/0000464 | A1 | 1/2009 | Mishima | |
| 2009/0139387 | A1* | 6/2009 | Toda | G10H 1/348 84/422.3 |
| 2010/0031800 | A1 | 2/2010 | Van Ekstrom | |
| 2011/0116634 | A1* | 5/2011 | Norman | H04L 9/3247 380/277 |
| 2012/0073425 | A1 | 3/2012 | Hashimoto | |
| 2012/0180621 | A1 | 7/2012 | Holl | |
| 2013/0098227 | A1 | 4/2013 | Wei | |
| 2013/0112068 | A1 | 5/2013 | Rogers | |
| 2013/0333545 | A1* | 12/2013 | Dunwoodie | G10H 3/181 84/726 |
| 2014/0000445 | A1 | 1/2014 | Gulak | |
| 2014/0208926 | A1* | 7/2014 | Shepherd | G10H 3/146 84/730 |
| 2015/0009417 | A1 | 1/2015 | Jargiello, III | |
| 2015/0068392 | A1 | 3/2015 | Huston et al. | |
| 2015/0262567 | A1* | 9/2015 | Truchsess | G10H 3/146 84/725 |
| 2015/0269921 | A1* | 9/2015 | Truchsess | G10D 13/06 84/422.1 |

FOREIGN PATENT DOCUMENTS

| | | |
|---|---|---|
| GB | 2183076 | 6/1986 |
| WO | 1990/003639 | 4/1990 |

* cited by examiner

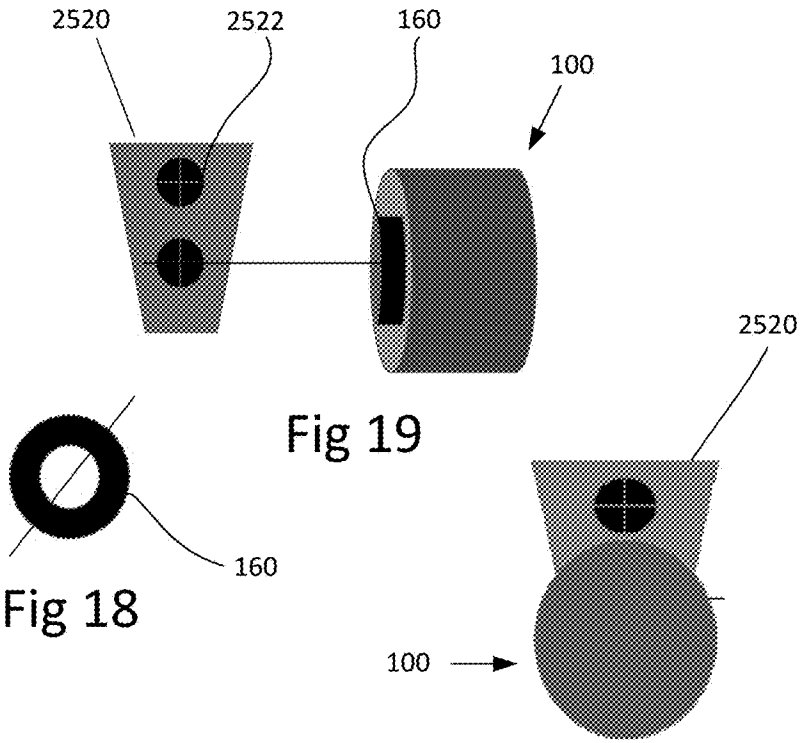
Fig 19
Fig 18
Fig 20
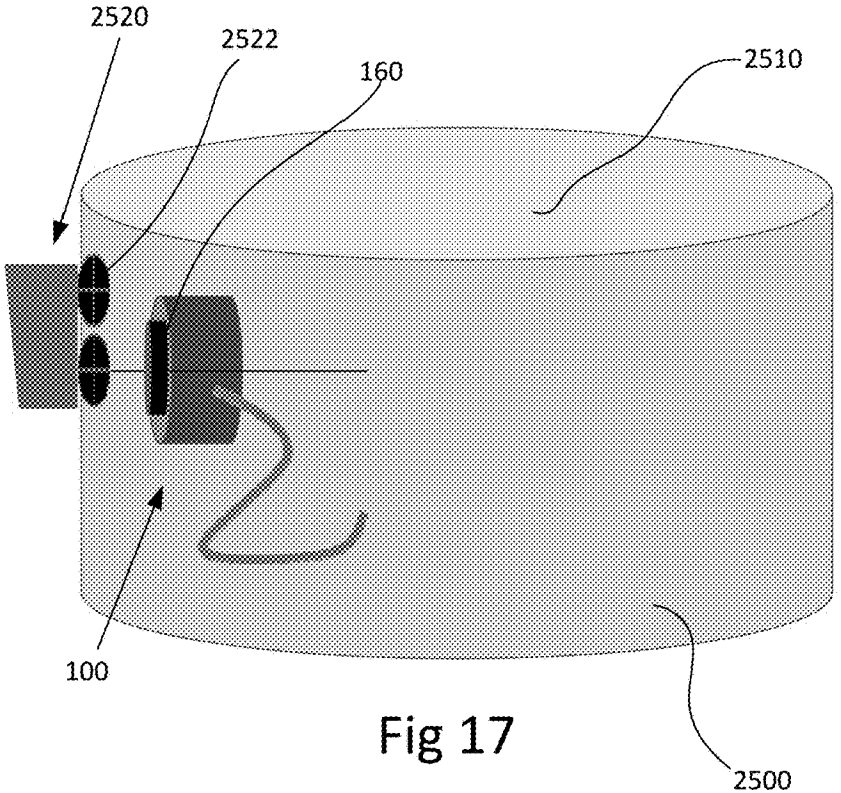
Fig 17

5700

5850

INSTRUMENT TRIGGER AND INSTRUMENT TRIGGER MOUNTING SYSTEMS AND METHODS

CROSS-REFERENCE TO RELATED APPLICATION AND CLAIM OF PRIORITY

The present application is a continuation-in-part of and claims benefit of priority to U.S. patent application Ser. No. 16/398,131, entitled MAGNETICALLY SECURED INSTRUMENT TRIGGER AND INSTRUMENT TRIGGER MOUNTING SYSTEMS AND METHODS, filed Apr. 29, 2019, which claims priority to U.S. Provisional Patent Application 62/686,657, entitled MUSICAL INSTRUMENT TRIGGERING, DRUM MODULE CONTROL UNIT AND DISPLAY AND SYSTEM, AND METHOD FOR MODIFYING DRUM MODULE SIGNAL, filed Jun. 18, 2018, and to U.S. Provisional Patent Application 62/714,596, entitled CYMBAL INSTRUMENT TRIGGERING, filed Aug. 3, 2018, and to U.S. Provisional Patent Application 62/738,931, entitled CYMBAL INSTRUMENT TRIGGERING, filed Sep. 28, 2018; each of which are incorporated herein in their entirety.

FIELD OF THE INVENTION

The field of the invention is electronic instrument triggers.

BACKGROUND

The background description includes information that may be useful in understanding the present invention. It is not an admission that any of the information provided herein is prior art or relevant to the presently claimed invention, or that any publication specifically or implicitly referenced is prior art.

In the past few decades, drum triggers have increasingly been used with acoustic drums for live performances and studio recordings. In many instances, drum triggers can overcome potential problems with using microphones and can allow a drummer to have more control over the sound of the drum. In effect, the addition of a drum trigger to an acoustic drum converts the acoustic drum to an electric drum pad.

There are several existing varieties of drum triggers. A first type of prior art drum trigger involves a tension arm that is mounted on the rim of a drum using a lug or clamp mount mechanism. For this type of drum trigger, a tension arm attached to the rim of the drum puts pressure on the trigger and places the trigger in contact with the head of the drum. This has several undesirable effects. First, this puts stress on the head of the drum thereby deforming the drum head. This affects the tonal quality of the drum and changes the sound produced by the drum head. Second, the tension applies unnecessary force to the trigger and can cause it to fail because of the mechanical stress placed on the trigger. Third, when the drum is struck, and the drum head vibrates, the trigger will not be in constant contact with the drum head. This can cause problems including double triggering of the trigger. Fourth, the location of the trigger is limited to a position near the rim of the drum. Fifth, the trigger is susceptible to movement and requires frequent re-adjustment. Problems with the position and mechanical issues with the trigger can occur in a few as 150-300 strikes of the drum head, and the majority of prior art triggers begin to suffer from degrading performance beginning with the first strike of the drum. The degrading performance may take the form of a decreased voltage output, noticeable as a decreased amplitude of the output voltage wave, and may also include increases in non-triggering or double triggering. Additionally, the piezoelectric transducer commonly used in these triggers may begin to degrade or wear out quickly because it is placed in high-stress direct contact with the drum head. The very design of prior art triggers causes the triggers to suffer from the aforementioned problems.

This type of tension arm trigger is also difficult to install and configure. The tension arm trigger requires exact tension be placed on the trigger itself to keep the trigger in constant contact with a drum head. This type of installation is finicky and requires expertise or trial-and-error to install correctly. The prior art triggers also require considerable configuration at a drum module. A drum module is an electronic device that interprets an input and produces as an output a sound or other electronic output. A plurality of drum modules, their specifications and methods of operation are described hereinbelow. For prior art triggers, the drum module will need to specifically tuned to not only the type of trigger, but the manner in which the trigger is installed and the type of instrument on which the trigger is installed. The configuration must also take into account other external conditions at the time of configuration. The exact same trigger may need different configuration settings each time the trigger is set up for use.

Many external drum triggers are top rim mounted, but these suffer from the described defects. For example, top rim triggers are bulky and may get in the way of a drummer's performance. One way to overcome this defect is to install the drum trigger on the drum head. U.S. Pat. No. 7,259,317 to *Hsien* describes an external drum trigger that can be added to a drumhead and is incorporated by reference herein in its entirety. However, the drum trigger described in *Hsein* suffers from numerous drawbacks. First, installation of the drumhead in *Hsein* requires a hole to be created in the drumhead, which permanently damages the drum. Second, the drumhead in *Hsein* requires a foam buffer, which can decrease the sensitivity of the drum trigger and result in a degradation in response as it is applied to larger drums. U.S. Pat. No. 5,977,473 to *Adinolfi* describes a drum trigger incorporated into the rim of a drum and is incorporated by reference herein in its entirety. However, the drum trigger described in *Adinolfi* is undesirable because it requires the purchase of a completely new drum. Because of this, in many instances external or add-on drum triggers are more favorable.

Another type of prior art drum trigger is a pad installed trigger. Typically these triggers are glued using an epoxy or adhesive to a plate on the underside of a rubber or silicone drum pad. These triggers suffer from problems including a loss of velocity, double triggering, and frequent mechanical failure. The drum pad triggers that incorporate piezoelectric triggers prevent the piezoelectric trigger from functioning properly because the piezoelectric trigger cannot flex properly. The adhesive and solid plate the trigger is disposed on force the trigger to remain rigid and essentially cause the trigger to function as a contact microphone instead of as a proper trigger. Drum triggers may also be glued or otherwise adhered to a drum head directly without an intervening plate or pad. However, this method of attachment is undesirable because it permanently attaches the trigger to the drum head and puts undue stress on the trigger itself.

Additional information about problems that exist with prior art triggers and methods for installing, configuring, and using prior art drum triggers can be found in Norman Weinberg, *Tweaking For Touch: The Electronic Trigger*, Drum! Magazine, June 2011, and in Mike Snyder, *Don't Pull That Trigger!*, Drum! Magazine, November 2013, both of which are hereby incorporated by reference in their entirety. The function and operation of piezoelectric transducers and the piezoelectric effect is well known in the art. A description of the functioning of a piezoelectric transducer can be found in the article Piezoelectric Trasnsducers, NDT Resource Center, https://www.nde-ed.org/EducationResources/CommunityCollege/Ultrasonics/EquipmentTrans/piezotransducers.ht m, accessed Jan. 5, 2016, which is incorporated by reference herein in its entirety. Additional information on piezoelectric transducers can be found in the article *What's a Transducer?*, APC International, LTD, https://www.americanpiezo.com/piezo-theory/whats-a-transducer.html, accessed Jan. 5, 2016, which is incorporated by reference herein in its entirety. Detail on the mechanics and function of piezoelectric transducers can be found in the article *Introduction to Piezo Transducers*, Piezo Systems, Inc., http://www.piezo.com/tech2intropiezotrans.html, accessed Jan. 5, 2016, which is incorporated by reference herein in its entirety.

All extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

The field of electronic instrument triggering is comprised of numerous ways to trigger an electronic module by the playing of an instrument, including percussion instruments, including cymbal instruments. Systems and method for musical instrument triggering include: U.S. patent application Ser. No. 15/456,471, entitled HANDHELD ELECTRONIC MUSICAL PERCUSSION INSTRUMENT (Suitor), filed Mar. 10, 2017, which claims benefit of U.S. Provisional Patent Application 62/306,306, entitled HANDHELD ELECTRONIC MUSICAL PERCUSSION INSTRUMENT (Suitor), filed Mar. 10, 2016, and which also claims benefit of priority and is a continuation-in-part of pending U.S. patent application Ser. No. 15/433,990, entitled MAGNETICALLY SECURED CYMBAL TRIGGER AND CHOKE ASSEMBLY (Suitor), filed Feb. 15, 2017, which claims priority to U.S. Provisional Patent Application 62/295,483, entitled MAGNETICALLY SECURED CYMBAL TRIGGER AND CHOKE ASSEMBLY (Suitor), filed Feb. 15, 2016; which claims benefit of priority and is a continuation-in-part of pending U.S. Utility patent application Ser. No. 14/988,570, entitled MAGNETICALLY SECURED INSTRUMENT TRIGGER (Suitor), filed Jan. 5, 2016, which claims priority to U.S. Provisional patent application 62/259,047, entitled PIEZOELECTRIC INSTRUMENT TRIGGER (Suitor), filed Nov. 23, 2015, which also claims priority to U.S. Provisional Patent Application 62/100,041, entitled DUAL SIDED MAGNETIC DRUM TRIGGER (Suitor), filed Jan. 5, 2015; which also claims the benefit of U.S. Provisional Patent Application 62/448,388, entitled MAGNETICALLY SECURED INSTRUMENT TRIGGER AND INSTRUMENT TRIGGER MOUNTING SYSTEMS AND METHODS (Suitor), filed Jan. 19, 2017; and which also claims benefit of U.S. Provisional Patent Application 62/448,953, entitled MAGNETICALLY SECURED INSTRUMENT TRIGGER AND INSTRUMENT TRIGGER MOUNTING SYSTEMS AND METHODS (Suitor), filed Jan. 20, 2017; each of which is incorporated by reference in their entirety.

The evolution of electronic drums has been in a constant state of improvement. Today's drummers have the benefit of decades long enhancements to drum modules that make the sound of an electronic drum kit hard to distinguish from a real acoustic drum set. Many drummers take things a step further and use computer-based triggering.

Thus, there is a need for improved drum triggers that do not require modification of the drums and that may be releaseably attached at a variety of locations. Additionally, there is a need for an improved drum trigger that may be used with a plurality of drum triggers on a single instrument without cross-talk interference or hot-spotting.

SUMMARY OF THE INVENTION

The present invention generally relates to electronic musical instrument triggering, control, and sound reproduction. More specifically, the present invention relates to an electronic trigger adapted to generate a trigger signal as an input to a drum module for processing and generation of output signals. The invention also relates to a mounting configuration especially adapted for use with low volume cymbal instruments, e.g., Zildjian L80 Low Volume cymbals, Sabian Quiet Tone Practice Cymbals, and others. Low volume cymbals often are metallic and characterized as perforated with a patterned set of openings or perforations throughout the body of the cymbal. Low volume cymbals do not produce the sound volume when struck that traditional cymbals produce and are often used in practice settings or in situations where less sound volume is desired. Triggering low volume cymbals enables uses to capture the striking of the cymbal and generate signals for delivery to "drum" modules or the like to then generate signals which may be amplified or otherwise used to generate audible sounds. In this manner, the triggering of the low volume cymbals allows users to create whatever sound volume they desire and through modules allows users to customize or select a desired effect or signature sound, e.g., crash, ride, splash, sizzle, bell, china, clash, gong, hi-hat, etc. Through the module the user may also select a desired "kit" or style associated with a performance, e.g., jazz, rock, pop, blues, etc. Additional triggering may be used on the drum kit, e.g., snares, toms, bass, etc., for an overall kit triggering system.

The invention is also directed to providing a multi-zone trigger configuration with multiple trigger devices attached at different locations on a cymbal to produce multiple signals for producing multiple sounds depending on location the cymbal is struck. This feature and capability is very important to users as traditional cymbals may produce different and a variety of distinct sounds depending on location of the strike.

The present invention may include as an additional feature a cymbal silencer pad comprising a slot and channel for a musical instrument trigger and cable for connecting the trigger to an instrument module or other electronic device. The silencer pad may be adapted to be disposed on a cymbal or cymbal stand. The invention may also provide a cymbal choking mechanism, such as described in U.S. patent application Ser. No. 15/433,990, entitled MAGNETICALLY SECURED CYMBAL TRIGGER AND CHOKE ASSEMBLY (Suitor), filed Feb. 15, 2017, incorporated herein by reference.

In one embodiment the invention provides a trigger assembly comprising: a piezoelectric transducer, of any suitable size, with integrated cable, adhered in a housing; made from or combination of a polymer, metal, and/or composite, enclosed with a "cap"; made from or combination of a polymer, metal, and/or composite. This assembly is attached to various surfaces using up to, but not limited to, two threaded fasteners. This assembly is a transducer that sends a signal when the surface it is mounted to such as but not limited to, a cymbal or low volume cymbal.

The present invention provides a trigger and mount assembly for mounting to a surface of an instrument to be triggered for sending electrical signals, e.g., to a drum module. The assembly includes a transducer that detects the mechanical vibrations associated with a drummer striking a surface, e.g., striking a cymbal, and generates and sends an electrical signal for processing by a drum module, e.g., generate a signal for producing the sound of a cymbal when struck. In particular, the assembly includes fastening components specifically intended to mount or affix the trigger device to the surface of a low volume cymbal. In addition, the trigger assembly includes specially designed internal muffling to allow specific frequency response and to cancel out such things as cross-talk, double triggering, etc.

In some embodiments, the securing device and trigger contain magnets, and in some embodiments, the magnets are rare-earth element magnets, such as neodymium magnets.

In some embodiments, the drum trigger further comprises a sound-receiving element, such as a piezoelectric transducer, which translates the vibrations of the drum when played into a digital or analog electrical signal. In some embodiments, the sound-receiving element is protected by a silicone buffer layer and is disposed on the bottom of the drum trigger. The sound-receiving element is only attached or secured to the housing of the drum trigger at the edges of the sound-receiving element, thereby allowing the sound-receiving element to properly flex and function as designed. The sound-receiving element, (e.g. piezoelectric transducer) is electrically coupled to an analog or digital sound management system. In some embodiments, the digital sound management system is a drum sound module, and the piezoelectric transducer is connected to the drum sound module via a TRS jack.

Because at least a portion of the drum trigger can rest on top of the drumhead, it is contemplated that in some embodiments at least a portion of the drum trigger is covered in an impact-resistant gel coating or secured within a housing.

The drum trigger of the present invention is advantageous over prior art drum trigger devices because it is more accurate, more durable, and easier to use than the prior art drum trigger devices. The drum trigger of the present invention is magnetically secured to the drum head, drum shell, or drum lug. This enables the trigger to move with the vibrations of the drum or instrument on which it is disposed while capturing the exact vibrations and tone of the instrument. The present invention can pick up the strike of the drum without being subject to the mechanical force that causes problems with the prior art triggers. For example, with the tension arm triggers the tension arm itself is exerting a mechanical force on the trigger in an attempt to keep the trigger in physical contact with the drum head. The tension arm trigger cannot achieve constant contact and the trigger will "bounce" or be out of physical contact with the drum head after the drum head is struck. The trigger of the present invention overcomes this problem by moving with the drum head. The drum trigger of the present invention may move up and down with the vibrations of the drum head and is not subject to any additional forces or impacts. This enables the trigger of the present invention to accurately capture the exact sound and tone of the drum strike. The accurate sound capture is further improved because of the manner in which the piezoelectric transducer is disposed in the trigger. The piezoelectric transducer is secured only around the perimeter of the transducer, thereby providing the transducer with the ability to flex and function as designed. Unlike prior art drum trigger designs which cause the piezoelectric transducer to be in a rigid configuration, the drum trigger of the present invention enables the piezoelectric transducer to flex without causing double triggering or velocity gaps. A velocity gap is a "gap" in the MIDI input range, typically 0-127, that is not captured by a trigger. This can be a "flat spot" in the range, where jumps from one value to another occur, or "dead spots" where a portion of the range is not captured at all. A double triggering event is where a single strike of a drum or similar musical activity causes the trigger to send a single output that is interpreted as two events. A non-triggering event is where a single strike of a drum or similar musical activity causes the trigger to send a single output that is not interpreted as any event.

The manner of securing the drum trigger of the present invention to the drum head also enables a drum module to be easily configured with the drum trigger. The amount of configuration that is necessary is minimal and does not require the tedious trial-and-error required by prior art drum triggers. When installed and configured the drum trigger of the present invention virtually eliminates instances of velocity gapping, double triggering, and non-triggering. The design and manner of installation of the drum trigger of the present invention also When installed, the drum trigger of the present invention enables a musician to accurately capture the exact playing style used. The drum trigger of the present invention captures the full range of MIDI velocity, the exact tone of the instrument, and the playing style of the individual musician using the drum trigger, which is something that prior art triggers are unable to achieve.

The drum trigger of the present invention has a broad application on any component of a drum kit including snare drums, toms, bass or kick drums, cymbals, and other percussion instruments. The drum trigger of the present invention may be mounted on the shell, rim, lug, or head of a drum and is compatible with all drum head and drum shell types including natural hide drum heads, fabric drum heads, mesh heads, wood drum shells, acrylic drum shells, metal drum lugs, etc. Problems that occur with the prior art drum triggers on smaller drums are exacerbated on larger drums such as kick drums. For example, problems with double triggering and durability that may exist when prior art drum triggers are used on a 13" snare drum are greatly magnified when the prior art drum triggers are used on a 22" bass drum as the drum exerts a greater force on the prior art drum trigger. The drum trigger of the present invention is not susceptible to any of these problems because of the way may be magnetically installed on a drum head, shell, or lug and because of the manner in which the piezoelectric transducer is secured within the housing of the trigger.

The present invention trigger may also be used with other acoustic instruments including guitars, violins, cellos, basses, etc. as a musical instrument pickup.

Various objects, features, aspects and advantages of the inventive subject matter will become more apparent from the following detailed description of preferred embodiments, along with the accompanying drawing figures in which like numerals represent like components.

In one embodiment, the present invention provides an electronically triggered cymbal set adapted to generate electronic signals representing mechanical vibrations when struck during operation of the cymbal set, the cymbal set comprising: a plurality of cymbals having a set of perforations formed therein, each perforation extending from a top surface of a cymbal through to a bottom surface of a cymbal;

a set of electronic triggers respectively adapted to be securely attached to a cymbal, each electronic trigger of the set of electronic triggers comprising an electrical cable and a piezoelectric device adapted to convert mechanical vibrations into an electronic signal representative of the mechanical vibrations sensed by the piezoelectric device during operation of the respective cymbal, the electrical cable being connected at a first end to the piezoelectric device and having a second end providing an output adapted to communicate the electronic signal to a connected device; and a set of fasteners adapted to respectively mount the set of electronic triggers to the plurality of cymbals, each fastener from the set of fasteners comprising an elongated member configured to be received through a perforation formed in a cymbal and being adapted to securely affix an electronic trigger from the set of electronic triggers to a cymbal so as to enable accurate sensing of mechanical vibrations of the cymbal when struck during operation of the cymbal.

The cymbal set of the above embodiment may further comprise, wherein the plurality of cymbals are of the low volume cymbal type with perforations formed therein to minimize the acoustic sound produced during operation of the cymbals. The plurality of cymbals may comprise a hi-hat cymbal, a crash cymbal, and a ride cymbal. The cymbal set ma further comprise a choke mounted to a cymbal and adapted to abruptly interrupt an electronic signal generated by an electronic trigger in association with operation of the cymbal. The cymbal set may further comprise a hi-hat cymbal and a vibration baffle fixably secured to the hi-hat cymbal and being disposed between a top hat and a bottom hat of the hi-hat cymbal, the vibration baffle adapted to soften mechanical vibrations during a selected portion of the operation of the hi-hat cymbal. The cymbal set may further comprise a multi-zone adapter having at least two inputs and at least one output, the multi-zone adapter configured to receive and output an electronic signal from an electronic trigger. The set of electronic triggers may generate a plurality of electronic signals respectively representing operation of an associated cymbal and wherein each of the set of electronic triggers has an output in electrical communication with a respective input of an electronic drum module to deliver a respective one of the plurality of electronic signals. The set of electronic triggers may include a pair of openings and the set of fasteners comprises two elongated members, and wherein the pair of openings is configured to align with a pair of perforations in the cymbal so as to enable the two elongated members to respectively pass through the pair of trigger openings and the pair of cymbal perforations. The set of fasteners may further comprise a pair of threaded nuts and wherein each of the two elongated members are threaded at least in part and are configured to threadably engage with a threaded nut to secure the trigger to the cymbal.

In another embodiment, the present invention comprises a system for electronically triggering a percussion instrument set comprising a cymbal set and a drum set, the system being adapted to generate a set of electronic signals, each of the electronic signals representing mechanical vibrations associated with operation of the percussion instrument set, the system comprising: a set of drums; a set of electronic drum triggers, each one of the set of electronic drum triggers corresponding to a respective one drum from the set of drums and fixably secured to the respective one drum and adapted to sense mechanical vibrations from operation of the respective one drum and convert the mechanical vibrations into an electronic signal for output to a device; a plurality of cymbals having a set of perforations formed therein, each perforation extending from a top surface of a cymbal through to a bottom surface of a cymbal; a set of electronic cymbal triggers respectively adapted to be securely attached to a cymbal, each electronic cymbal trigger of the set of electronic cymbal triggers comprising an electrical cable and a piezoelectric device adapted to convert mechanical vibrations into an electronic signal representative of the mechanical vibrations sensed by the piezoelectric device during operation of the respective cymbal, the electrical cable being connected at a first end to the piezoelectric device and having a second end providing an output adapted to communicate the electronic signal to a connected device; and a set of fasteners adapted to respectively mount the set of electronic cymbal triggers to the plurality of cymbals, each fastener from the set of fasteners comprising an elongated member configured to be received through a perforation formed in a cymbal and being adapted to securely affix an electronic cymbal trigger from the set of electronic cymbal triggers to a cymbal so as to enable accurate sensing of mechanical vibrations of the cymbal when struck during operation of the cymbal.

The system of the above embodiment may further comprise, wherein the plurality of cymbals are of the low volume cymbal type with perforations formed therein to minimize the acoustic sound produced during operation of the cymbals. The plurality of cymbals may comprise a hi-hat cymbal, a crash cymbal, and a ride cymbal. The system may further comprise a choke mounted to a cymbal and adapted to abruptly interrupt an electronic signal generated by an electronic trigger in association with operation of the cymbal. The system may further comprise a hi-hat cymbal and a vibration baffle fixably secured to the hi-hat cymbal and being disposed between a top hat and a bottom hat of the hi-hat cymbal, the vibration baffle adapted to soften mechanical vibrations during a selected portion of the operation of the hi-hat cymbal. The system may further comprise a multi-zone adapter having at least two inputs and at least one output, the multi-zone adapter configured to receive and output an electronic signal from an electronic trigger. The set of electronic triggers may generate a plurality of electronic signals respectively representing operation of an associated cymbal and wherein each of the set of electronic triggers has an output in electrical communication with a respective input of an electronic drum module to deliver a respective one of the plurality of electronic signals. The set of electronic triggers may include a pair of openings and the set of fasteners comprises two elongated members, and wherein the pair of openings is configured to align with a pair of perforations in the cymbal so as to enable the two elongated members to respectively pass through the pair of trigger openings and the pair of cymbal perforations. The set of fasteners may further comprise a pair of threaded nuts and wherein each of the two elongated members are threaded at least in part and are configured to threadably engage with a threaded nut to secure the trigger to the cymbal. The system may further comprise wherein each of the set of fasteners comprises at least two elongated members, a first retention component and a second retention component, the first and second retention components adapted to be disposed opposite one another on opposite sides of the cymbal with that at least two elongated members disposed therebetween when mounted on a cymbal, whereby when affixing the cymbal trigger device to a cymbal the at least two elongated members are disposed through respective ones of the predefined set of perforations, the first and second retention portions being secured to the cymbal and trigger device to affix the trigger device to the cymbal.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

FIGS. 17, 18, 19, and 20 provide diagrams of a trigger disposed on a drum lug in a drum shell according to the present invention.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Figure 1:
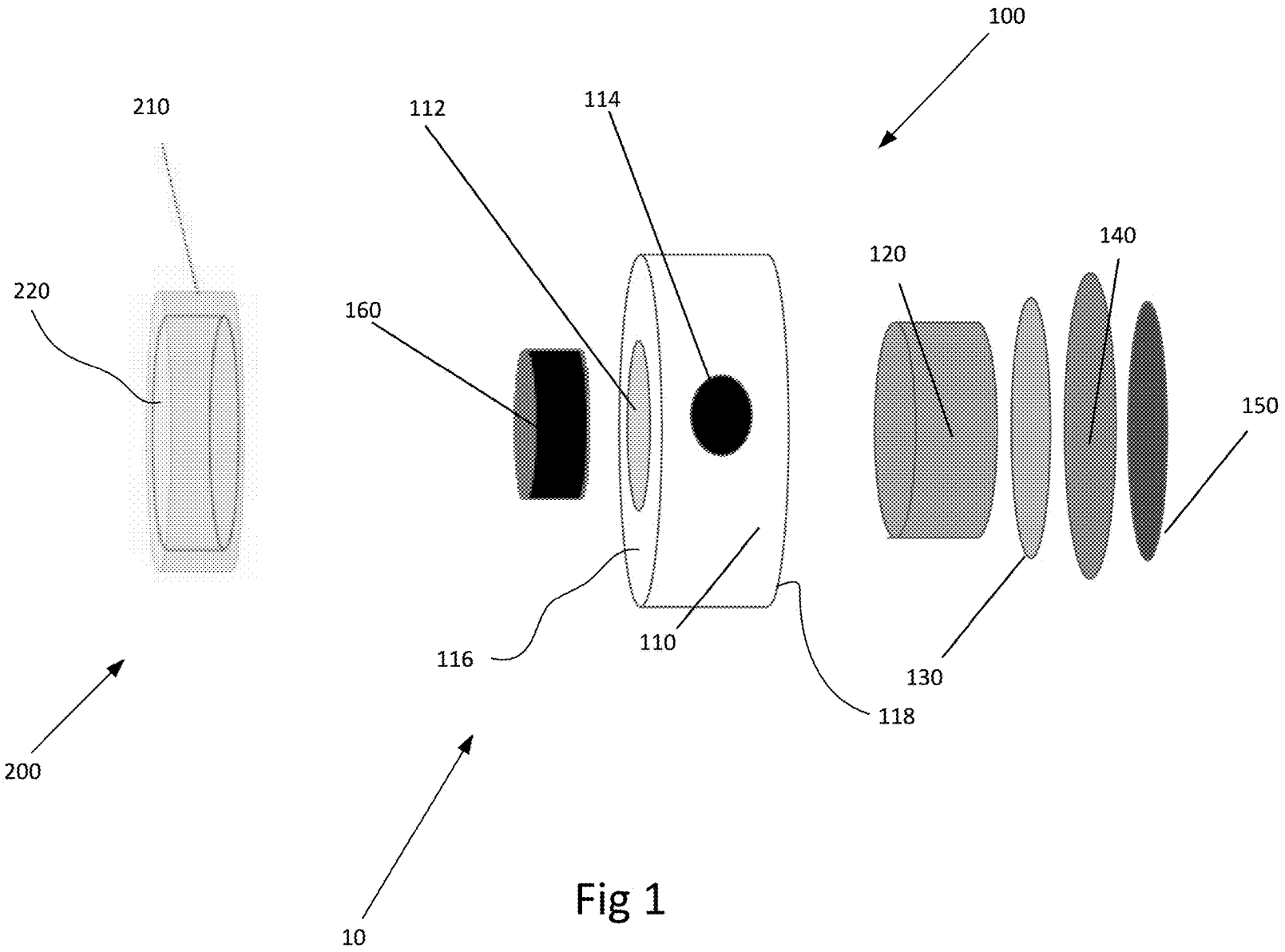
FIG. 1 provides a side view of the component parts of a trigger system according to the present invention.

With reference to FIG. 1, a side view of the primary component parts of a trigger system 10 according to one embodiment of the present invention is provided. The trigger system 10 comprises a trigger 100 and a securing device 200. The trigger 100 comprises a housing body 110 being substantially hollow and having an opening 112 at the top 116, and being substantially open at the bottom 118. The housing body 110 also has a pass-through opening 114 on the side of the housing. Magnet 120 is disposed within the housing body 110 and may be secured to the housing body 110 by an adhesive such as an epoxy or by a set of securing tabs. Silicone buffer layer 130 is disposed between the magnet 120 and the piezoelectric transducer 140. Piezoelectric transducer 140 is disposed at the bottom of the housing body 110 and may sit in a lip, ridge, or indentation at the bottom of the housing and may be secured by an adhesive such as an epoxy. Silicone buffer layer 150 is disposed on the exterior of the bottom 118 of the housing 110.

The housing body 110 of the trigger 100 may be substantially cylindrical, cuboid, or any other suitable shape. The top 116 of the housing may not have opening 112 and may instead be flat and covered in a buffer layer composed of silicone, foam, foam-rubber, or other suitable material. In a preferred embodiment, the silicone buffer layer 130 and silicone buffer layer 140 will comprise a thin layer of silicone secured in the housing body 110 by an adhesive such as an epoxy. However, the silicone buffer layer 130 and silicone buffer layer 140 may also be secured directly to the magnet 120 and piezoelectric transducer 140 respectively. The silicone buffer layer 130 is adapted to provide a physical and electrical barrier between the magnet 120 and piezoelectric transducer 140, and may comprise any other suitable material such as rubber or foam. The silicone buffer layer 150 is adapted to provide a non-skid and impact resistant layer on the bottom 118 of the trigger housing 110, and may comprise any other suitable material such as rubber or foam. The silicone buffer layer 150 keeps the trigger 100 from sliding or shifting from its position even when the trigger 100 is subjected to intense vibrations. Grommet 160 is adapted to fit within the opening 112 on the top 116 of the housing 110, and may comprise a material such as rubber, silicone rubber, or similar suitable elastic material. The grommet 160 may have an opening and may be adapted to fit on and/or receive a lug, screw, or other similar protrusion. The magnet 120 in the trigger 100 may be a neodymium or similar rare earth magnet, which are strong permanent magnets made from alloys of rare earth elements, with suitable Gaussian pull strength, e.g. at least 2500 Gauss. The magnet 120 may comprise the following technical specifications: 20 mm diameter×5 mm thick (0.79" diameter×0.20" thick); material: Neodymium (NdFeB); grade: N48; coating: Nickel (Ni); magnetization: through thickness; and pull force: 19.68 pounds. The magnet 120 is adapted to releaseably and magnetically secure the trigger 100 to a ferrous or magnetic structure such as in the securing device 200. However, in some embodiments the magnet 120 may simply be a magnetically attractive plate or disk instead of a magnet and may be attracted to a magnet 220 in the securing device, or vice versa.

The securing device 200 comprises a housing 210 having an opening adapted to receive a magnet 220. Securing device 200 may also be a magnet 220 without housing 210 and having a coating such as a rubberized coating or an impact-resistant gel coating, such as plastic, plastic blend, rubber, rubber blend, or other suitable impact-resistant material. Similarly, the magnet 120 in the trigger 100 may also have a coating such as a rubberized coating or an impact-resistant gel coating, such as plastic, plastic blend, rubber, rubber blend, or other suitable impact-resistant material. The securing device 200 may also have an additional buffer layer on the bottom of the securing device 200 that may be comprised of silicone, rubber, or other suitable material. If used, this layer would aid in keeping the securing device in place and in magnetic attraction with the trigger 100.

The piezoelectric transducer 140 may also be any suitable sound-receiving unit capable of translating a mechanical signal (e.g. vibration of the drumhead) into an electrical (analog or digital) sound signal. The piezoelectric transducer 140 may have the following technical specifications: plate diameter: 27 mm (1.06 inches); element diameter: 20 mm (0.787 inches); plate thickness: 0.54 mm (0.021 inches); lead length: ~50 mm (1.96 inches); plate material: brass; resonant frequency (kHz): 4.6+/−0.5 kHz; resonant impedance (ohm): 300 maximum; and capacitance (nF): 20.0+/−30% [1 kHz].

Figure 3:
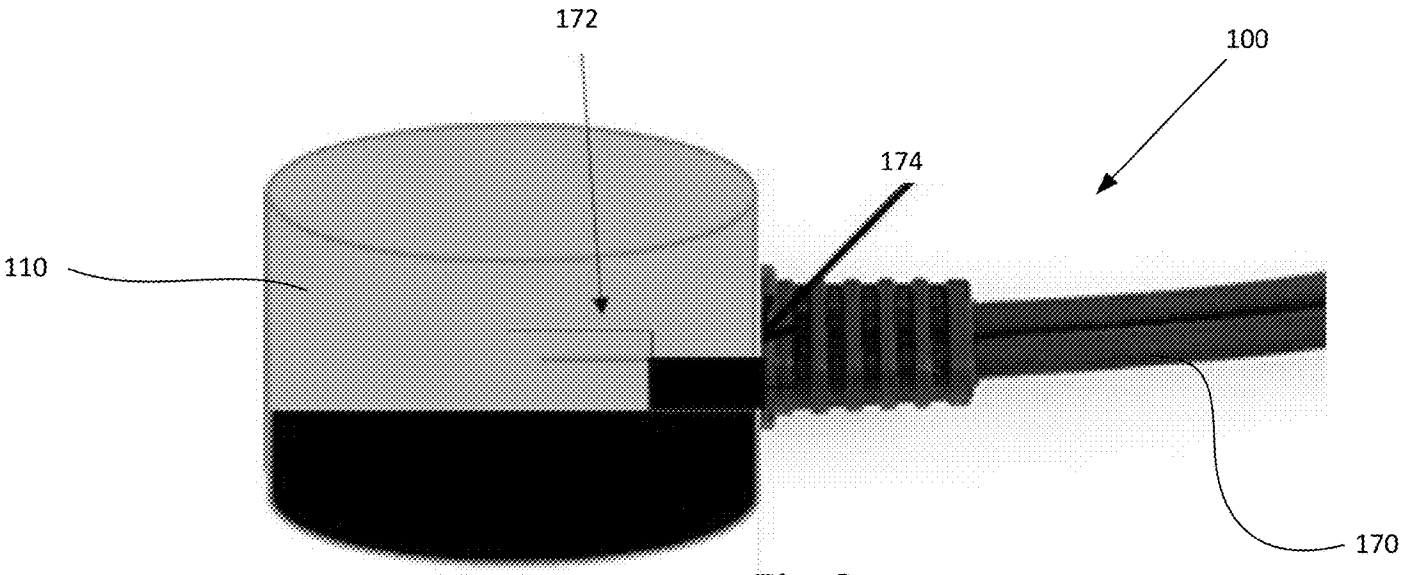
FIGS. 3 and 4 provide side and perspective views respectively of a trigger with a strain relief according to the present invention.

In one embodiment, the transducer 140 may instead be a force sensing resistor ("FSR") capable of producing differing voltages as force is applied to the sensor. Many modules, such as drum module 300 shown in FIG. 3, are not capable of using the output of an FSR. Furthermore, an FSR may not produce the desired outputs with similar accuracy and responsiveness compared to a piezoelectric transducer. However, the use of an FSR instead of a piezoelectric transducer 140 may be desirable in some applications. In some embodiments, the trigger system 10 is adapted to be mounted on a drum head in a "Thru-Head" configuration, shown in FIG. 16, a drum lug in a "Thru-Lug" configuration, shown in FIGS. 17-20, a drum shell in a "Thru-Shell" configuration, shown in FIG. 21 on a cymbal, shown in FIG. 22, or on a cymbal stand, shown in FIGS. 23-27. The trigger system 10 may also be employed, placed, or installed by way of the magnet 120 or secured by the securing device 200 to translate a mechanical signal into an electrical signal in other suitable applications. The trigger 100 may also comprise a potentiometer or a resistor to provide an adjustment or resistance to the trigger 100 on the trigger 100 itself.

The use of rare earth magnets on the top in the securing device 200 and bottom in the trigger 100 of a drumhead provides a superior ability to capture and transfer vibrations from the playing surface to a piezoelectric transducer 140 regardless of the size of the drum. The strength of the magnets 120 and 220 also provides a dampening effect that makes it ideal for both electronic and hybrid drums with no permanent alterations to the drum. Additionally, by being magnetically attached, the trigger 100 may vibrate along with the surface or instrument on which it is attached without affecting the sound, tone, or timbre of the instrument. Floating also enables the trigger 100 to be far more sensitive than traditional drum triggers. Being magnetically attachable also enables the trigger 100 to be placed anywhere desired by the musician or user. Additionally, because the trigger 100 may be disposed within a drum or other instrument, the trigger is not likely to be damaged from being struck or impacted in normal use or operation as the only electronic components are inside the instrument out of harm's way.

Figure 2:
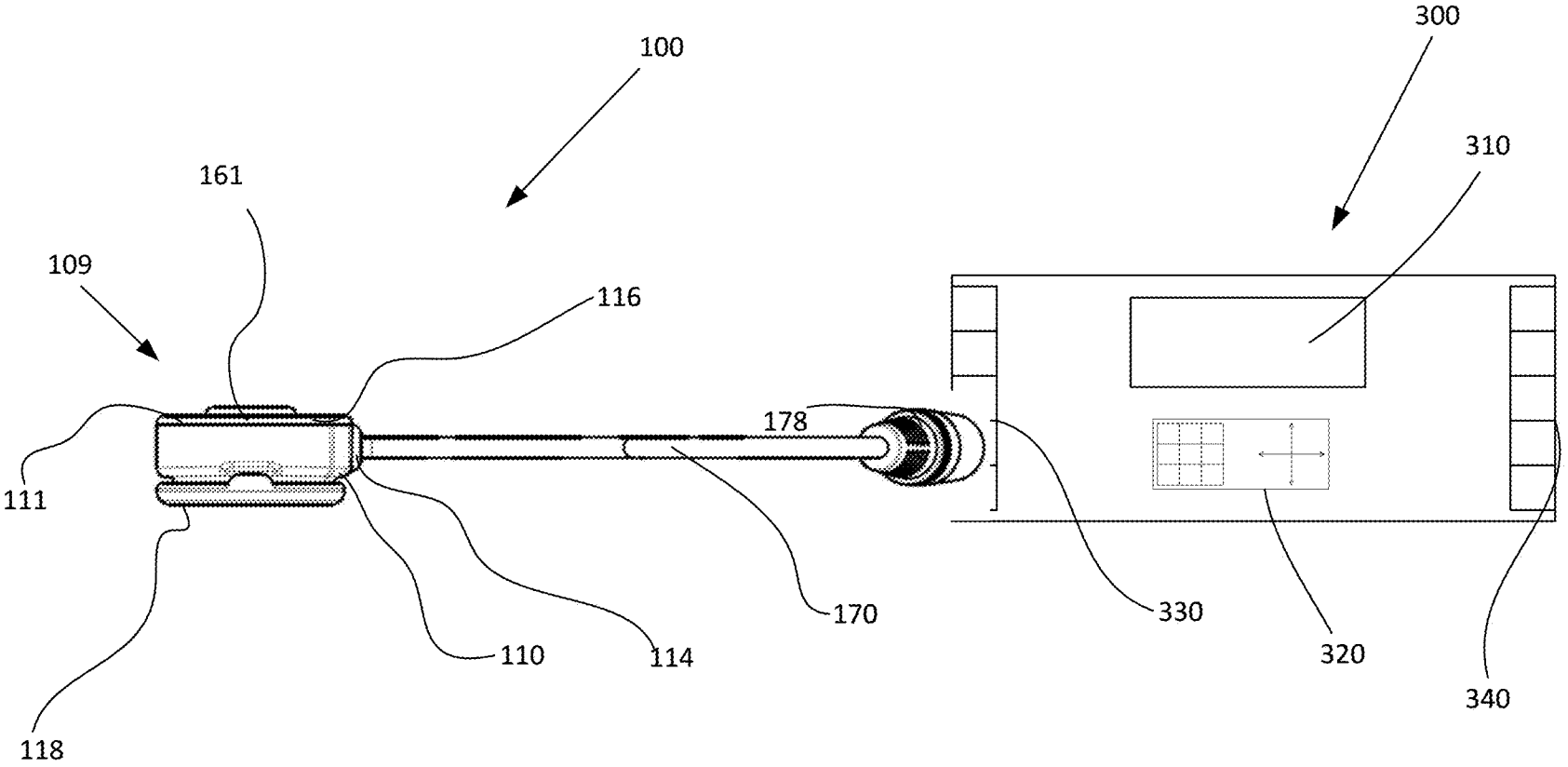
FIG. 2 provides a perspective view of a trigger according to the present invention.

With reference now to FIG. 2, a perspective view of a trigger 100 according to the present invention is provided. The trigger 100 comprises the housing 109, comprising the housing body 110 and magnet plug 111 which has a grommet 161 disposed in the top of the magnet plug 111. In this embodiment of the trigger 100, shown in greater detail in FIGS. 4-6, 9B, and 10-14, the housing body 110 holds the piezoelectric transducer 140 and the magnet 120 is held between the housing body 110 and the magnet plug 111. The trigger 100 therefore comprises a two-piece shell with the primary component of the shell being the housing body 110 and the secondary component of the shell being magnet plug 111. The pass-through opening 114 is adapted to permit an electrical lead 170 to pass through the pass-through opening 114. The electrical lead 170 may have a tip-ring-sleeve (TRS) jack, XLR connector, or other suitable connector at the termination 178 of the electrical lead 170. The termination 170 is adapted to operatively connect to an electronic module 300, which may be a drum module or other suitable audio module. A list of exemplary drum module with links to their descriptions and methods of operation is provided in Table 1, and all descriptions are incorporated herein by reference in their entirety. Additionally, descriptions of electronic drum modules can be found in Wikipedia articles entitled "Roland V-Drums", https://en.wikipedia.org/wiki/Roland_V-Drums, and "Electronic Drum", https://en.wikipedia.org/wiki/Electronic_Drum, both of which are incorporated herein in their entirety.

| BRAND | MODULE | Information |
|---|---|---|
| ROLAND | TD-30 | http://www.rolandus.com/products/td-30/ |
| ROLAND | TD-25 | http://www.rolandus.com/products/td-25/ |
| ROLAND | TD-15 | http://www.rolandus.com/products/td-15/ |
| ROLAND | TD-11 | http://www.rolandus.com/products/td-11/ |
| ROLAND | TM-2 | http://www.rolandus.com/products/tm-2/ |
| ALESIS | DM-10 | http://www.alesis.com/dm10prokit |
| ALESIS | DM-8 | http://www.alesis.com/dm8prokit |
| 2BOX | DRUMMIT 5 | http://www.2box.se/US/pages/products/ |
| YAMAHA | 502 SERIES | http://usa.yamaha.com/ |
| YAMAHA | DTX950K | http://usa.yamaha.com/ |

A drum module 300 may have a display 310, set of controls 320, a set of inputs 330, and a set of outputs 340. The trigger 100 is adapted to connect to the module 300 by way of the electronic lead 170 to an input 330. Configuring the drum module is performed by manipulating the inputs 320 and using the display 310 to view the current configuration and options for the module 310. The module 300 may be connected to additional equipment such as speakers, computers, amplifiers, and additional electronic modules by way of outputs 340 which may comprise universal serial bus (USB) ports, TRS receptacles, XLR female receptacles, RJ-45 jacks, or other suitable connections.

In typical operation, a mechanical signal, e.g. a strike of a drum head or drum shell, is translated by the piezoelectric transducer 140 in the trigger 100 into an electrical signal. This electrical signal may comprise a level which may fall on a range of 127 or more levels. This signal is received by the module 300 and the module 300 determines how to interpret the signal. For example, if the trigger 100 is disposed on a drum, and the signal is an electrical representation of the strike of a drum, the module 300 may determine which sound from a library of sounds to output to the outputs 340. The module 300 may also make this determination based on a set of settings used to configure the module. The set of settings may be selected from a library of configurations or settings stored in or loaded onto the module 300. The module 300 may be manipulated by the inputs 320 to fine tune the module to the particular implementation of the trigger 100. These fine tunings may be used to employ a plurality of triggers 100 on a single instrument. The trigger 100 is adapted to be used with a plurality of other triggers 100 to create a set of "zones" on an instrument, e.g. a drum. The trigger 100 does not receive cross-talk interference from other triggers like trigger 100 used on the same instrument, and when used as a set of triggers 100, does not suffer from "hot-spotting" which is the higher sensitivity of particular areas on an instrument such as a drum.

Figure 4:
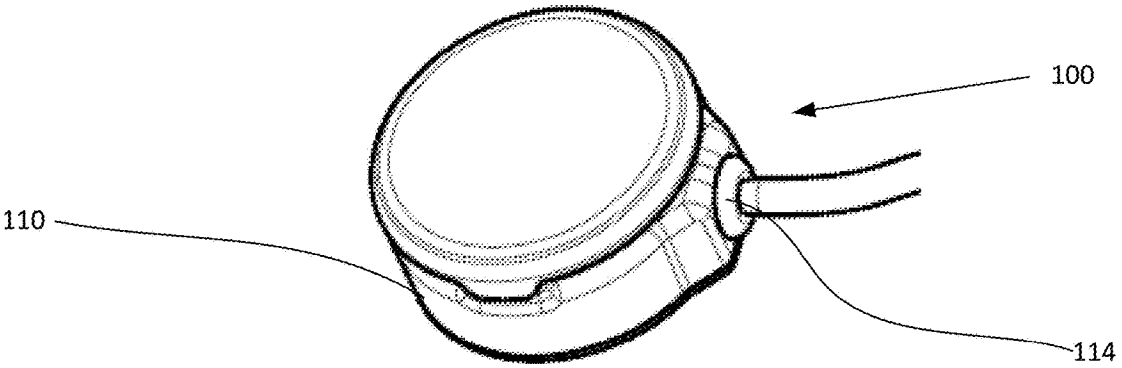

With reference now to FIGS. 3 and 4, side and rear views respectively of a trigger 100 with a strain relief sleeve 174 according to the present invention are provided. The electrical lead 170 extending from the housing body 110 of the trigger 100 may be bent at various angles depending on the implementation of the trigger 100. It may therefore be necessary to employ a form of strain relief such as strain relief sleeve 174 to prevent kinking, fraying, or damage to the electrical lead 174. The strain relief sleeve 174 may be attached to the opening 114 which may be modified to accommodate the shape of the strain relief sleeve 174.

Figure 5:
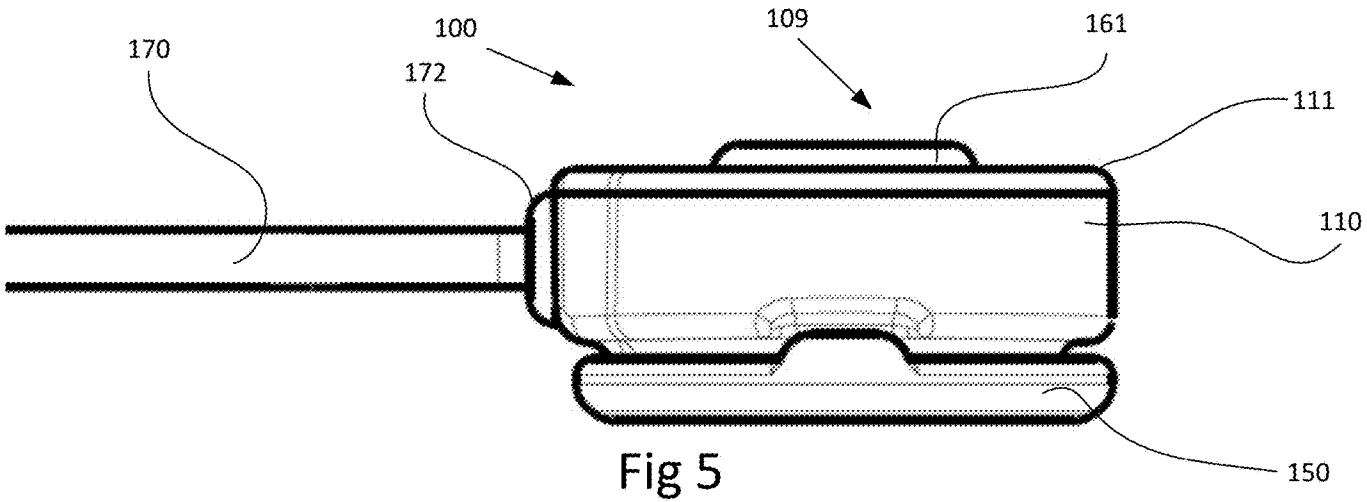
FIGS. 5 and 6 provide side and top views respectively of a trigger with electrical lead according to the present invention.
Figure 6:
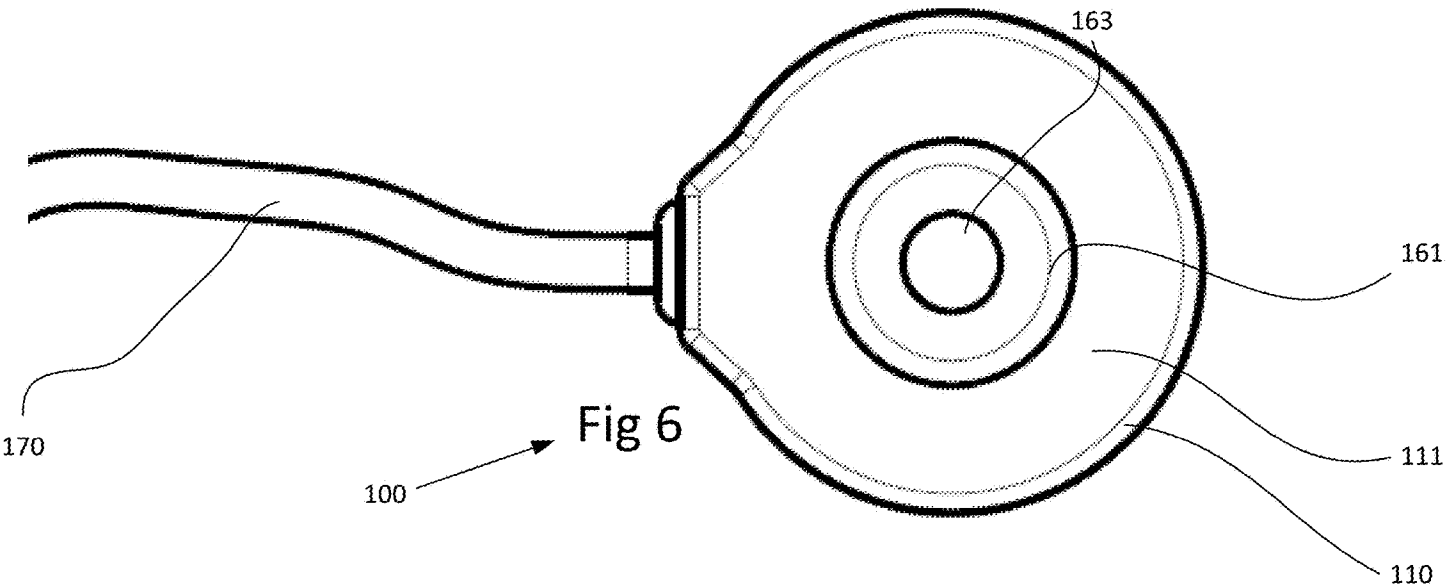

With reference now to FIGS. 5 and 6, side and perspective views respectively of a trigger 100 with electrical lead 170 according to the present invention are provided. The trigger 100 is shown with the electrical lead 170 extending from the housing body 110 of the trigger 100. Electrical lead 170 may comprise a set of two or more wires 172 that connect to electrical connections 146 on the piezoelectric transducer 140 as shown in FIGS. 14 and 15. The grommet is disposed at the top 116 of the trigger 100 and has an opening 162 in the center of the grommet 161 adapted to receive a lug or other suitable mounting protrusion. The silicone buffer layer 150 is disposed at the bottom 118 of the housing body 110 of the housing 109 and serves as a physical buffer for any vibrations or impacts and also serves to help secure and stabilize the trigger 100. An additional buffer layer may be used in some embodiments to provide additional protection to the trigger 100 when attached to a lug on the grommet 161 side of the trigger 100.

Figure 7:
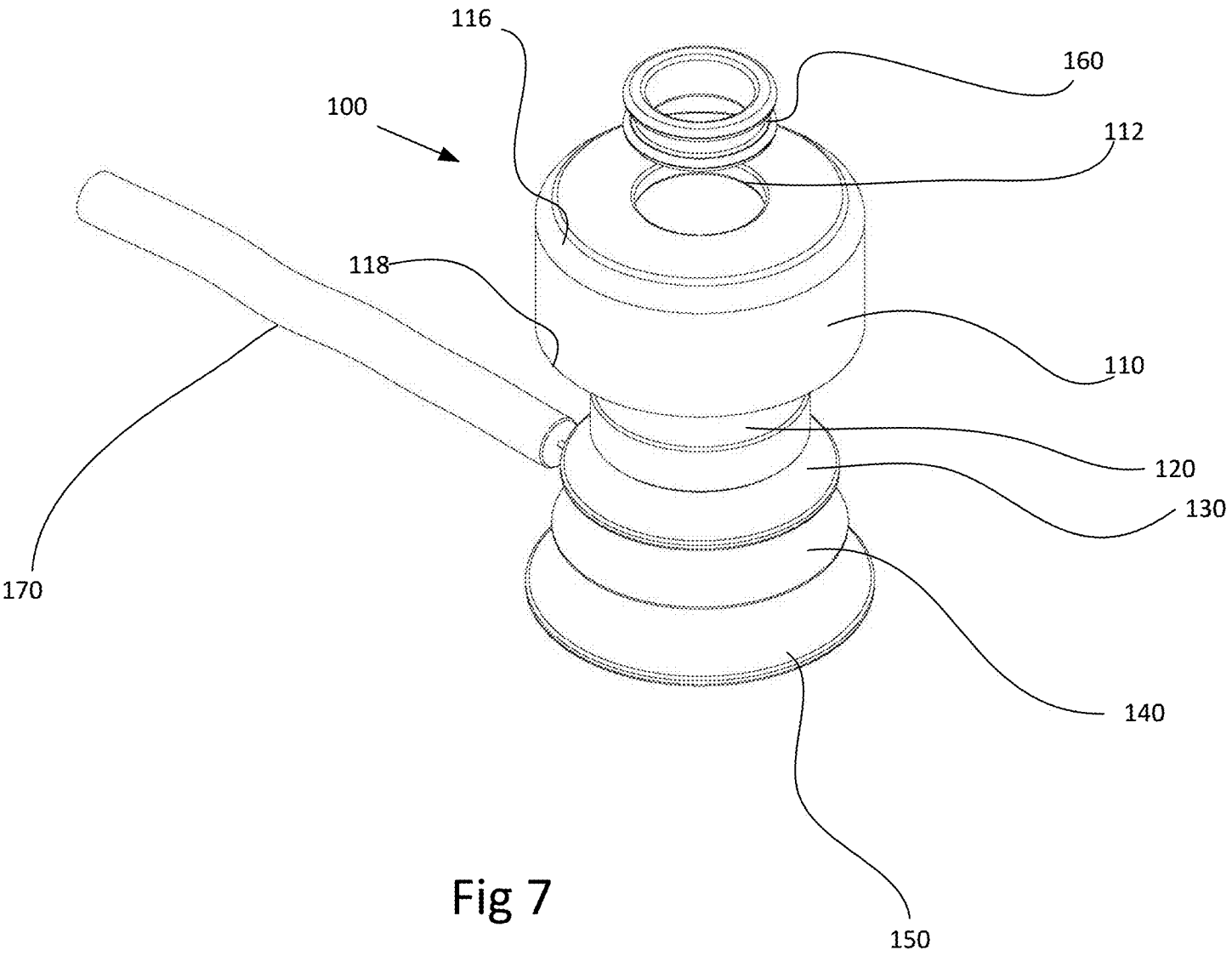
FIG. 7 provides a perspective view of a trigger showing the trigger components according to the present invention.
Figure 8:
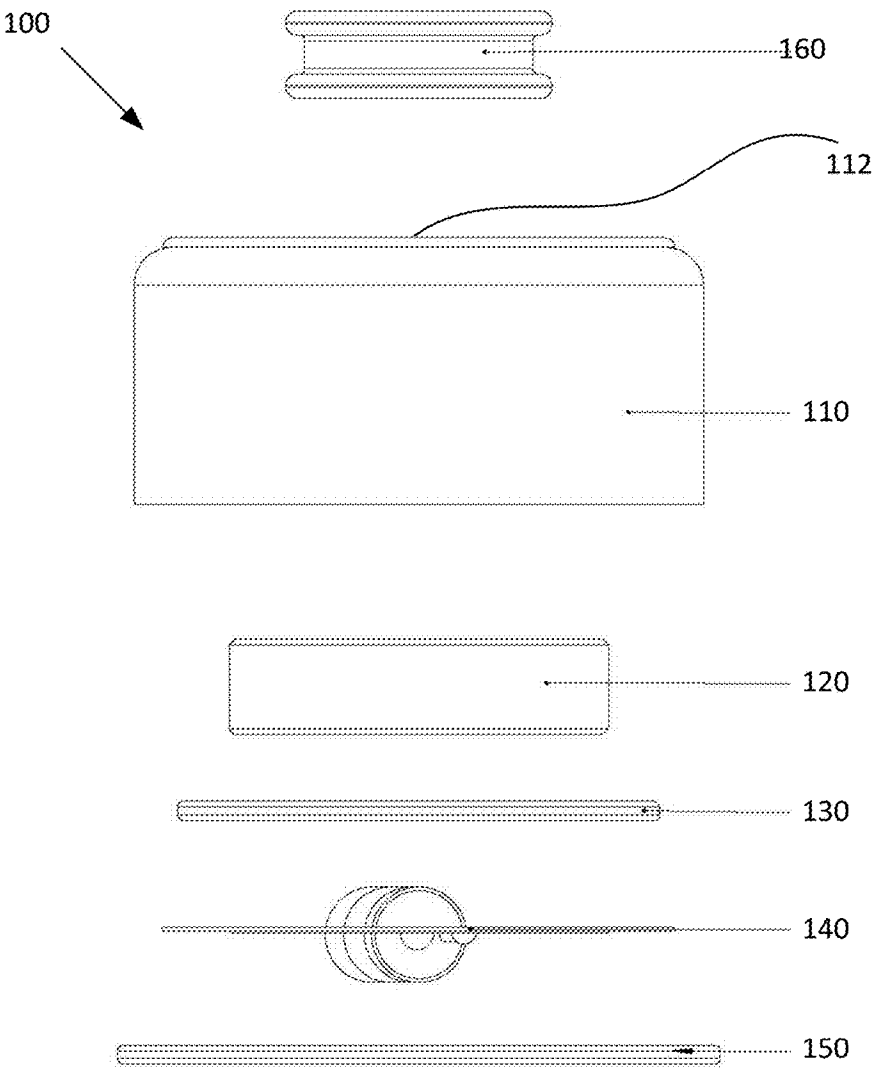
FIG. 8 provides a side view showing the components of a trigger according to the present invention.

With reference now to FIG. 7 a perspective view of an alternate embodiment of trigger 100 showing the trigger 100 components according to the present invention is provided. FIG. 7 provides an "expanded" or "exploded" view of the components of the trigger 100, showing the order in which the components may be disposed within the housing 110. The grommet may be disposed in the opening 112 at the top 116 of the housing 110. Within the housing 110, the magnet 120 may be secured to the interior of the top 116 of the housing body 110 by way of an adhesive. The silicone buffer layer 130 may be secured to and disposed on the magnet 120 within the housing. The piezoelectric transducer 140 is disposed at the bottom 118 of the housing body 110 and may be placed in a lip or groove at the bottom of the housing 110. The electrical lead 170 passes through the pass-through opening 114 in the housing body 110 to connect to the piezoelectric transducer 140. The silicone buffer layer 150 may be disposed on the bottom 118 of the housing body 110 to provide protection to the piezoelectric transducer 140. FIG. 8 provide a side view of the trigger 100 showing the components described with respect to FIG. 7. The housing body 110 may have a diameter of 30 mm, a bottom 118 with an opening of 27 mm, giving the housing body 110 a thickness of 1.5 mm. The housing body 110 may be 13.95 mm tall. The opening 112 may be 12 mm in diameter. The pass-through opening may be 5 mm in diameter and the middle of the pass-through opening 114 may be 3.2 mm from the bottom 118 of the housing 110.

Figure 9B:
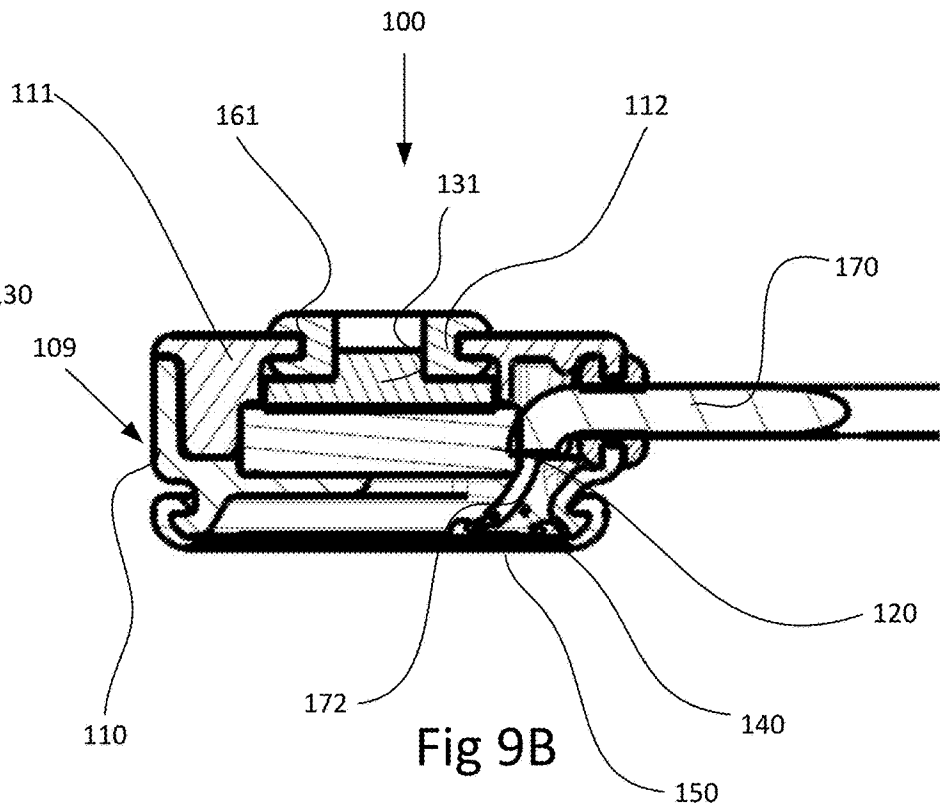
FIG. 9B provides a side cross-section view of a trigger according to the present invention.
Figure 9A:
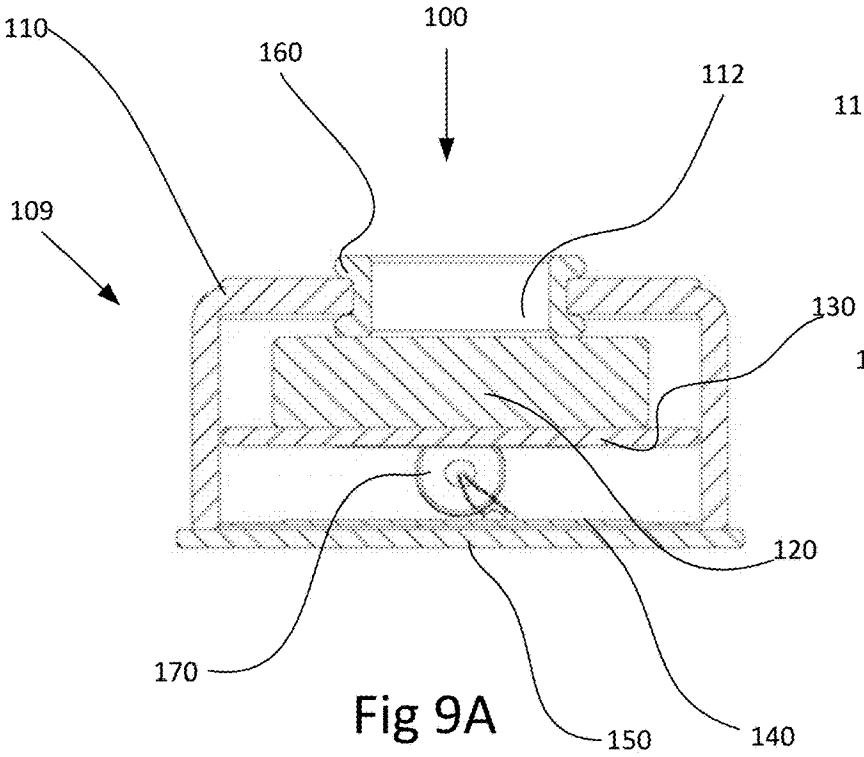
FIG. 9A provides a side cross-section view of a trigger according to the present invention.

With respect to FIG. 9A, a side view showing an alternate embodiment of the components of a trigger 100 according to the present invention is provided. In this embodiment, the silicone buffer layer 130 is disposed between the magnet 120 and the interior of housing body 110 of housing 109. This may be to prevent movement of the magnet 120 and to provide protection to the interior of the housing body 110 when the trigger 100 is employed primarily in a grommet 160 attachment configuration. The piezoelectric transducer 140 may be disposed within the housing body 110 as shown, but in most implementations is optimally disposed at the bottom 118 of the housing body 110 abutting the silicone buffer layer 150.

With reference now to FIG. 9B a side cross-section view of a trigger according to the present invention is provided. In FIG. 9B the trigger is primarily comprised of a housing 109 comprising housing body 110 and magnet plug 111. The magnet plug 111 secures the magnet 120 between the magnet plug 111 and the housing 110. A grommet 161 fits in the opening in the magnet plug 111 and an adapter post 131 fits in the grommet 161 and keeps the magnet 120 secure within the housing body 110 and magnet plug 111. The piezoelectric transducer 140 is secured in the housing body 110 by the silicone buffer layer 150 that is disposed on the bottom of the housing body 110 and is secured to the outer lip 1002, shown in FIG. 10. The wires 172 connect the piezoelectric transducer 140 to the electrical lead 170 and are routed through the housing interior opening 1006 shown in FIG. 11. A space 1005 behind the piezoelectric transducer 140 enables the transducer 140 to flex within the housing 110. This flexing is critical to accurately capturing both the velocity and tone of an instrument, e.g. the strike of a drum. The manner in which the trigger 100 is disposed on a drum head such as drum head 2400 shown in FIG. 16, using the securing device 200 enables the trigger to move with the drum head 2400 and more quickly return to a steady state wherein the voltage produced by the piezoelectric transducer 140 is below a threshold that would cause a triggering event in a module such as module 300.

Figure 11:
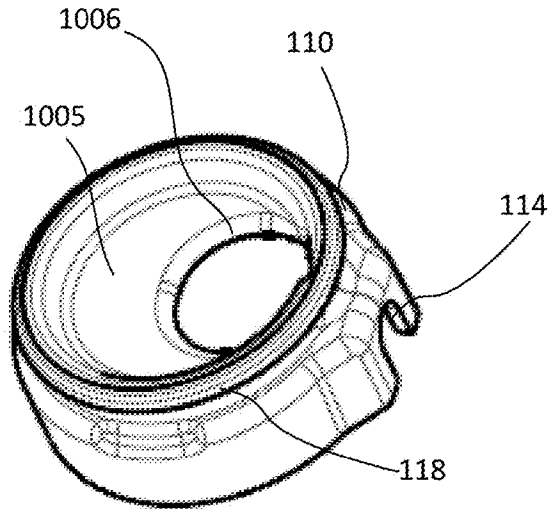
FIGS. 10, 11, 12, and 13 provide side cross-section and top perspective views of a trigger housing and magnet plug according to the present invention.
Figure 13:
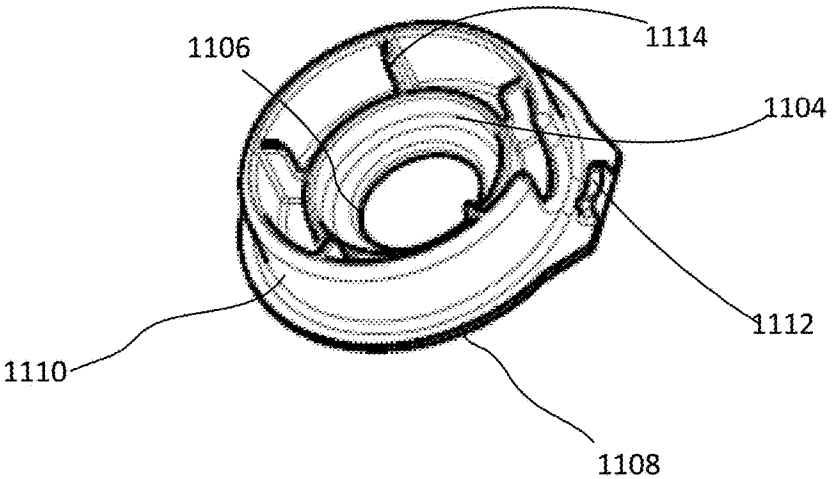
Figure 10:
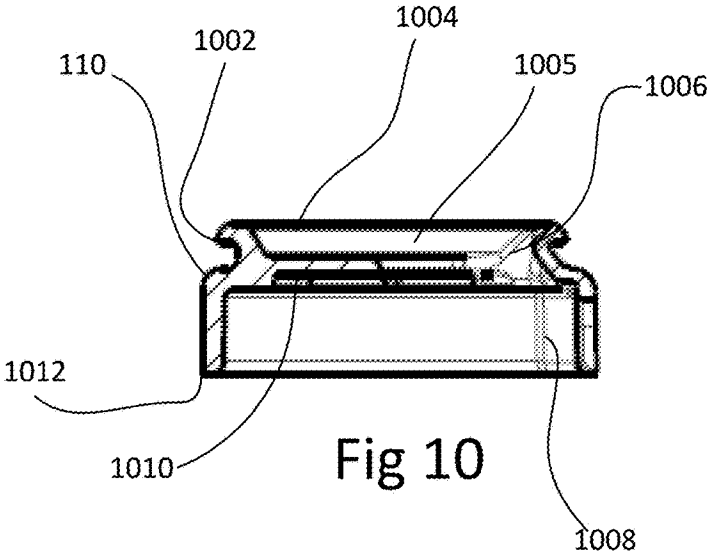
Figure 12:
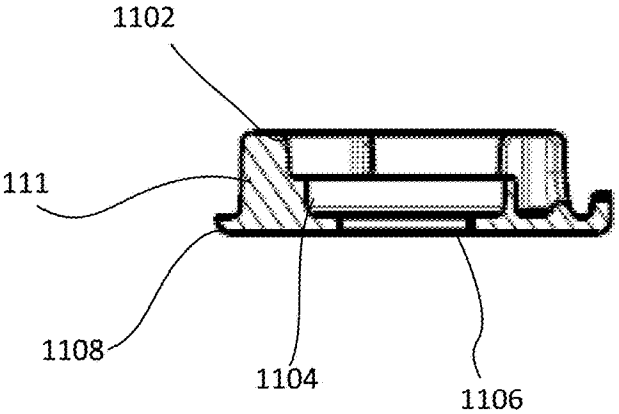

With reference now to FIGS. 10, 11, 12, and 13, side cross-section and top perspective views of a trigger housing body 110 and magnet plug 111 according to the present invention are provided. FIGS. 10 and 11 show the housing 110, and FIGS. 12 and 13 show the magnet plug 111. The housing body 110 has an outer lip 1002 at the bottom 118, an inner lip 1004, an interior opening 1006, an inner area 1008, and a magnet seat 1010. The piezoelectric transducer 140 is disposed in the inner lip 1004 and is held in place and protected by the silicone buffer layer 150 that is disposed on the bottom 118 and secures over the outer lip 1002. A set of wires 172 connect the piezoelectric transducer 140 to the electrical lead 170 and feed through the interior opening 1006 to the pass-through opening 114. The chamber 1005 provides space for the piezoelectric transducer 140 to vibrate so that it can accurately capture analog signals from a drum head or other musical instrument. The magnet plug 111 is adapted to fit within the plug opening 1008 of the housing 110. The magnet 120 sits within the magnet opening 1102 of the magnet plug 111 and is also received by the magnet opening 1010 of the housing 110. The adapter post 131 is disposed within the adapter opening 1104 and serves as a buffer between the magnet 120 and the grommet 160. The grommet 160 is disposed within the grommet opening 1106 of the magnet plug 111. The magnet plug lip 1108 abuts the housing top 1012 when the magnet plug 111 is disposed within the housing 110. A set of stabilizing posts 1114 within the magnet plug 111 hold the magnet 120 within the magnet plug 111.

Figure 14B:
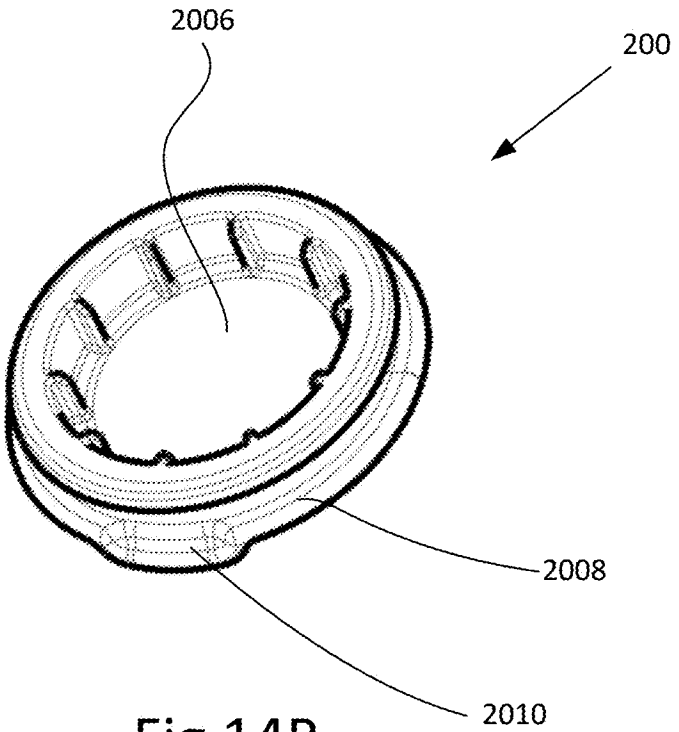
FIGS. 14A and 14B provide side cross-section and top perspective views of a securing device according to the present invention.
Figure 14A:
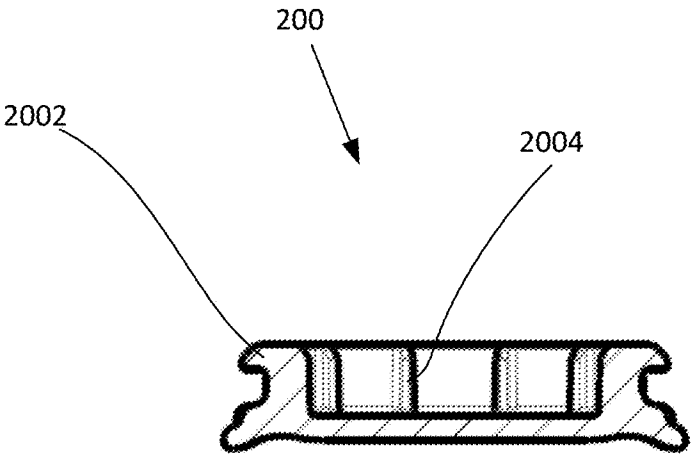

With reference now to FIGS. 14A and 14B, side cross-section and top perspective views of a securing device according to the present invention are provided. The securing device 200 secures the trigger 100 to a drum head or other musical instrument. The outer lip 2002 of the securing device 200 is adapted to secure a silicone buffer. A magnet such as magnet 120 would be disposed in the interior 2006 of the securing device 200 and a set of stabilizing posts 2004 would secure the magnet in place. A tab 2010 on the bottom lip 2008 enables the securing device 200 to be easily removed from a surface on which it is placed.

Figures 15A, 15B:
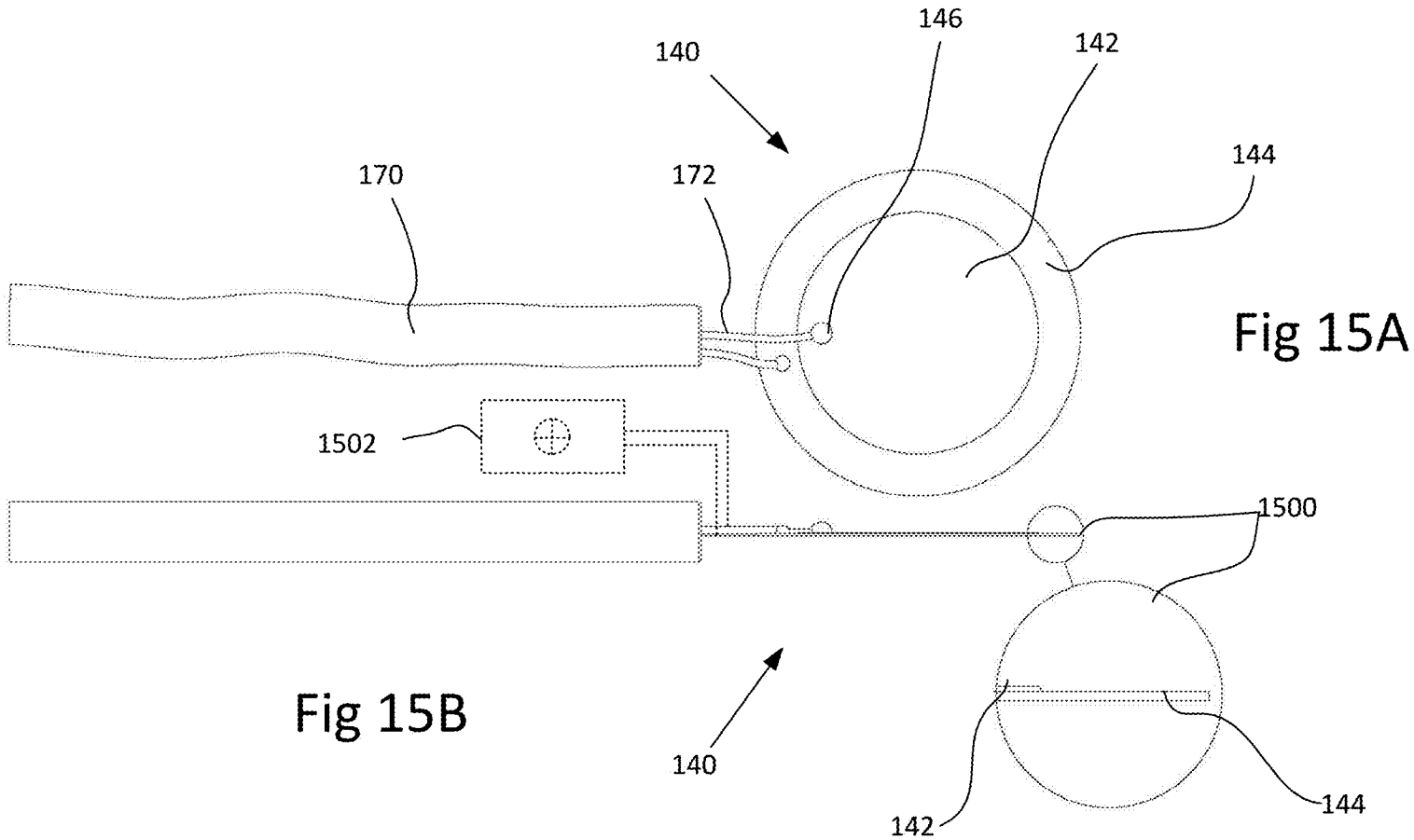
FIGS. 15A and 15B provide plan and side views respectively of a piezoelectric transducer according to the present invention.

With reference now to FIGS. 15A and 15B, plan and side views respectively of a piezoelectric transducer 140 according to the present invention are provided. In FIG. 14, the electrical lead 170 with set of wires 172 is shown electrically and operatively connected to electrical connections 146 on the bottom portion 144 and top portion 142 of the piezoelectric transducer 140. The top portion 142 may be comprised of ceramic or other suitable material and the bottom 144 may be comprised of brass or bronze or other suitable non-magnetic metal. The material used for the bottom 144 must not be magnetically attractive or the magnet 120 used in the trigger 100 may interfere with the operation of the piezoelectric transducer 140. The inset 1500 shown in FIG. 15 shown the detail of the thickness of the top portion 142 and bottom portion 144 of the piezoelectric transducer 140. The top portion 142 may a have a diameter of 20 mm and be 0.1 mm thick, and the bottom portion may have a diameter of 27 mm and be 0.2 mm thick. When used in a housing such as housing body 110 or housing 111, shown in FIGS. 13A and 13B, the piezoelectric transducer needs to be able to bend and flex to accurately transducer the mechanical inputs into electrical signals. The buffer layers such as layers 130 and 150 shown in FIG. 1 isolate the piezoelectric transducer from the magnet and the surface on which the trigger 100 is placed, but still place the piezoelectric transducer 140 in physical abutment with the surface. Additionally, a potentiometer 1502 may be attached to the wires 172 to enable the output of the piezoelectric transducer 140 to be more finely tuned by adding additional resistance to lower the voltage output.

Figure 16:
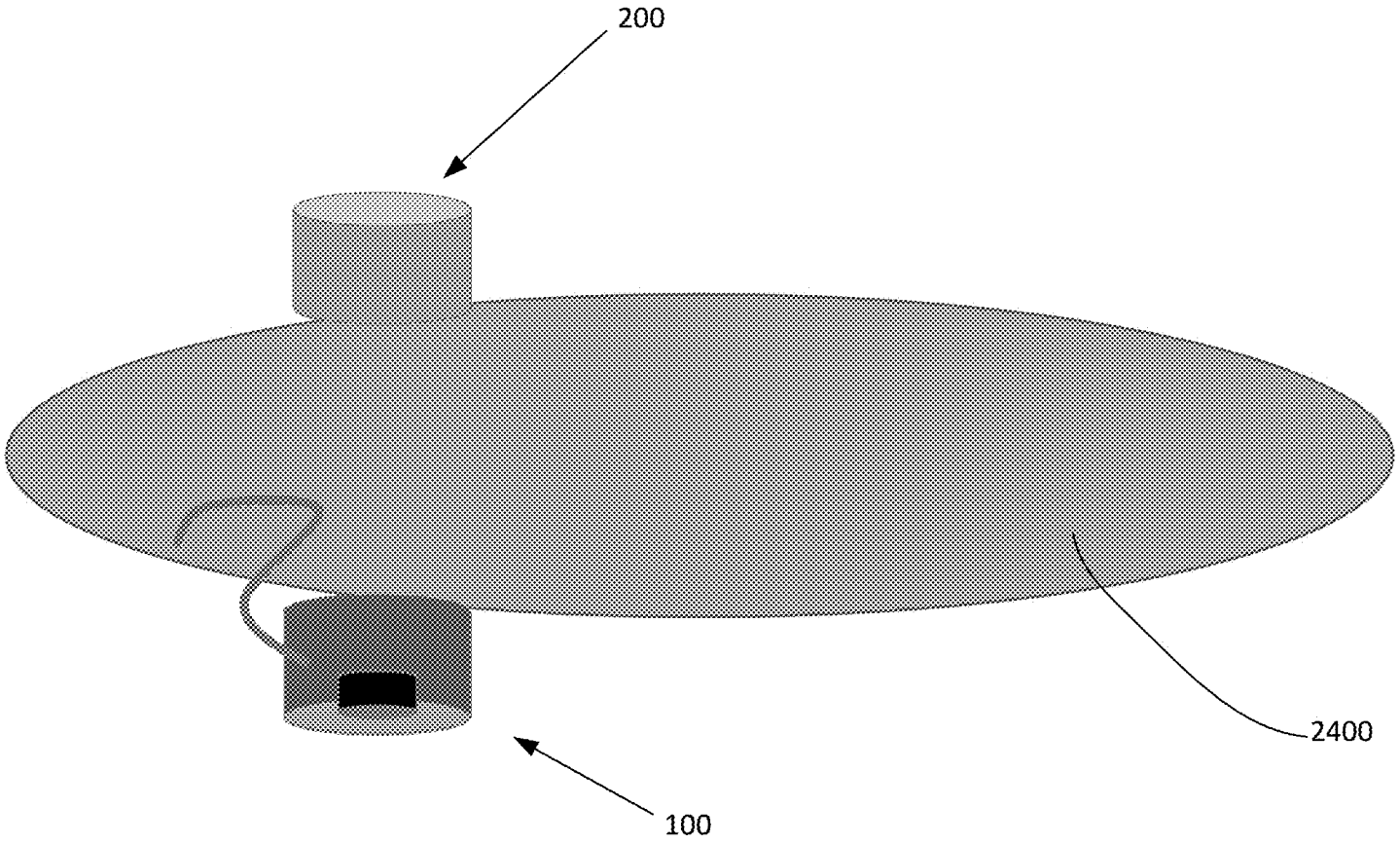
FIG. 16 provides a diagram showing a trigger and securing device being attached to a drum head according to the present invention.

With reference now to FIG. 16, a diagram showing a trigger 100 and securing device 200 being placed on a drum head 2400 in a "Thru-Head" configuration according to the present invention is provided. In this configuration, the securing device 200 and trigger are configured to straddle the drumhead 2400. This enables the trigger 100 to be installed on most drum head with minimal effort and without using adhesives, glues, putties, or other potentially destructive or damaging securing methods. The drum head 2400 may be for an acoustic or electric drum and may comprise an acoustic drum head, single layer mesh head, or multiple layer mesh head. In a preferred configuration, the trigger 100 is used with a mesh drum head 2400 to accurately replicate the feel of playing on an acoustic drum head while reducing the noise produced when playing. A mesh head 2400 would also be variably adjustable for a desired tension compared to a multi-ply drum head. Using the trigger 100 as shown in FIGS. 16-27 enables the trigger 100 to accurately pick up the mechanical movement of the instrument and transmit the mechanical movement as an electrical signal. The trigger 100 used in this manner has only a 20% signal loss compared to a 60% or greater loss of traditional drum triggers. The trigger 100 records a sharp "attack", an input having an immediate spike and sharp drop off, of a drum strike compared to traditional drum triggers and also accurately can read and transmit 127 midi levels of input. Additional triggers 100 may be placed on the drum head 2400 and if multiple triggers 100 were used the triggers 100 would not "hot-spot" and would not experience crosstalk interference.

With reference to FIGS. 17-20, diagrams of a trigger 100 disposed on a drum lug 2522 in a drum shell 2500 in a "Thru-Lug" configuration according to the present invention is provided. The drum shell 2500 may have a plurality of tensioners 2520 attached to the exterior of the shell 2500 by a number of lugs 2522 disposed on the interior 2510 of the shell 2500. The grommet 160 of the trigger 100 is adapted to fit over a lug 2522, and the magnet 120 within the trigger 100 is magnetically attracted to the lug 2522. The trigger 100 is thereby magnetically and releaseably secured to the lug 2522. In this configuration, vibrations from striking a drum head or the drum shell 2500 are transmitted through the tensioner 2520 and lug 2522 to the trigger 100. This implementation of the trigger 100 may be preferred when the use of an external securing device 200 is not desired in order to maintain the "look" of the drum shell 2500, especially when used with acoustic drums.

Figure 21:
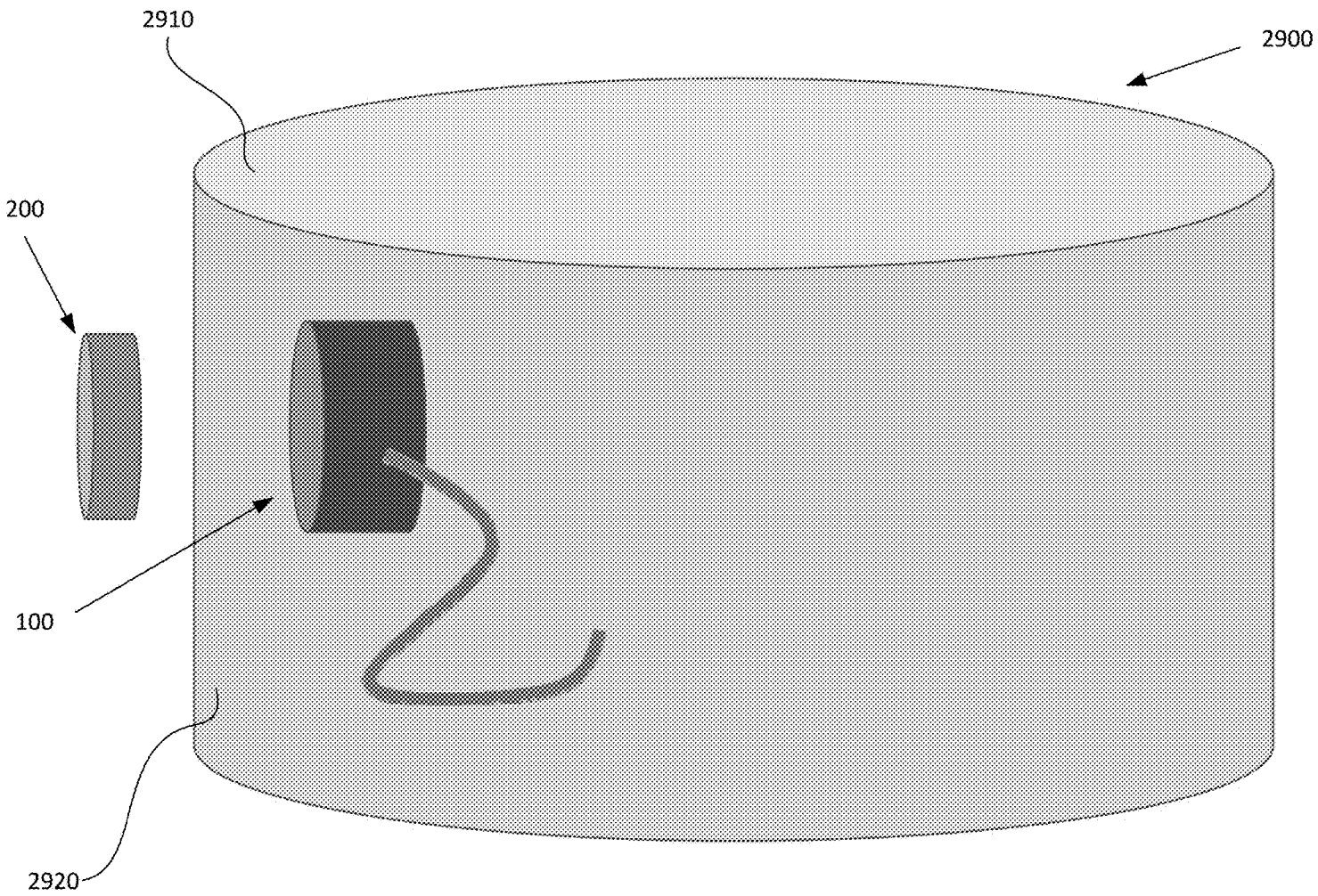
FIG. 21 provides a diagram of a trigger secured to a drum shell by a securing device according to the present invention.

With reference to FIG. 21, a diagram of a trigger 100 secured to a drum shell 2900 by a securing device 200 in a "Thru-Shell" configuration according to the present invention is provided. The securing device 200 is positioned on the exterior 2520 of the shell 2900 and the trigger 100 is disposed on the interior 2910 of the shell 2500 opposite the securing device 200. Magnets in one or both of the securing device 200 and trigger 100 magnetically and releaseably secure the trigger 100 to the shell 2900. In this configuration, vibrations from striking a drum head or the drum shell 2900 are transmitted through shell 2900 to the trigger 100. The trigger 100 configurations shown in FIGS. 16-21 may be used in conjunction with one another to enable triggering on more than one area of the drum.

Figure 22:
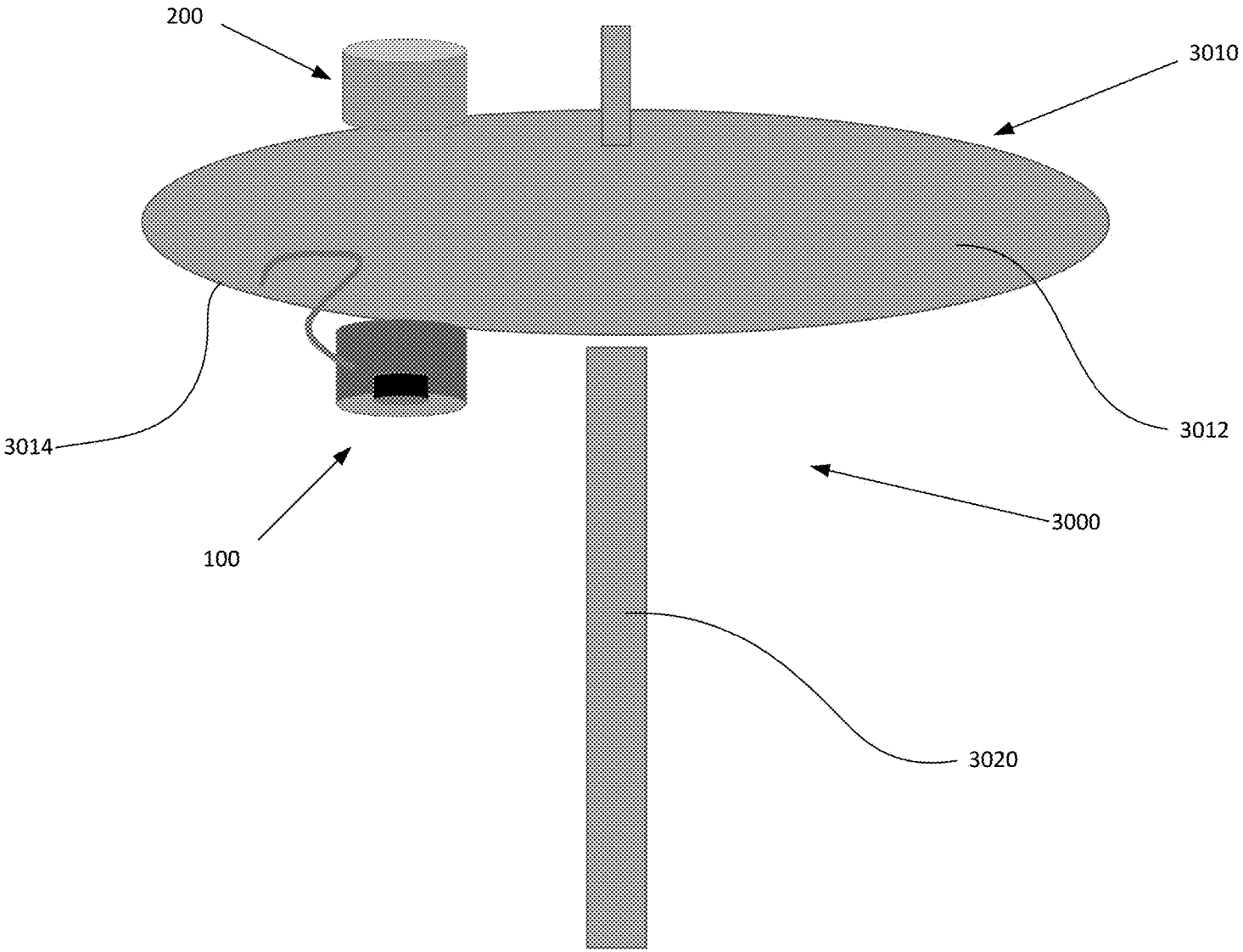
FIG. 22 provides a diagram of a trigger secured to a cymbal by a securing device according to the present invention.
Figures 23, 24, 25, 26, 27:
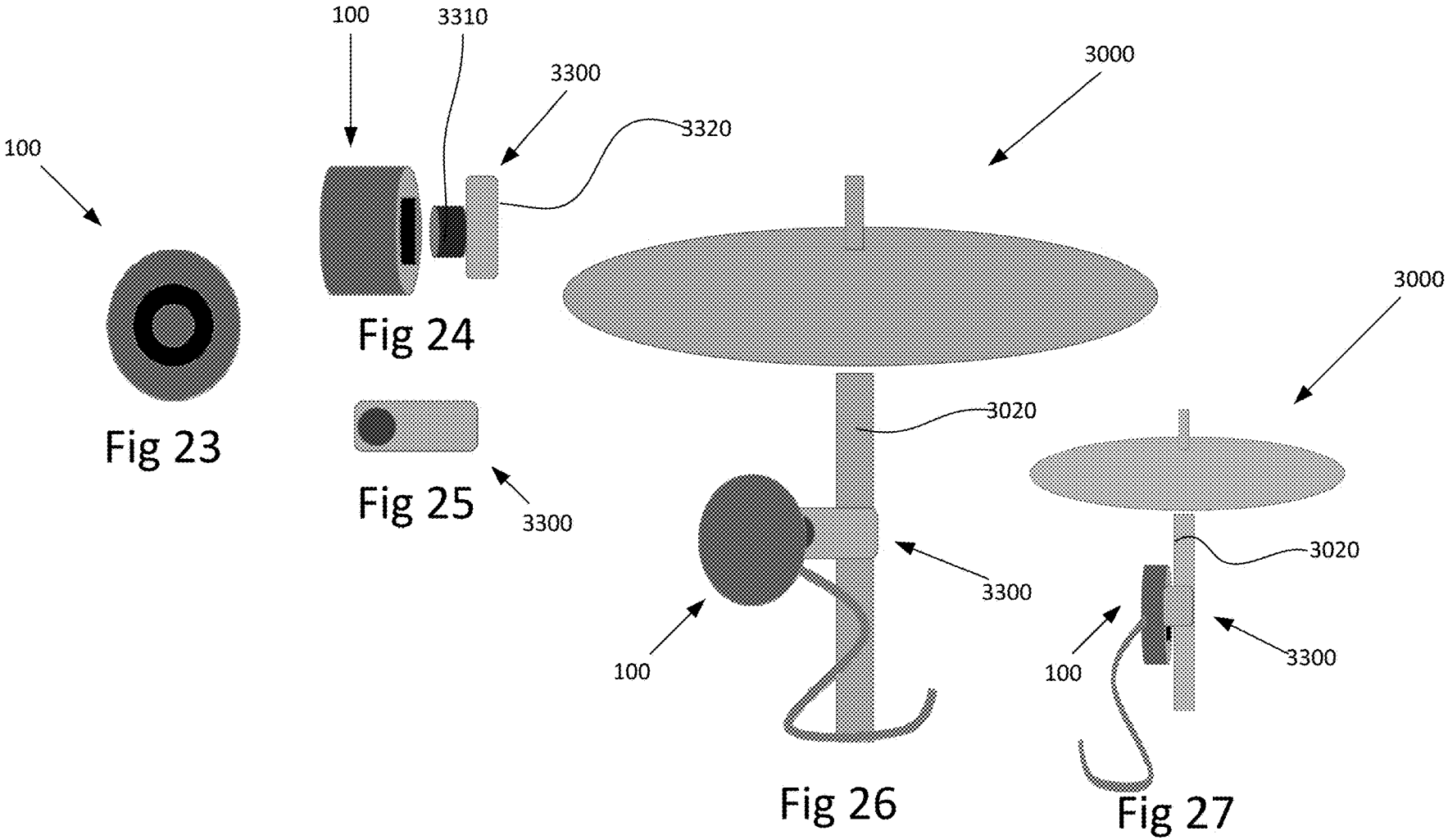
FIGS. 23, 24, 25, 26, and 27 provide diagrams of a trigger secured to a cymbal stand mount on a cymbal stand according to the present invention.

With reference now to FIG. 22, a diagram of a trigger 100 secured to a cymbal 3010 by a securing device 200 according to the present invention is provided. The cymbal 3010 is disposed at the top of a cymbal assembly 3000 including a cymbal stand 3020. The cymbal 3010 may be a metal cymbal or may be a plastic or rubber practice cymbal. The trigger 100 works with any cymbal 3010 material composition. The securing device 200 is positioned on the top 3012 of the cymbal 3010 and the trigger 100 is disposed on the bottom 3014 of the cymbal 3010 opposite the securing device 200. Magnets in one or both of the securing device 200 and trigger 100 magnetically and releaseably secure the trigger 100 to the cymbal 3010. More than one trigger 100 may be placed on the cymbal 3010 to enable a player to play different cymbal sounds such as a bell sound or a crash sound on the body of the cymbal 3010. The trigger 100 does not experience crosstalk interference and therefore has no problems operating with additional triggers 100 on the cymbal 3010 when properly tuned using a module such as the electronic module 300 shown in FIG. 2.

With reference now to FIGS. 23-27, diagrams of a trigger 100 secured to a cymbal stand mount 3300 on a cymbal stand 3020 according to the present invention are provided. The cymbal stand mount 3300 may have one or more protrusions 3310 disposed on the body 3320 of the cymbal stand mount 3300 adapted to fit within the grommet 160 of the trigger 100. The protrusion 3310 may be comprised of a neodymium magnet or other ferromagnetic material such that the magnet 120 in the trigger 100 is magnetically attracted to the protrusion 3310. The cymbal stand mount 3300 may be placed anywhere on the cymbal stand 3020 of the cymbal assembly 3000. The position of the cymbal stand mount 3300 may be adjusted to provide optimal performance of the trigger 100.

Figure 28:
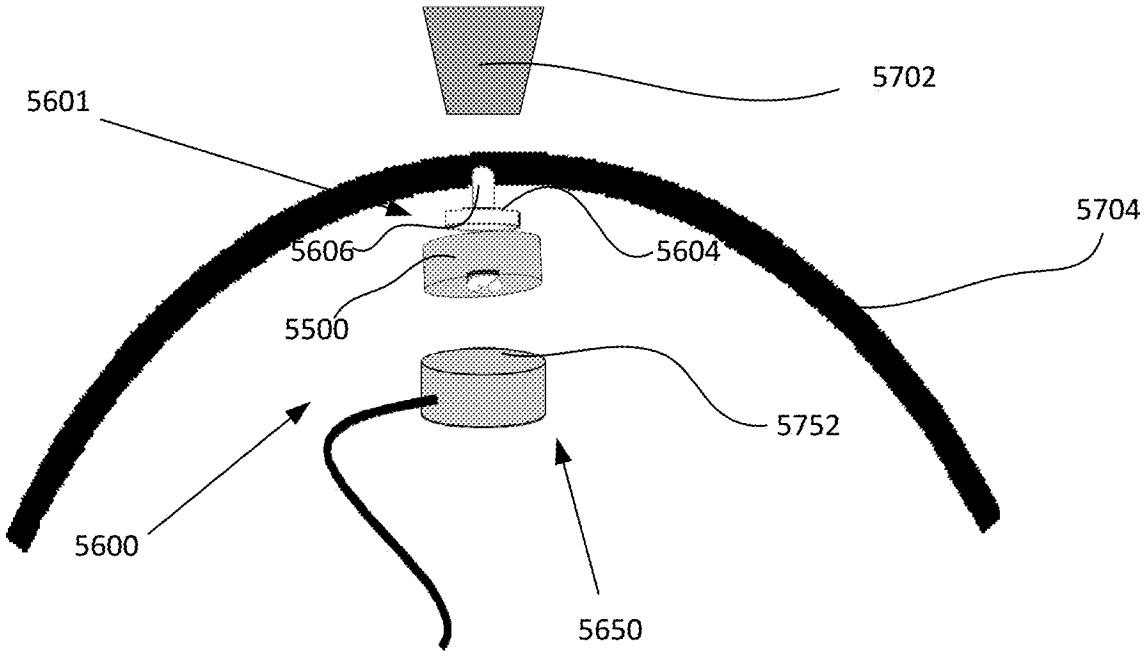
FIG. 28 provides a top plan view of a lug-mountable securing device and magnetically secured instrument trigger.

With reference now to FIG. 28 a top plan view of a lug-mountable securing device 5600 and magnetically secured instrument trigger 5650 is provided. The bolt 5601 secures the disc magnet 5500 to the drum shell 5704. The washer 5604 is disposed between the disc magnet 5500 and the drum shell 5704. The bolt 5601 secures in, either by mechanically screwing into or by another suitable method, the drum lug 5701. The securing device 5600 is thereby secured to the drum shell 5704 by the drum lug 5702 in place of a typical bolt or screw used to secure the drum lug 5702 to the drum shell 5704. The securing device 5600 is in full mechanical and acoustic contact with the drum shell 5704 and any impact or strike of a drum head or drum shell will be acoustically communicated through the securing device 5600. The securing device 5600 secures the instrument trigger 5650 to the securing device 5600 by magnetic attraction to the disc magnet 5500. The instrument trigger 5650 may be a trigger such as trigger 100 shown in FIG. 9B. The magnet of the instrument trigger 5650 secures the trigger 5650 to the securing device 5600 and the face 5752 of the instrument trigger 5650 abuts the face 5504 of the disc magnet 5500.

Figure 29:
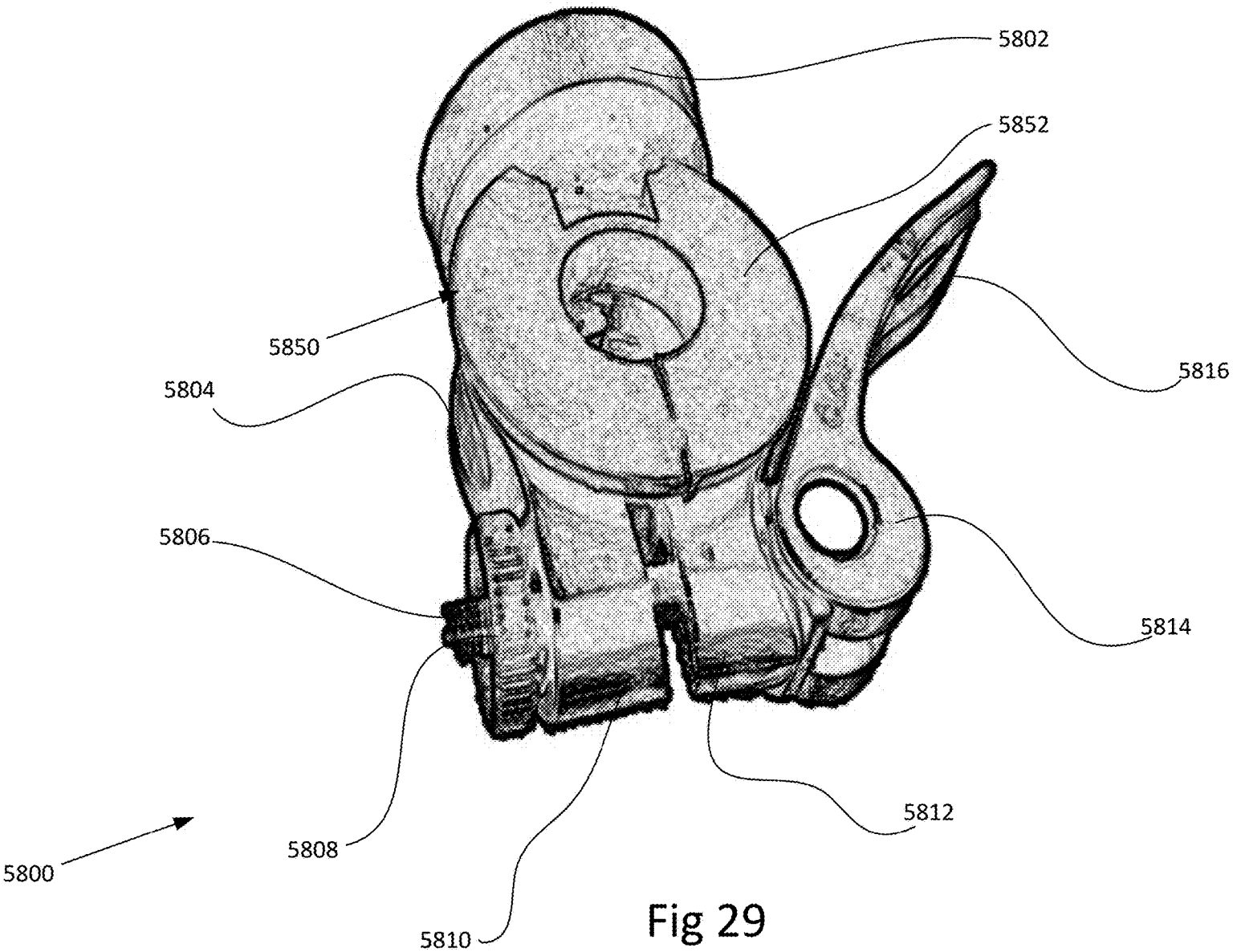
FIGS. 29 and 30 provide top perspective views of a magnetic securing device adapted to be disposed about a stand or post and an insert for the magnetic securing device, respectively.
Figure 30:
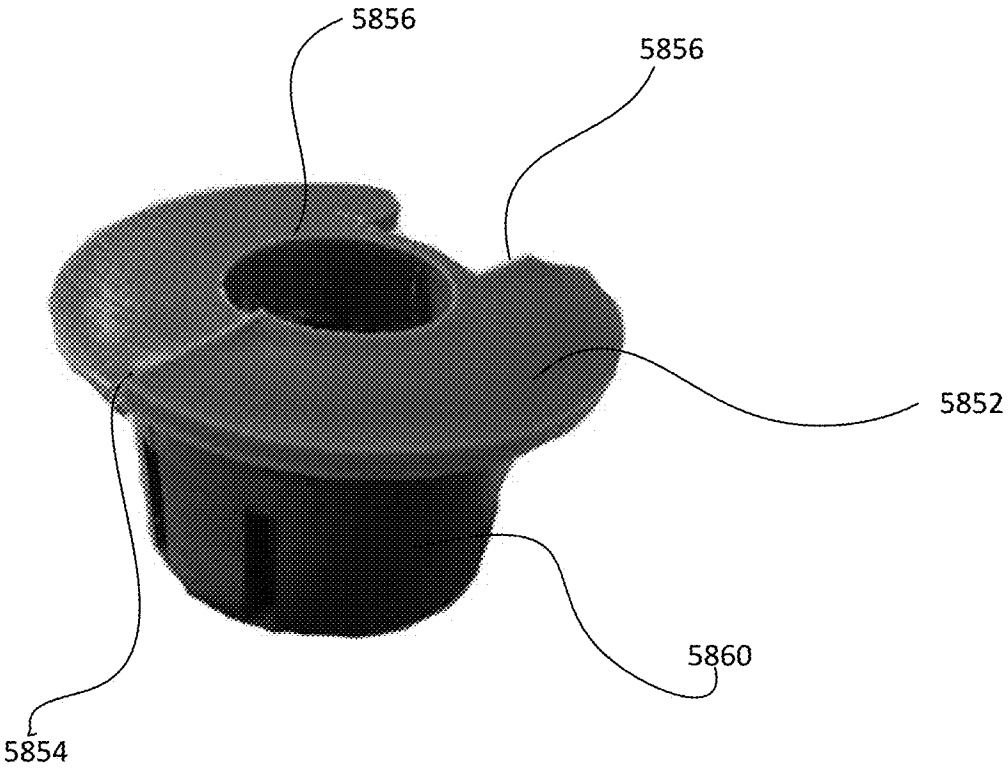

With reference now to FIGS. 29 and 30, perspective views of a magnetic stand mount 5800 and mount insert 5850 are provided. The stand mount 5800 comprises a magnet 5802, body 5804, threaded rod 5806, tightener 5808, body segments 5810 and 5812, clamp body 5814, and clamp arm 5816. The tightener 5808 may be rotated about the threaded rod 5806 to bring the body segments 5810 and 5812 closer or farther together to enable the stand mount 5800 to fit about rods or stands of varying sizes. The clamp arm 5816 when operated closes the clamp body 5814 thereby tightening the stand mount 5800 about a rod or stand on which it is disposed. The insert 5850 may be removed and replaced to enable the stand mount 5800 to fit about rods or stands of varying thicknesses. The magnet 5802 enables an instrument trigger 100 shown in FIG. 9B to be secured to the stand mount 5800. The insert 5850 comprises an insert body 5860, top 5852, interior opening 5856, cutout 5856, and separation 5854. The separation 5854 enables the insert 5850 to be removably positioned about a stand or rod.

Figure 35:
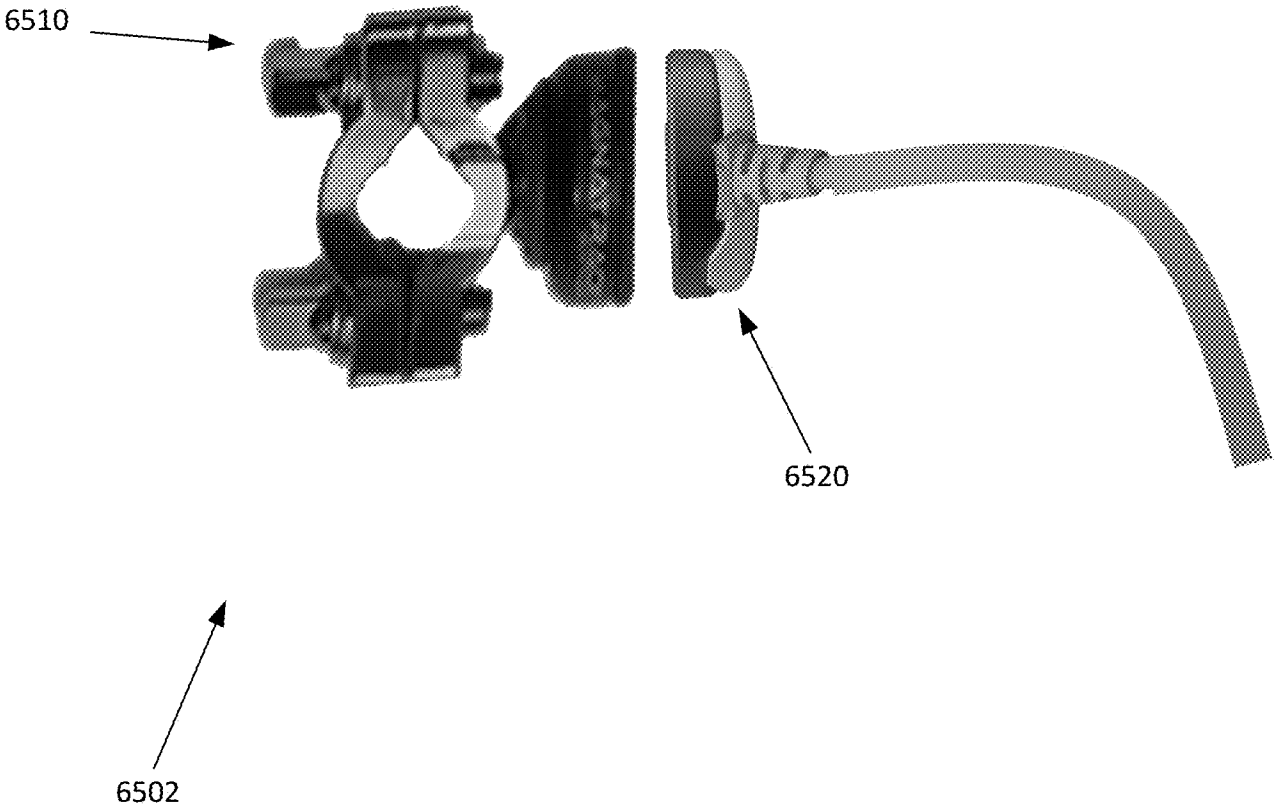
FIGS. 35 and 36 provide perspective views of a magnetic stand mount assembly and cymbal stand assembly.
Figure 36:
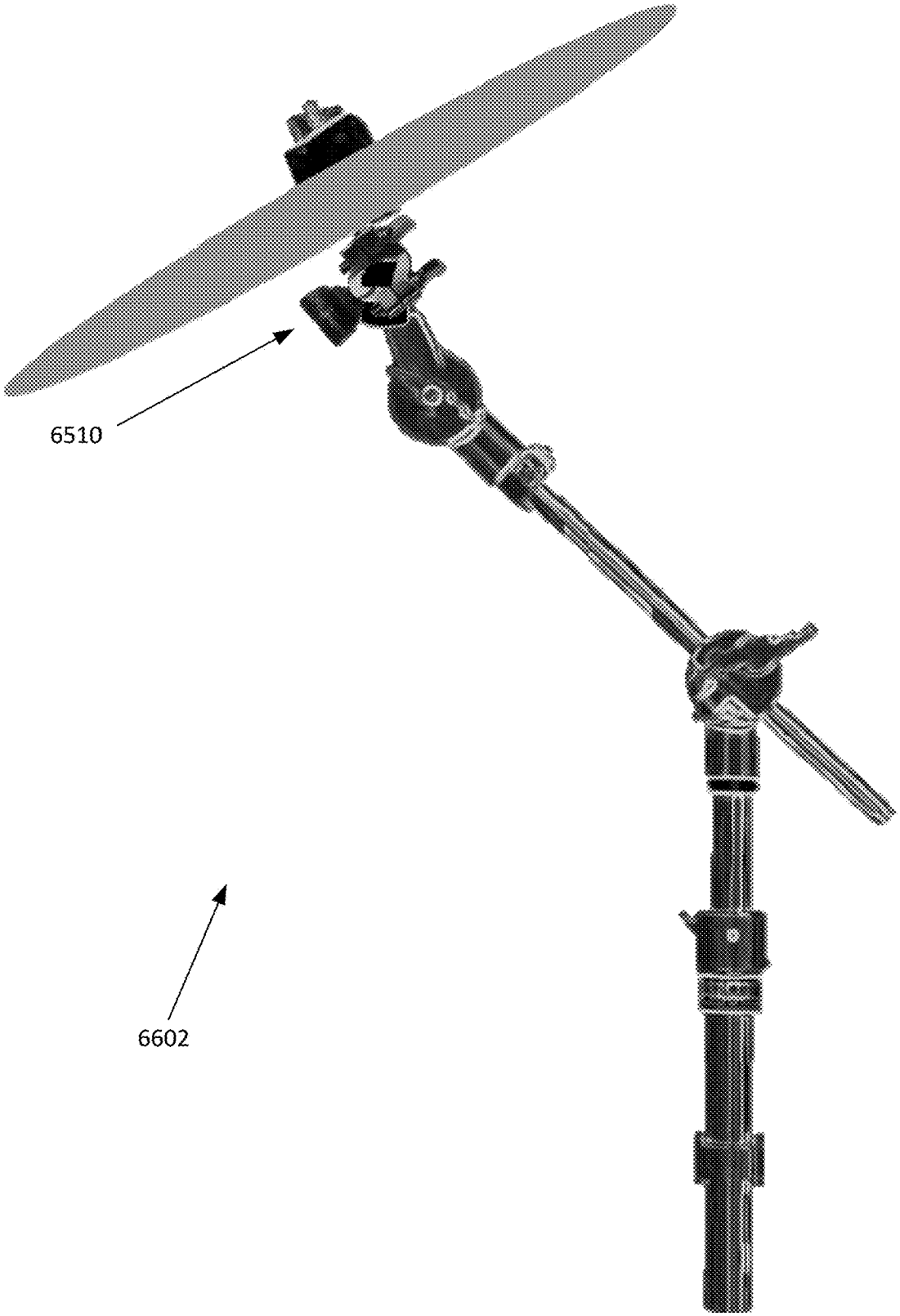

In another embodiment, provided in FIGS. 35 and 36, perspective views of a magnetic stand mount assembly 6502 comprising a magnetic stand mount 6510 and magnetic piezoelectric instrument trigger 6520 are provided. The magnetic stand mount 6510 may comprise a first and a second arcuate portions adapted to fit about a cymbal stand assembly 6602 as shown in FIG. 36. The first and second arcuate portions may be secured by a suitable fastening means such as by a threaded bolt adapted to thread into corresponding threads in the respective first and second arcuate portions. A magnetic assembly may be disposed on the exterior of one of the first or second arcuate portions and may have a magnetic polarity opposite that of the magnetic piezoelectric instrument trigger 6520 to provide for better and easier mating between the magnetic stand mount 6510 and magnetic piezoelectric instrument trigger 6520. The magnetic stand mount 6510 makes direct metal-to-metal contact with the stand of the cymbal stand assembly 6602.

By using a magnetic receiver in the magnetic stand mount 6510 secured to a clamp then fixed to a cymbal stand assembly 6602, cymbal playing can be captured from the energy or "vibrations" that resonate down the cymbal stand assembly 6602 when the cymbal is struck which in turn is captured by the magnetic piezoelectric instrument trigger 6520 sending the signal to a drum module to produce a sound audio sample. The cymbal may be electronically choked through the use of a momentary switch. Electronically choking the cymbal is accomplished by mounting a momentary switch to the magnetic stand mount 6510 at a position that when the cymbal is pulled downward beyond the natural travel of the cymbal when struck with stick, the switch is engaged signaling the module to stop or choke the sample that was triggered by the stick.

Figure 31:
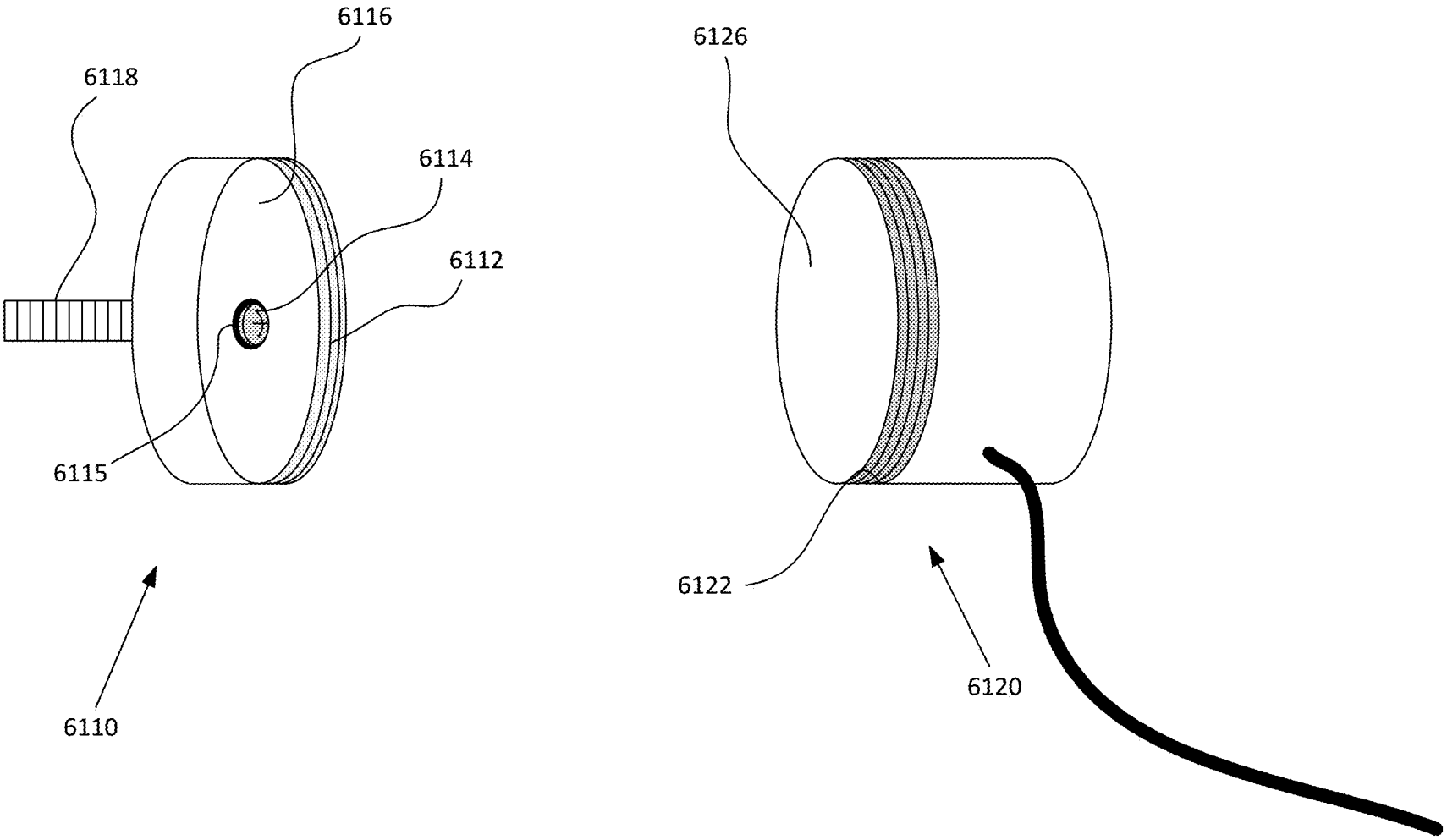
FIGS. 31, 32, 33, and 34 provide perspective views of alternative methods of securing an instrument trigger against a supporting surface or instrument surface by non-magnetic securing means.

With reference now to FIGS. 31-34, perspective views of alternative methods of securing or positioning an instrument trigger such as the trigger 100 shown in FIG. 9B against a supporting surface or an instrument surface are provided. With reference to FIG. 31, a threaded lug mount 6110 and threaded instrument trigger 6120 are provided. The lug mount 6110 comprises a body 6116, raised threaded portion 6112, and recess with pass-through or opening 6115. A bolt or screw 6118 with head 6114 is positioned or disposed within the recess 6115 such that the bolt head does not extend beyond the top of the recess 6115 and would not contact the face 6126 of the instrument trigger 6120 when the instrument trigger 6120 and the lug mount 6110 are in a mated condition. The bolt 6118 may be epoxied, glued, or otherwise permanently secured within the recess 6115. The bolt 6118 may be any suitable bolt or screw that may be used to secure the lug mount to, for example, a drum lug assembly or other suitable threaded receiving portion of a supporting surface or instrument. The threaded portion 6112 of the lug mount 6110 is complementary to or corresponds with the threaded portion 6122 of the instrument trigger 6122. The instrument trigger 6120 may be threaded onto and removably secured to the lug mount 6110 by the threaded portions 6122 and 6112 respectively. The face 6126 of the instrument trigger 6120 would be in full mechanical and acoustic contact with the body 6116 of the lug mount 6110. Therefore, any vibrations that pass through the surface in which the lug mount 6110 is secured would pass directly to the instrument trigger 6120.

Figure 32:
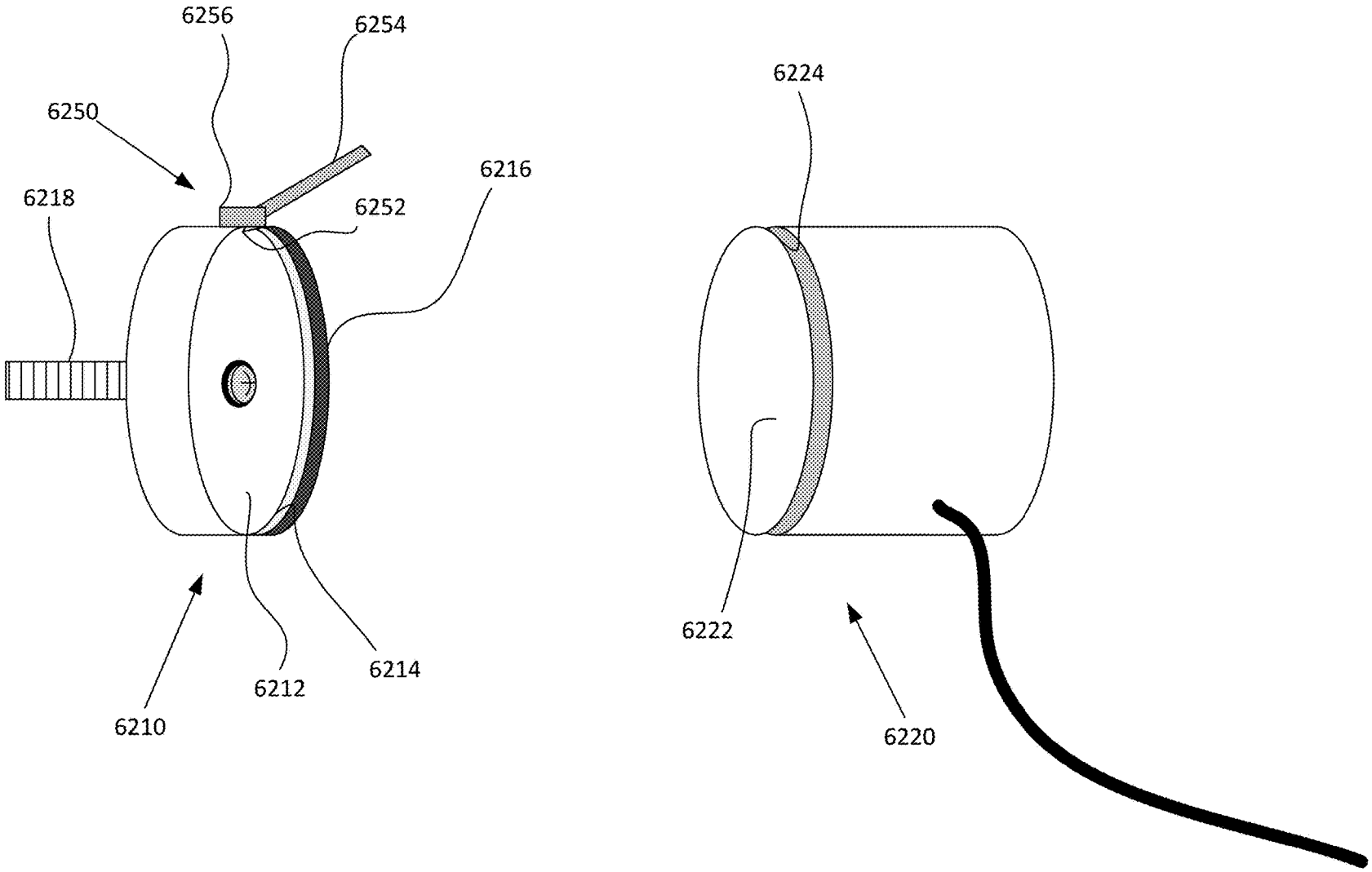

With reference now to FIG. 32, a perspective view of a lug mount 6210 and instrument trigger 6220 having a mechanical snap on securing method is provided. The raised portion 6212 of the lug mount 6210 has a lip or protrusion 6216 which extends inward from the raise portion 6214. The lip or protrusion 6216 corresponds to an indention or cutout 6224 of the instrument trigger 6220. The spacing of the lip 6216 and cutout 6224 are such that when the face 6222 of the instrument trigger 6220 is in full contact with the face 6212 of the lug mount 6210, the lip 6216 is fully engaged with, locked into, or snapped into the cutout 6224, thereby securing the face 6222 of the instrument trigger 6220 securely against the face 6212 of the lug mount 6210. The lug mount 6210 may comprise a bolt 6218 similar in configuration to that of the lug mount 6110 of FIG. 61. The lug mount 6210 may further comprise a releasing assembly 6250. The releasing assembly 6250 comprises a body portion 6256, releasing arm 6254, and releasing tab 6252. When operated by a user, the releasing arm 6254 moves the releasing tab 6252 upwards and inwards, dislodging or releasing the instrument trigger 6220 from the lug mount 6210 by forcing the cutout 6224 out of the lip 6216, thereby making the instrument trigger 6220 easier to remove from the lug mount 6210. Other suitable mechanisms for releasing the instrument trigger 6220 from the lug mount 6210 may also be used such as a button placed or piston that extends out from the face 6212 of the lug mount 6210 that, when an exterior control such as a switch, lever, or button, is acted on a by a user, protrudes from the face of the lug mount 6210, releasing the instrument trigger 6220.

Figure 33:
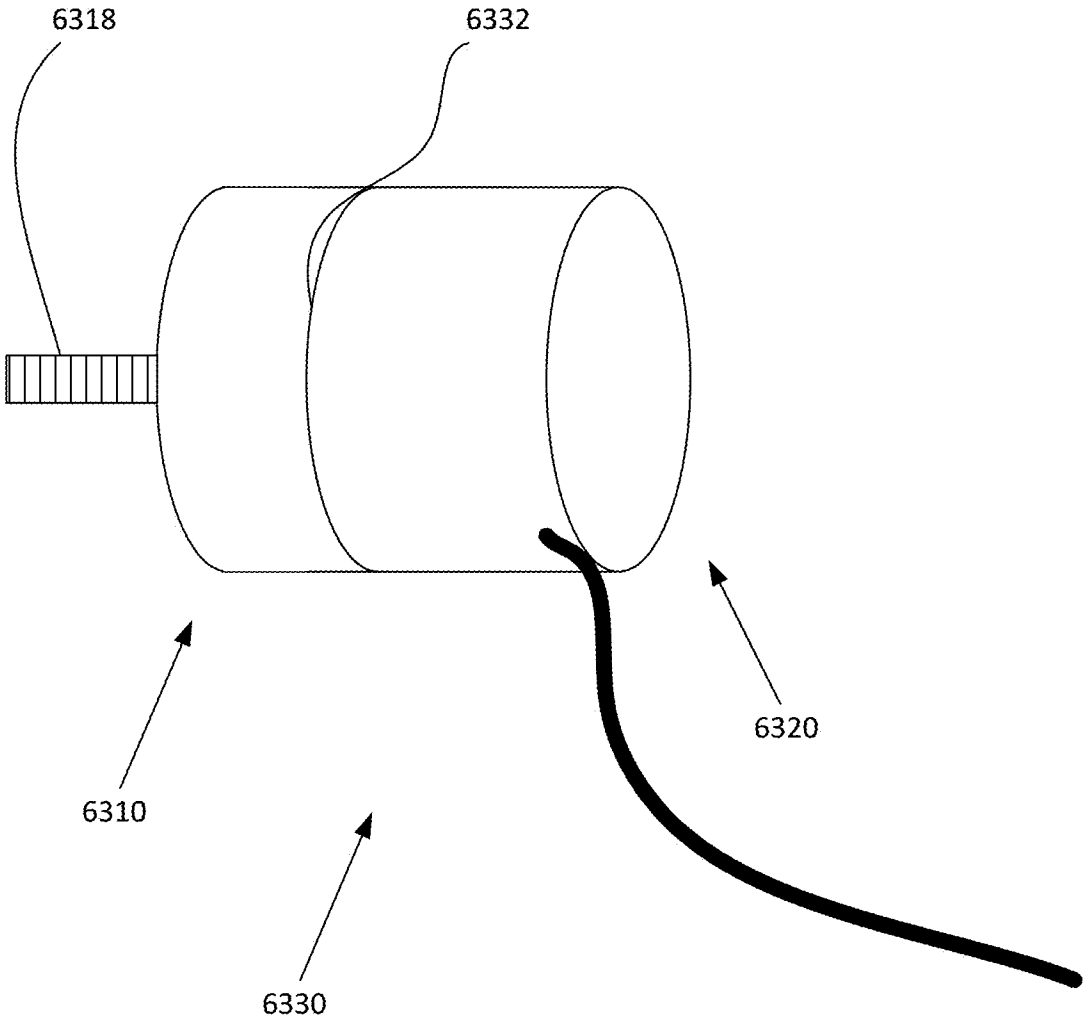

With reference now to FIG. 33, a perspective view of a lug mountable instrument trigger 6330 is provided. The lug mountable instrument trigger 6330 comprises a lug mount 6310 and an instrument trigger 6320. The lug mount 6310 comprises a bolt or screw 6318 that may be used to mount the lug mountable instrument trigger 6330 in any suitable threaded mounting point or lug. The two portions of the lug mountable instrument trigger 6330, the lug mount 6310 and instrument trigger 6320, may be permanently joined or may be separable at the join point 6332 for maintenance or repairs.

Figure 34:
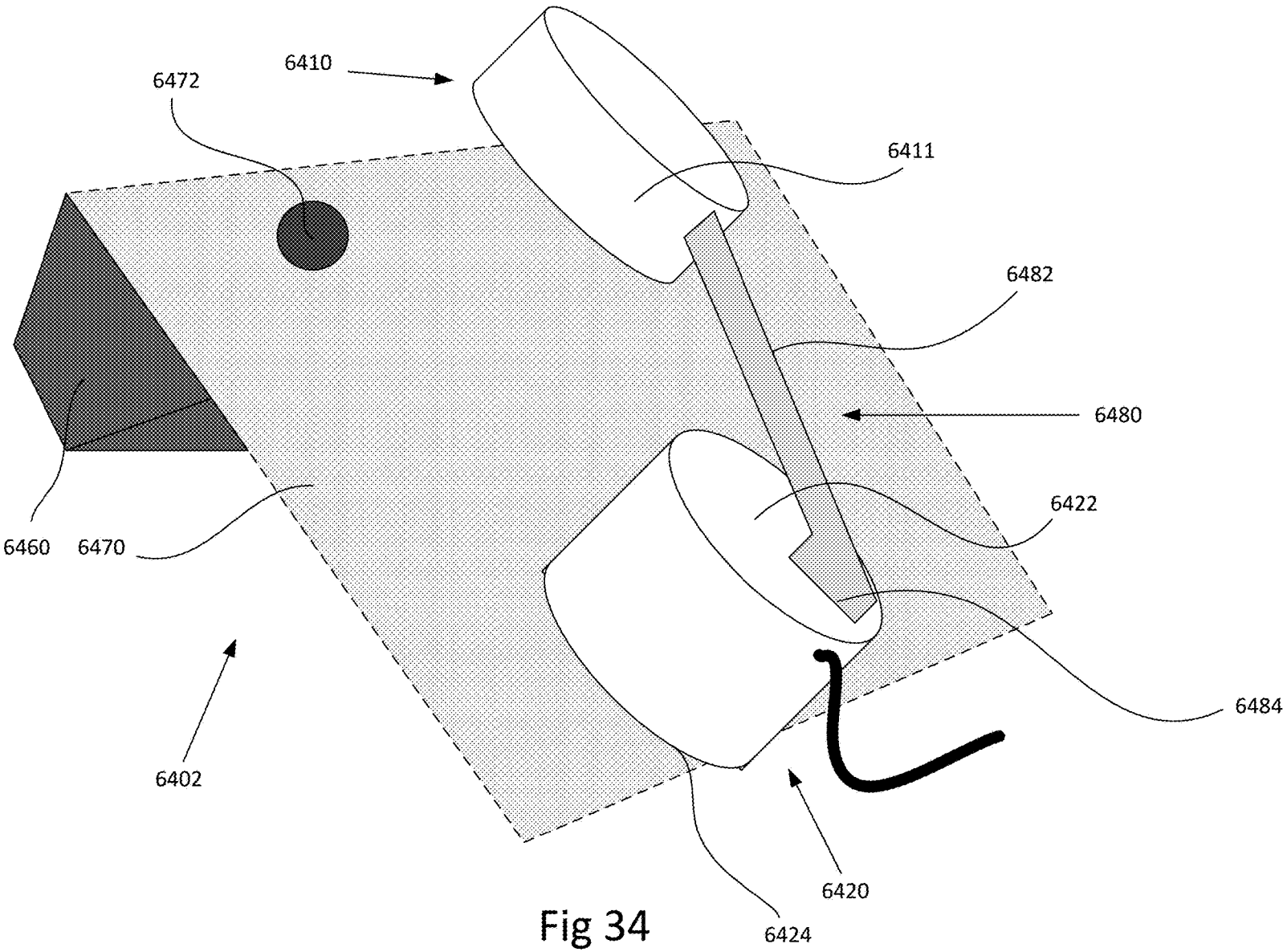

With reference now to FIG. 34, a perspective view of a tension mounting system 6402 for an instrument trigger 6420 is provided. The tension mounting system 6402 is shown on the interior surface of a drum shell 6470. The tension mounting system comprises a lug mount 6410 and an instrument trigger 6420. The lug mount 6410 is mounted, such as by a threaded bolt, in a lug point like lug point 6472 which is part of the drum shell's 6470 drum lug 6460. A tension arm assembly 6480 extends out from the body 6411 of the lug mount 6410. The assembly 6480 may alternatively extend from the top or bottom of the lug mount 6410. The assembly 6480 comprises a tension arm 6482 and an arm head 6484. The arm head 6484 applies pressure to the top 6422 of the instrument trigger 6420 by tension applied by the tension arm 6482, thereby keeping the face 6424 of the instrument trigger 6420 in mechanical or acoustic contact with the drum shell 6470. The assembly 6480 applies a constant force on the instrument trigger 6420 keeping the instrument trigger 6420 in place on the drum shell 6470. The lug mount 6410 may alternatively be mounted on any suitable surface and may also be secured to the surface by adhesives or by magnetic means. The arm head 6484 may comprise any shape suitable for interfacing with and holding the instrument trigger 6420 and may comprise a pad or other gripping means. In another embodiment, the tension arm assembly 6480 may comprise a spring or spring loaded arm adapted to keep a constant pressure applied on the instrument trigger 6420. In either the tension arm 6482 embodiment or in the spring embodiment, the tension arm assembly 6480 applies a constant force of 20-40 lbs. on the instrument trigger 6420 such that the piezoelectric transducer in the instrument trigger 6420 may pick up any vibrations or movements of the drum shell 6470.

Figure 37:
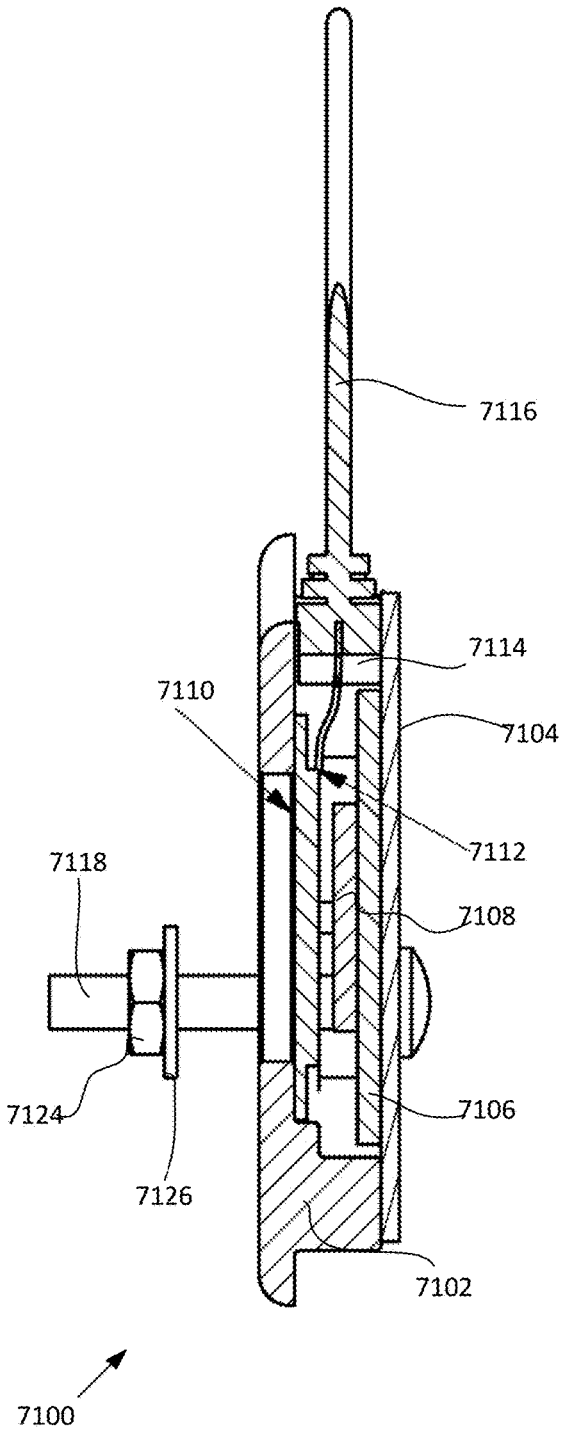
FIG. 37 provides a cross-section view of a trigger and mount assembly.
Figure 38:
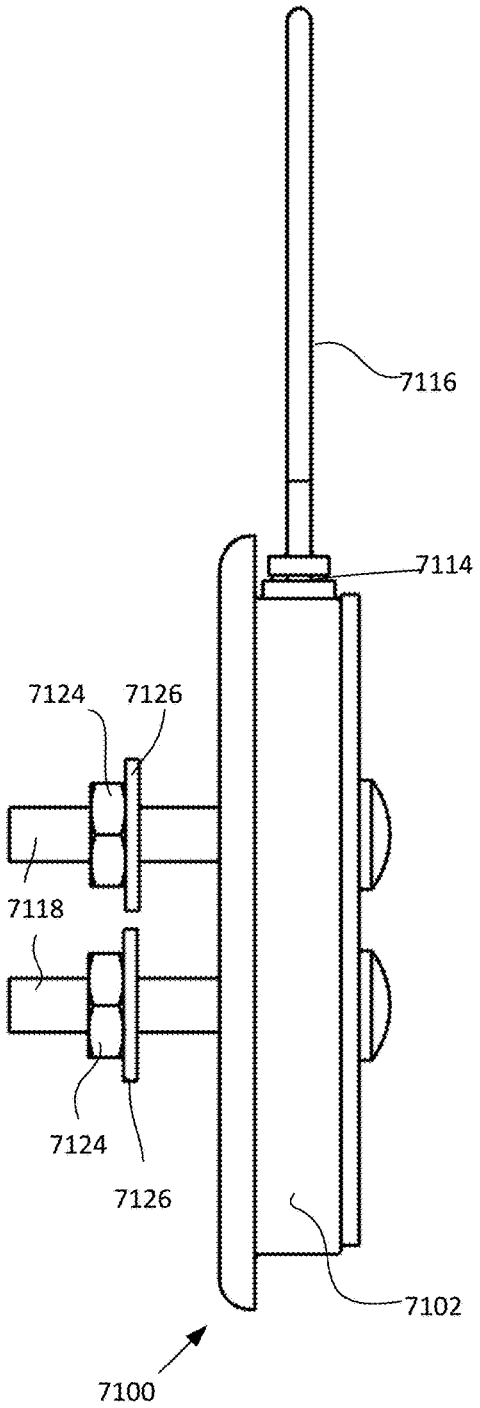
FIG. 38 provides a side perspective view of a trigger and mount assembly.
Figure 39:
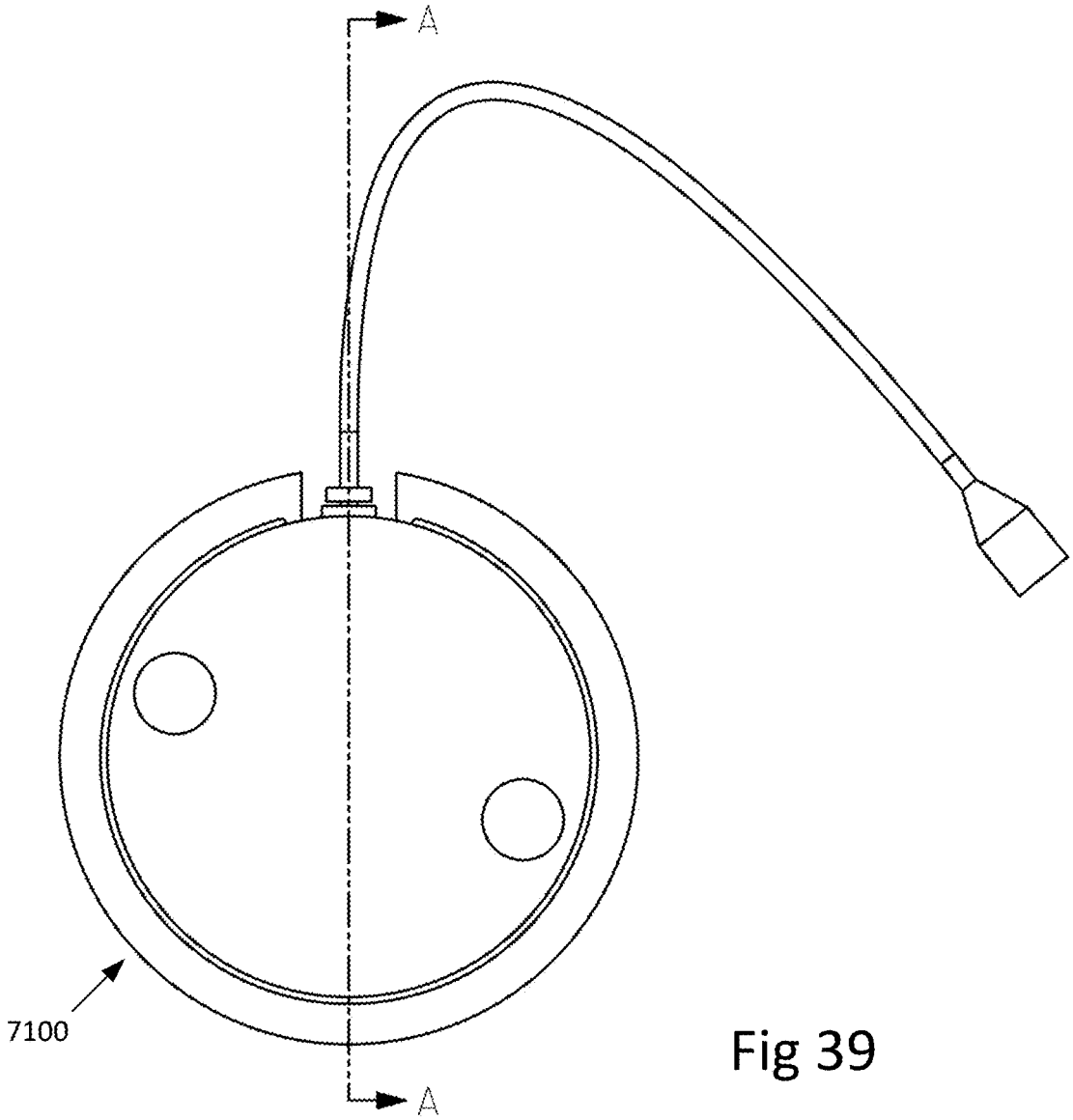
FIGS. 39 and 40 provide perspective views of a trigger and mount assembly.
Figure 40:
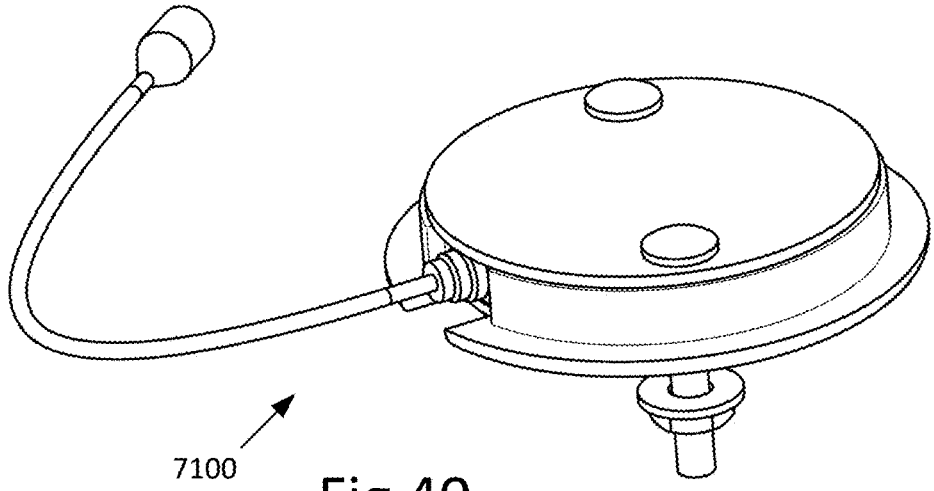

With reference now to FIG. 37, a cross-section view of a trigger and mount assembly 7100 and FIG. 38 is a side perspective view of the assembly 7100 is provided. In this exemplary embodiment, the trigger and mount assembly 7100 comprises: a housing 7102, e.g., made from or combination of a polymer, metal, and/or composite; a piezoelectric transducer 7110, of a suitable size and response characteristics as discussed elsewhere; connected via wires such as by soldering or other techniques with integrated cable 7116; a strain relief 7114; either a single or combination of internal muffling components or mufflers or isolators 7106, 7108, e.g., made from either open cell foam rubber, closed cell foam rubber, or silicone rubber; enclosed with a cap 7104, e.g., made from or combination of a polymer, metal, and/or composite. This assembly is attached to various surfaces using up to, but not limited to, two threaded fasteners, e.g., combination of threaded bolts 7118 with washers 7126 and nuts 7124. It should be readily understood that the invention is not limited by the exemplary fastening components described herein as any suitable fasteners that securely affix the trigger 7100 to the surface of an instrument, e.g., cymbal 7202, is acceptable. The assembly may further include one or more magnets to provide enhanced adhering properties and may also include adhesive materials in desired locations. FIGS. 39 and 40 provide further perspective views of the assembly 7100.

Figure 41:
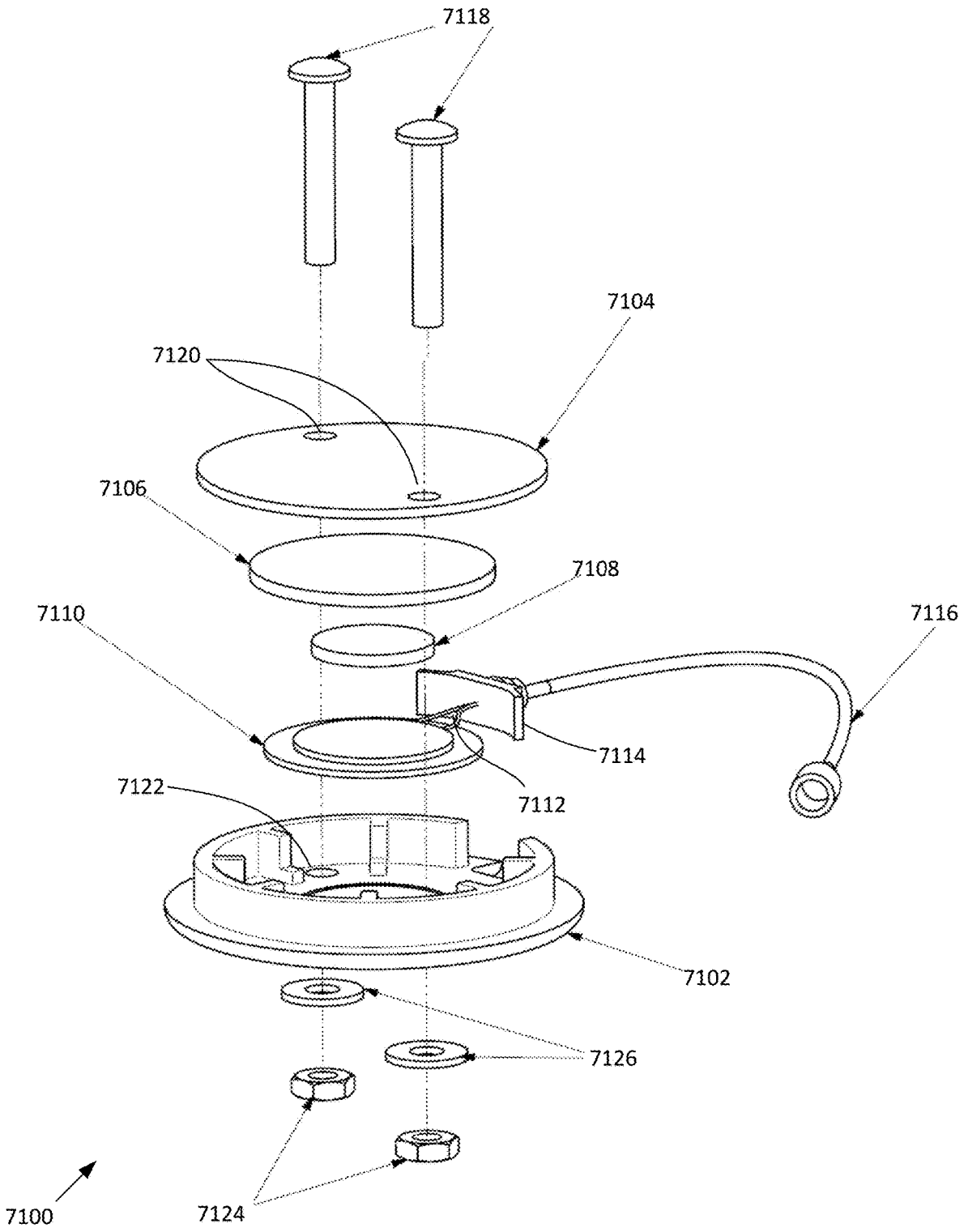
FIG. 41 provides an exploded view of a trigger and mount assembly.

FIG. 41 illustrates an "exploded" view of the assembly 7100 for ease in illustrating the configuration of the various components of the assembly. In particular, the housing 7102 includes holes or apertures or openings 7122 and cap or end piece 7104 includes holes or apertures or openings 7120. During assembly and/or mounting of the trigger assembly to an instrument, such as a low volume cymbal, the bolts 7118 are disposed to be received through cap openings 7120 and positioned through the assembly components to then be received through housing openings 7122. Nuts 7124 along with washers 7126, or the like, threadably engage the distal threaded positions of the bolts 7118 to secure the bolts to the trigger subassembly.

Figure 42:
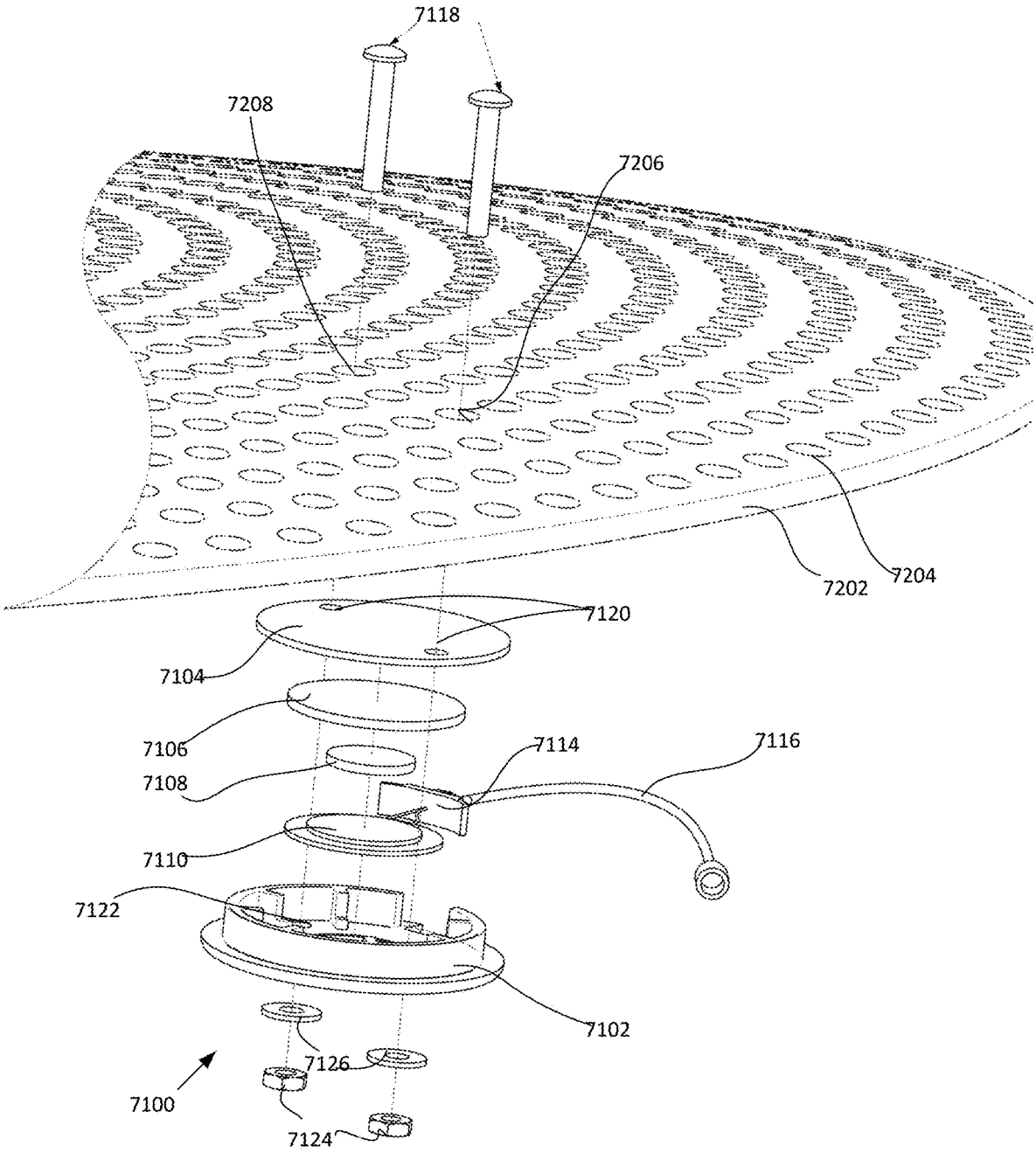
FIG. 42 provides a schematic diagram of a trigger and mount assembly and a low-volume cymbal.

Now with reference to FIG. 42, schematic diagram 7200 illustrates when mounting the assembly 7100 (shown in an exploded or unassembled manner) to a cymbal 7202. Cymbal 7202 is illustrated as a low volume type cymbal having a perforated surface comprising a pattern of openings 7204, including openings 7206 and 7208. The bolts 7118 are disposed from the top surface of the cymbal 7202, through openings 7206, 7208, and displaced through the bottom surface of the cymbal through openings 7120 in the cap 7104 through the body of the trigger housing 7102 and through openings 7122 and out the bottom of the housing 7104 to provide an accessible portion of the bolt 7118 for securely mounting the trigger assembly to the cymbal. Nuts 7124 and washers 7126 are disposed on threaded portions of bolts 7118 and tightened sufficiently to secure the trigger assembly to the cymbal so that the trigger assembly will not be dislodged or become unmounted when a drummer strikes the cymbal repeatedly.

In one manner, nuts and/or washers may not be needed to secure the assembly to a cymbal. For instance, the housing or other member of the assembly 7100 may be configured to threadably receive bolts 7118 or screws or the like to obtain a tight or snug attachment to the cymbal sufficient to provide effective triggering performance of the piezoelectric transducer. The stand mounted trigger assembly comprising the instrument trigger and cymbal stand mount is easy to install and may be used to create bell zones without being mounted on the cymbal itself. The stand mounted trigger assembly may be used with crash cymbals, ride cymbals, splash cymbals, and other cymbal types. Although the invention has been described with reference to a two-bolt/nut/washer fastening system or component, any number of fastening systems will work as needed for proper and effective mounting and triggering operation of the assembly 7100 and the invention is not limited to the particular configuration shown.

Figure 43:
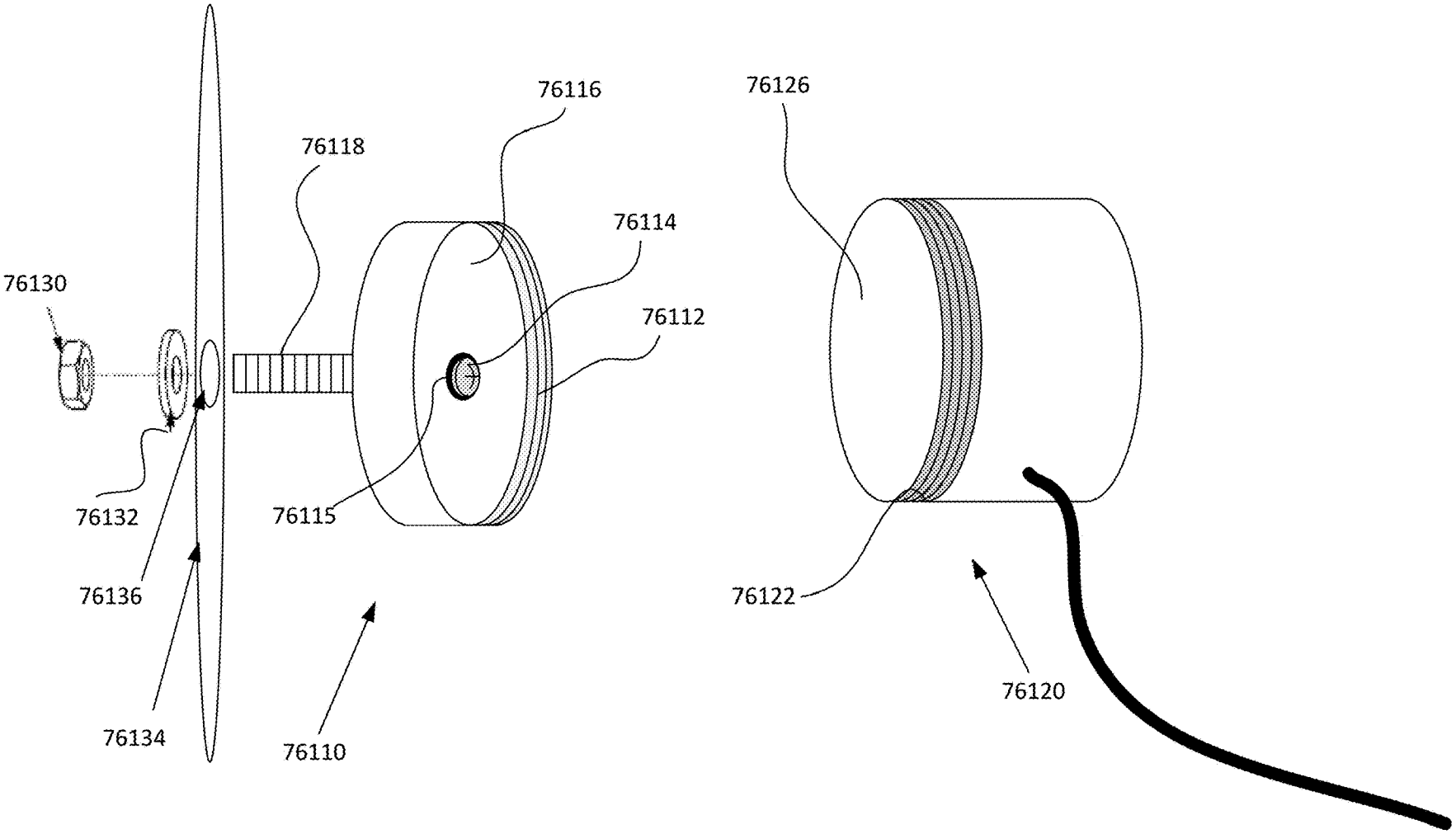
FIG. 43 provides a perspective view of an alternative fixed or lug mount and instrument trigger.

With reference now to FIG. 43, a perspective view of an alternative fixed or lug mount 76110 and instrument trigger 76120 is provided. In this exemplary alternative, a threaded lug or threaded fastener mount 76110 and threaded instrument trigger 76120 are provided. The lug mount 76110 comprises a body 76116, raised threaded portion 76112, and recess with pass-through or opening 76115. A bolt or screw 76118 with head 76114 is positioned or disposed within the recess 76115 such that the bolt head does not extend beyond the top of the recess 76115 and would not contact the face 76126 of the instrument trigger 76120 when the instrument trigger 76120 and the lug mount 76110 are in a mated condition. The bolt 76118 may be epoxied, glued, or otherwise permanently secured within the recess 76115. The bolt 76118 may be any suitable bolt or screw that may be used to secure the lug mount to, for example, any suitable threaded receiving portion of a supporting surface or instrument. As shown, the bolt 76118 may be received through an opening 76136 formed in a cymbal 76134 and affixed or mounted to the surface of the cymbal 76134 by nut 76130 and washer 76132.

The threaded portion 76112 of the lug mount 76110 is complementary to or corresponds with the threaded portion 76122 of the instrument trigger 76122. The instrument trigger 76120 may be threaded onto and removably secured to the lug mount 76110 by the threaded portions 76122 and 76112 respectively. The face 76126 of the instrument trigger 76120 would be in full mechanical and acoustic contact with the body 76116 of the lug mount 76110. Therefore, any vibrations that pass through the surface in which the lug mount 76110 is secured would pass directly to the instrument trigger 76120. The threaded lug mount or fastener may be received through a perforation 76136 formed on a low volume cymbal 76134 and fixably attached to the cymbal by way of a nut 76130 or other suitable fastening means engaging the bolt 76118 on the opposite side of the cymbal. Of course, a second or third or so forth bolt or stem may be used with corresponding fastening members to affix the lug mount 76110 to the cymbal. Once affixed to the cymbal the trigger 76120 may be affixed to the lug mount 76110.

The alternative lug or fixed mount 76110 may alternatively include a mechanical snap on securing method in place of the threaded portions 76112 and 76122. In such an alternative the lug mount 76110 may include a raised portion having a lip or protrusion which extends inward from the raised portion. The lip or protrusion corresponds to an indention or cutout provided on the instrument trigger 76120. The spacing of the lip and cutout are such that when the face 76126 of the instrument trigger 76120 is in full contact with the face 76116 of the lug mount 76110, the lip is fully engaged with, locked into, or snapped into the cutout, thereby securing the face 76126 of the instrument trigger 76120 securely against the face 76116 of the lug mount 76110. The lug mount 76110 may comprise a bolt 76118 and may further comprise a releasing assembly comprising a body portion, releasing arm, and releasing tab. When operated by a user, the releasing arm moves the releasing tab upwards and inwards, dislodging or releasing the instrument trigger 76120 from the lug mount 76110 by forcing the cutout out of the lip, thereby making the instrument trigger easier to remove from the lug mount. Other suitable mechanisms for releasing the instrument trigger 76120 from the lug mount 76110 may also be used such as a button placed or piston that extends out from the face of the lug mount that, when an exterior control such as a switch, lever, or button, is acted on a by a user, protrudes from the face of the lug mount, releasing the instrument trigger.

Figure 44:
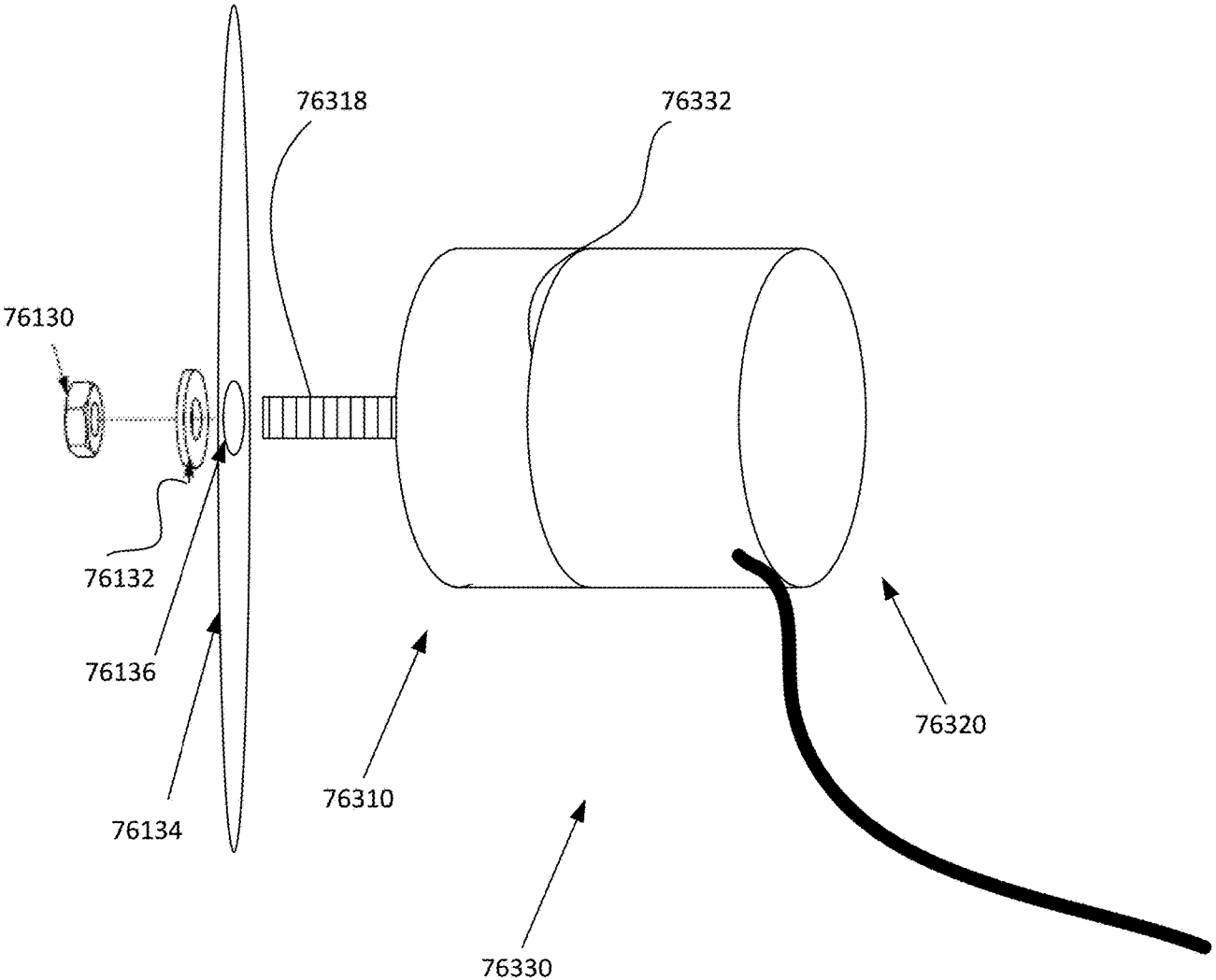
FIG. 44 provides a perspective view of the alternative lug mountable instrument trigger.

With reference now to FIG. 44, a perspective view of the alternative lug mountable instrument trigger 76330 is provided. The lug mountable instrument trigger 76330 comprises a lug mount 76310 and an instrument trigger 76320. The lug mount 76310 comprises a bolt or screw 76318 that may be used to mount the lug mountable instrument trigger 76330 in any suitable threaded mounting point or lug or receiving member, e.g., a nut. The two portions of the lug mountable instrument trigger 76330, the lug mount 76310 and instrument trigger 76320, may be permanently joined or may be separable at the join point 76332 for maintenance or repairs. The lug mountable instrument trigger is securely attached to cymbal 76134 as shown by disposing the bolt 76318 through the opening 76136 of the cymbal, placing washer 76132 about the bolt and adjacent the surface of the cymbal, and threadably engaging nut 76130 to the threaded portion of bolt 76318.

Figure 45:
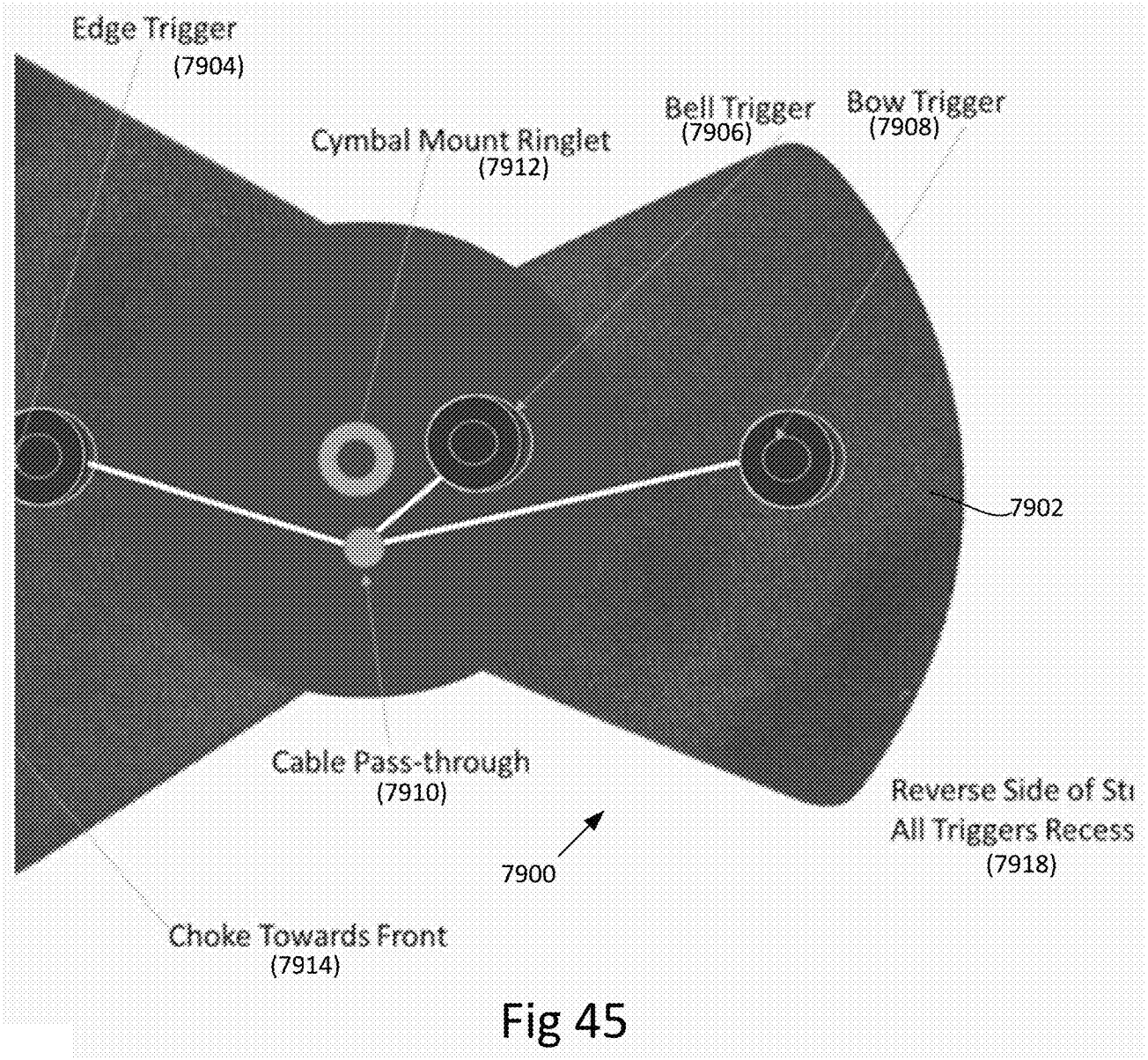
FIG. 45 provides a mounting assembly to securely affix one or more triggers to the surface of a cymbal.

FIG. 45 illustrates an alternative mounting assembly to securely affix one or more triggers to the surface of a cymbal. As shown assembly 7900 includes a bow-tie shaped body 7902 having a length or diameter to match the diameter of a cymbal for mounting. Cymbal mount opening or ringlet 7912 allows for the assembly to be placed over a cymbal when mounting the cymbal to a stem or cymbal stand in a conventional manner. A set of trigger recesses are formed or provided in the body portion to securely receive edge trigger 7904, bell trigger 7906 and bow trigger 7908 to provide a multi-zone trigger assembly. The separate triggers detect and trigger strikes in different locations on the surface of the cymbal. A cable pass-through 7910 is provided for ease in managing the cabling associated with the one or more triggers positioned on the assembly. In addition, a choke component 7914 may be provided to allow the drummer to choke the signal generated by one or more triggers during performance.

Figure 46:
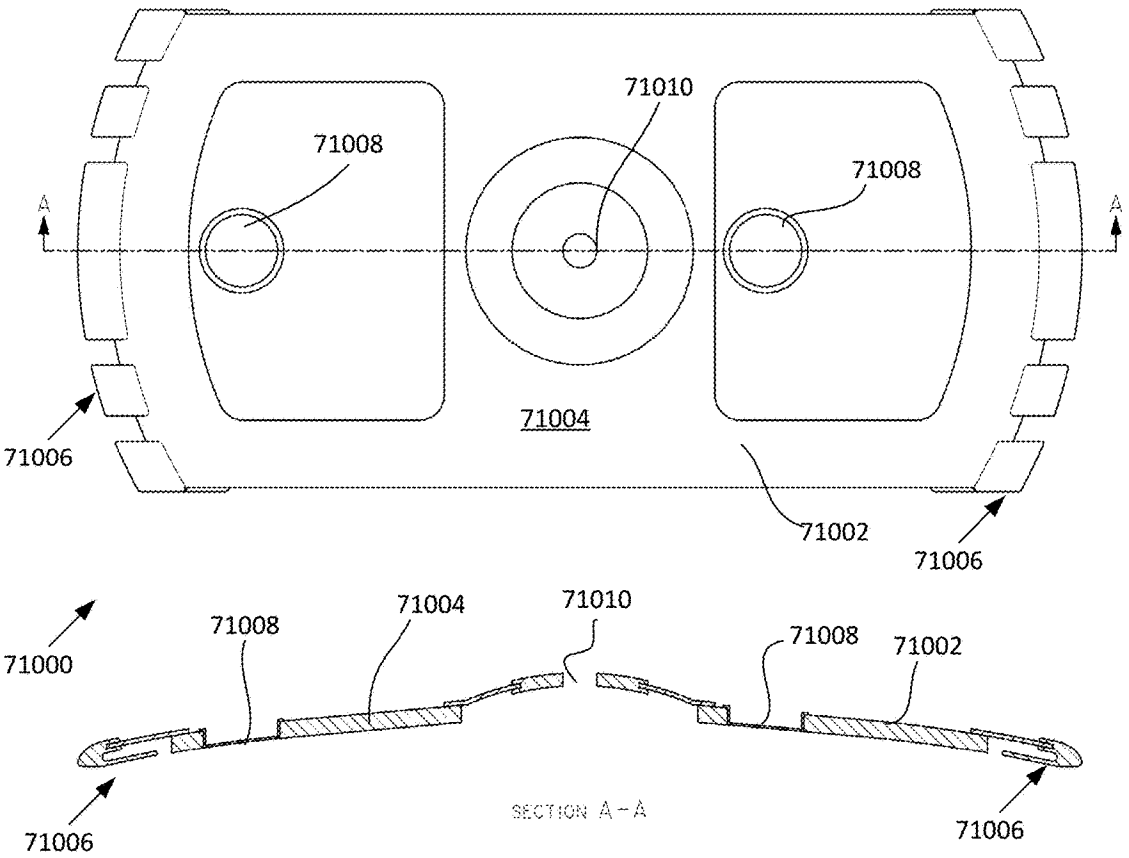
FIG. 46 provides top-down, cross-section and side perspective views of an alternative trigger mount assembly.
Figure 46:
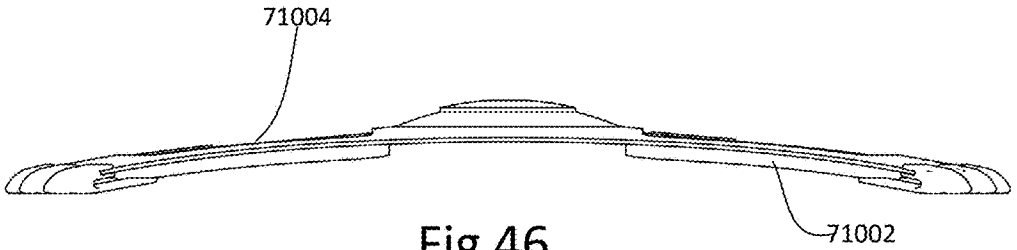

FIG. 46 illustrates top-down, cross-section and side perspective views of an alternative trigger mount assembly 71000. As shown, the assembly 71000 includes an elongated body 71002 having a central portion 71004 and distal portions 71006. Trigger recesses or openings 71008 are provided to receive trigger devices and to securely hold them in place once mounted on a cymbal. Distal portions 71006 include a lip or series of lips configured to securely wrap-around and engage the outer perimeter surface of a cymbal. C-shaped profile as shown in cross-section illustrates how the assembly is placed about the cymbal extreme outer perimeter to prevent the assembly from becoming disengaged from the cymbal during performance and while in use.

Figure 47:
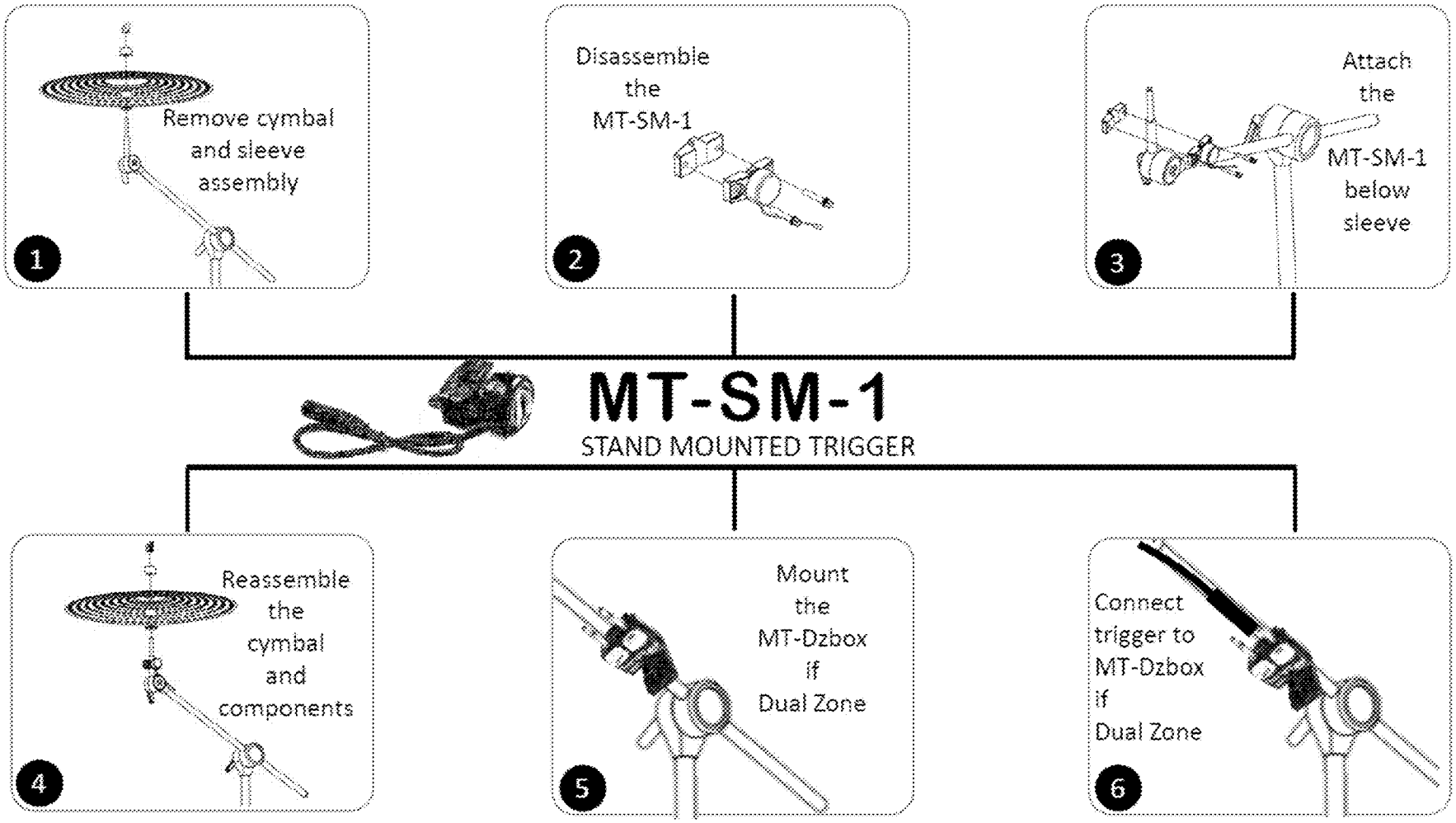
FIG. 47 provides an installation process for the stand mounted cymbal trigger assembly FIG. 48 provides an installation process for the instant zone trigger assembly.

FIG. 47 provides an installation process for the stand mounted cymbal trigger assembly. First the cymbal is removed from the stand. Then the stand mounted trigger assembly is separated and then installed about a member of the cymbal stand. After the stand mounted trigger assembly has been installed on the cymbal stand, the cymbal is reinstalled on the stand. A dual zone trigger box may also be installed on the cymbal stand and connected to the stand mounted trigger assembly if dual zone triggering is desired. Threaded screws or bolts are used to pass through openings in the cymbal and secure the instant zone trigger assembly to the cymbal underside. The instant zone trigger assembly may also be installed on the top side of the cymbal if necessary. The fasteners, screws or bolts, securely hold the trigger in place and keep the trigger in physical contact with the cymbal.

Figure 48:
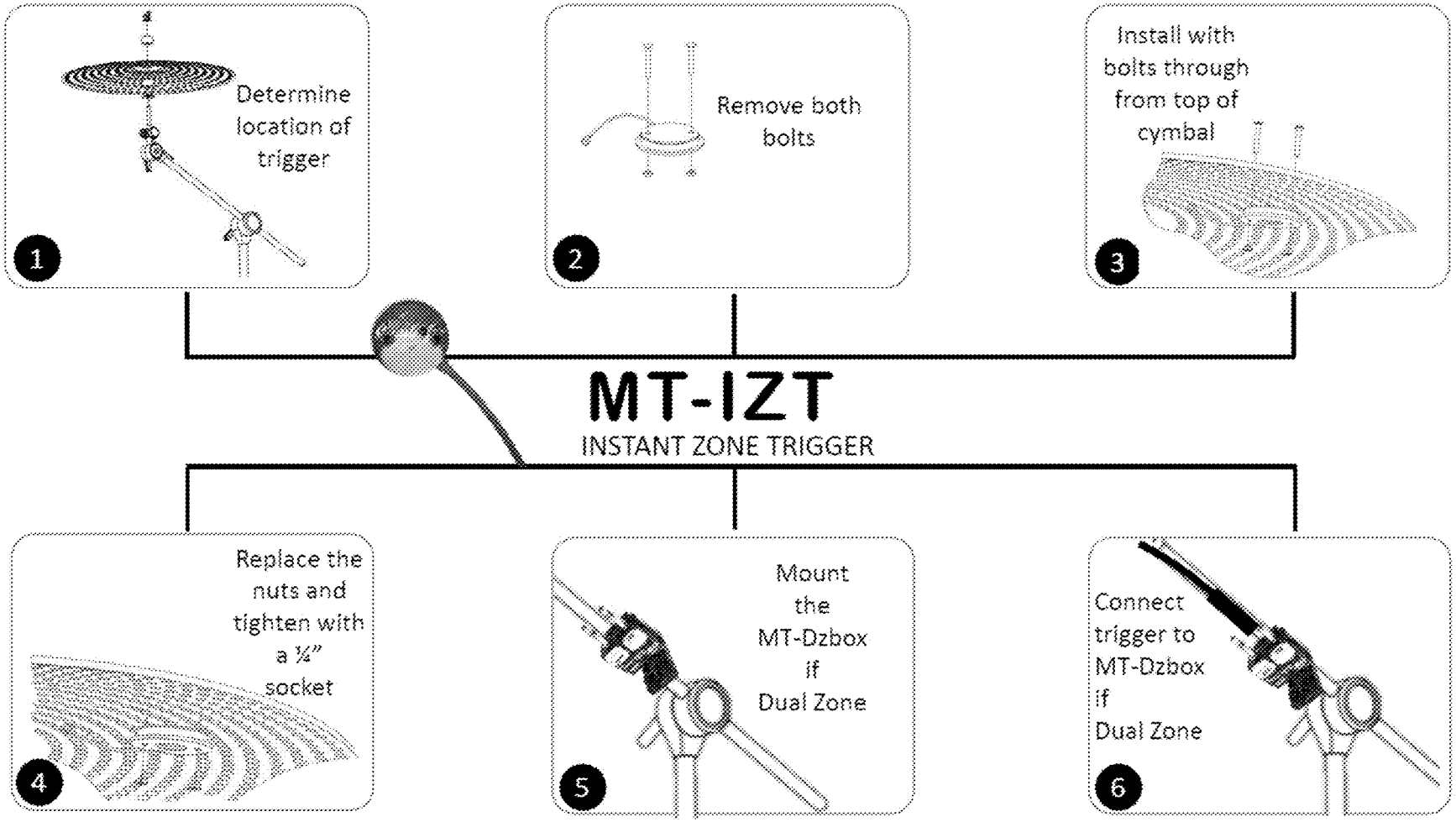

FIG. 48 provides an installation process for the instant zone trigger assembly. Bolts are removed from the instant zone trigger assembly, passed through openings in the cymbal, and then threaded into corresponding openings in the instant zone trigger assembly to secure it to the underside of the cymbal. A dual zone trigger box may also be installed on the cymbal stand and connected to the instant zone trigger assembly if dual zone triggering is desired. The cymbal stand mounted trigger assembly of the present invention provides an improvement over prior art cymbal triggers that rely on a clamp around the base of the cymbal boom arm. The cymbal is seated directly onto the trigger assembly maintaining constant contact with the cymbal.

Figure 49:
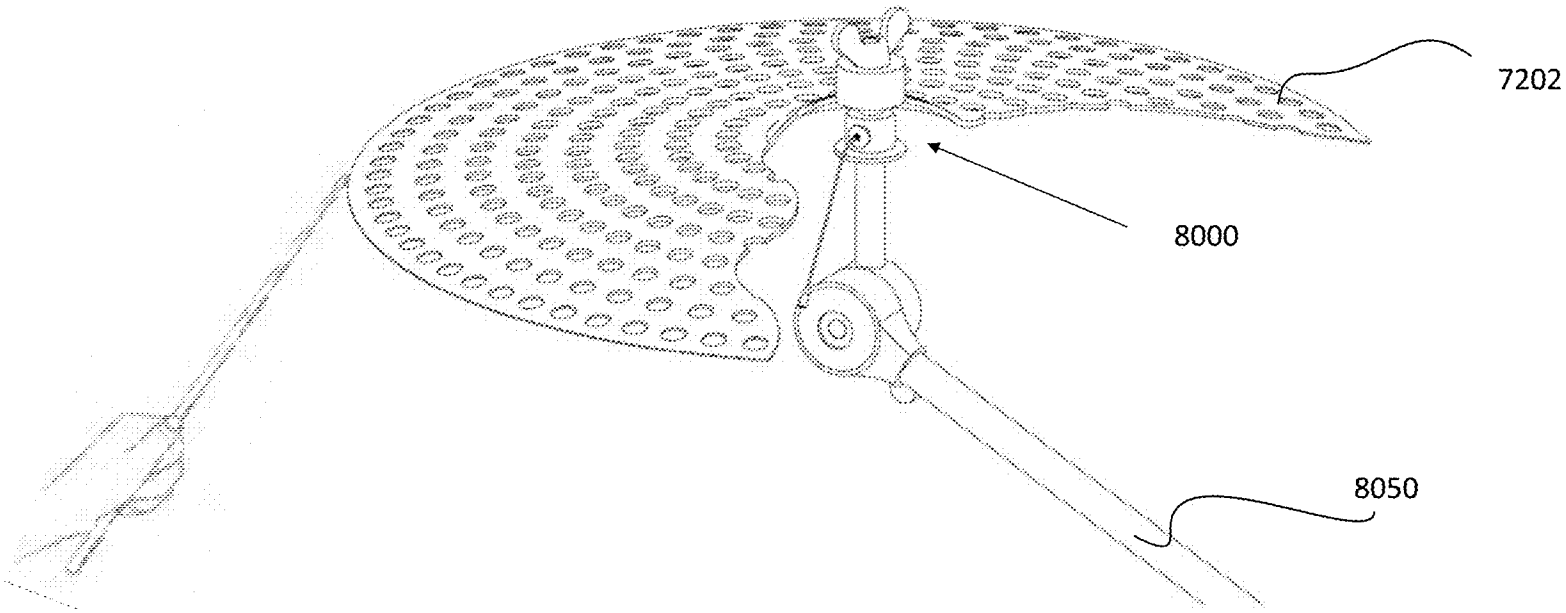
FIG. 49 provides a partial cut-away view of a cymbal on a stand with a stand mounted trigger assembly installed below the cymbal.

FIG. 49 provides a partial cut-away view of a cymbal 7202 on a stand 8050 with a stand mounted trigger assembly 8000 installed below the cymbal 7202. The trigger 8000 is placed on the cymbal stand 8050 underneath the cymbal 7202. The cymbal 7202 is seated directly onto the trigger assembly 8000 maintaining constant contact with the cymbal 7202. When the cymbal 7202 is struck by stick or other object the energy is transferred down into the trigger 8000. The trigger assembly 8000 includes a piezoelectric/transducer 8004 with electrical leads, and cable. The transducer generates an electrical signal that, with the leads/cable electrically connected to a drum module, causes the drum module to generate sound representative and corresponding to cymbal strikes.

Figure 50:
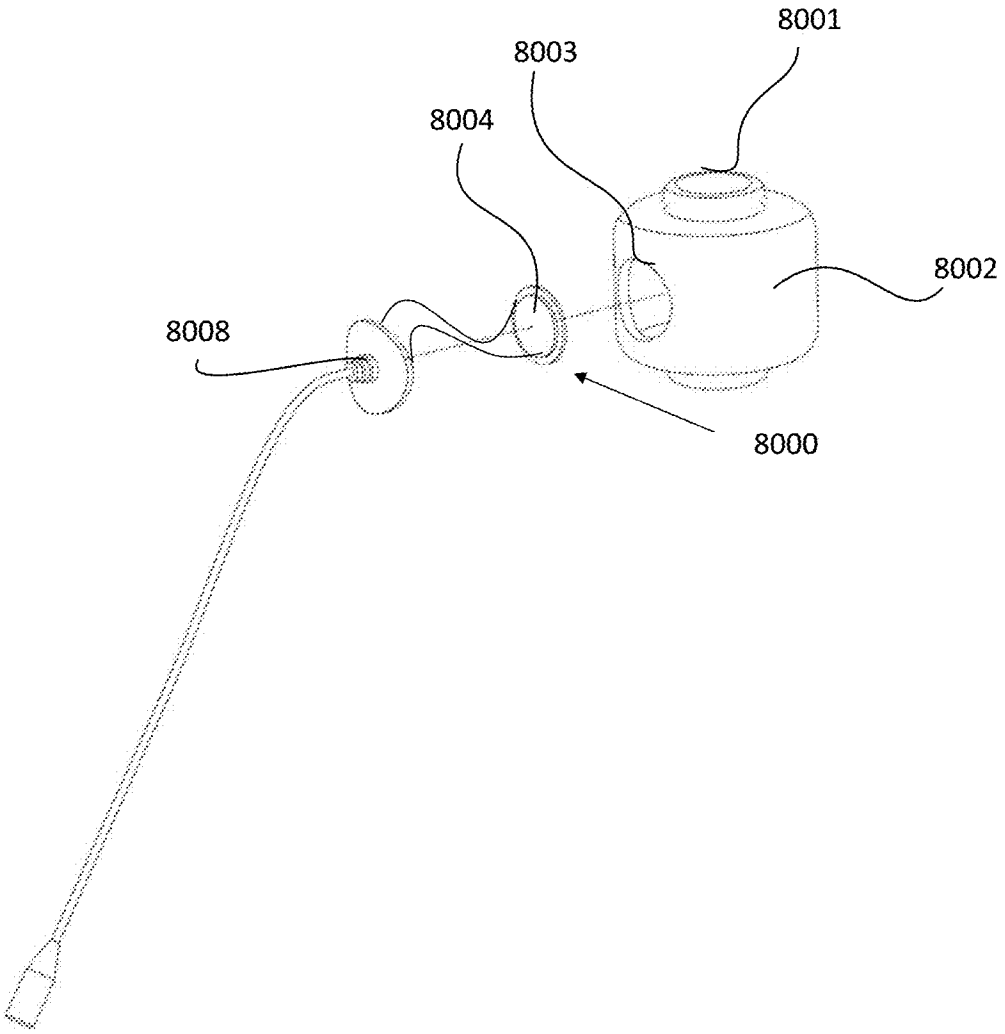
FIG. 50 provides a perspective view of the cymbal stand mounted trigger assembly.

FIG. 50 provides a perspective view of the cymbal stand mounted trigger assembly 8000. The piezo 8004 is mounted into a bore hole 8003 in a grommet 8002 and back filled with epoxy and electrical leads are connected to a cable 8008 which may include a strain relief. The grommet 8002 has an internal diameter of ⅜ inches. The piezo 8004 is a 11-15 mm piezo and is connected to a 3.5 mm jack cable assembly. The durometer of the grommet 8002 has a direct effect on the trigger sensitivity and resulting electrical signal response and performance. A harder grommet provides more sensitivity, and a softer grommet provides less sensitivity.

Figure 51:
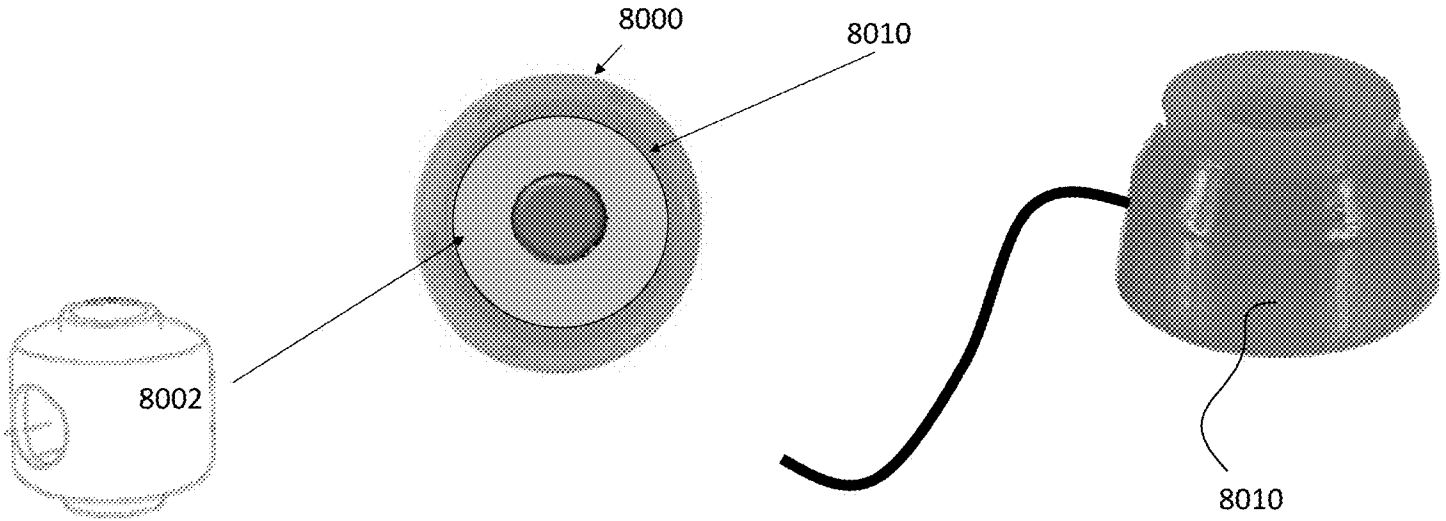
FIG. 51 provides top and perspective views of the grommet and piezoelectric transducer with an outer boot.

FIG. 51 provides top and perspective views of the grommet 8002 and piezoelectric transducer 8004 with an outer boot 8010. The boot 8010 may be made of softer silicon and is placed over the trigger assembly 8000 and the gap between may be filled with epoxy. When the outer boot and grommet/piezoelectric transducer are bonded as single unit, the unit becomes more sensitive to lower frequencies and is well suited for ride cymbal bell frequency bandwidth which is typically between 300-600 Hz.

Figure 52:
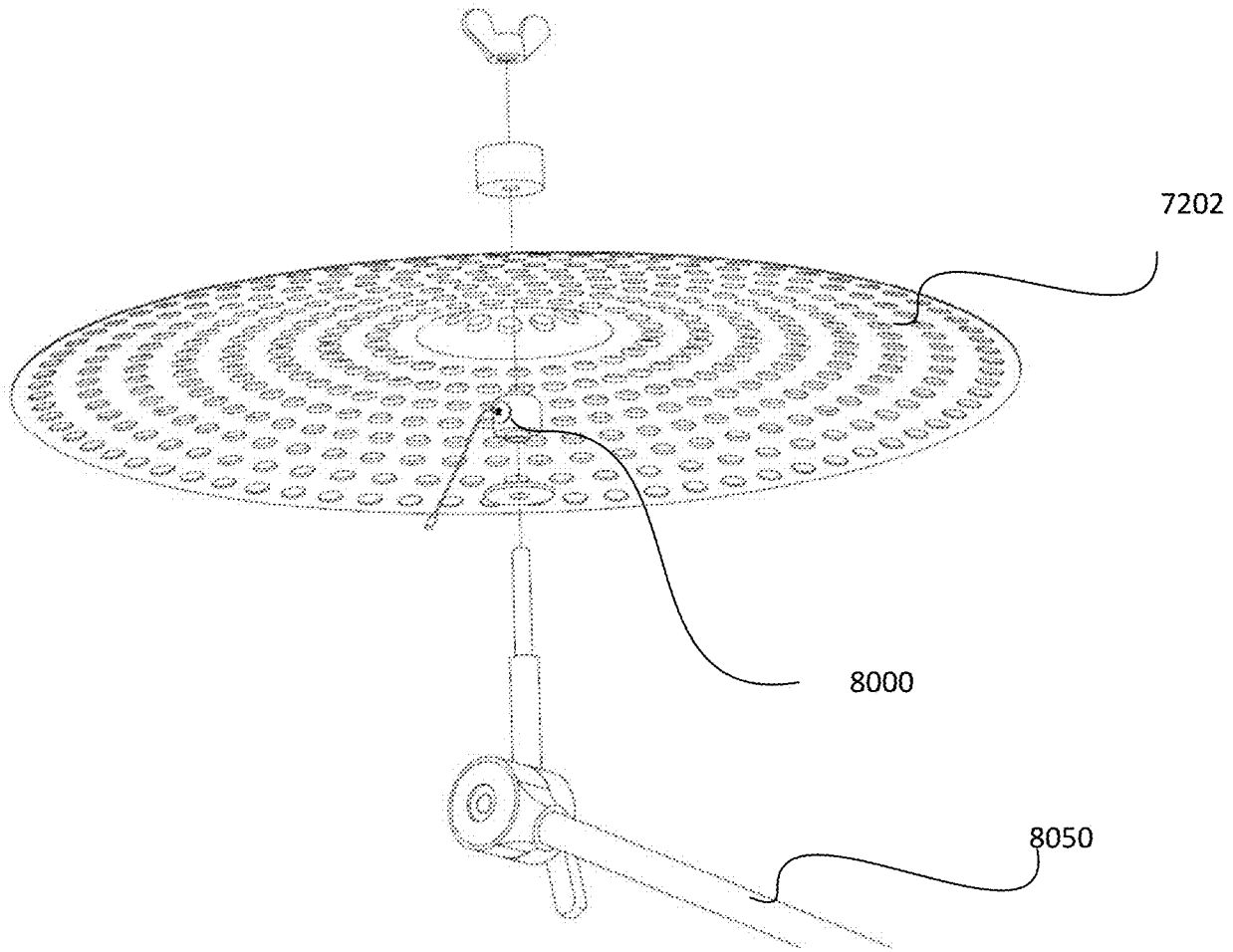
FIG. 52 provides a perspective view of a cymbal and stand mounted trigger assembly.
Figure 53:
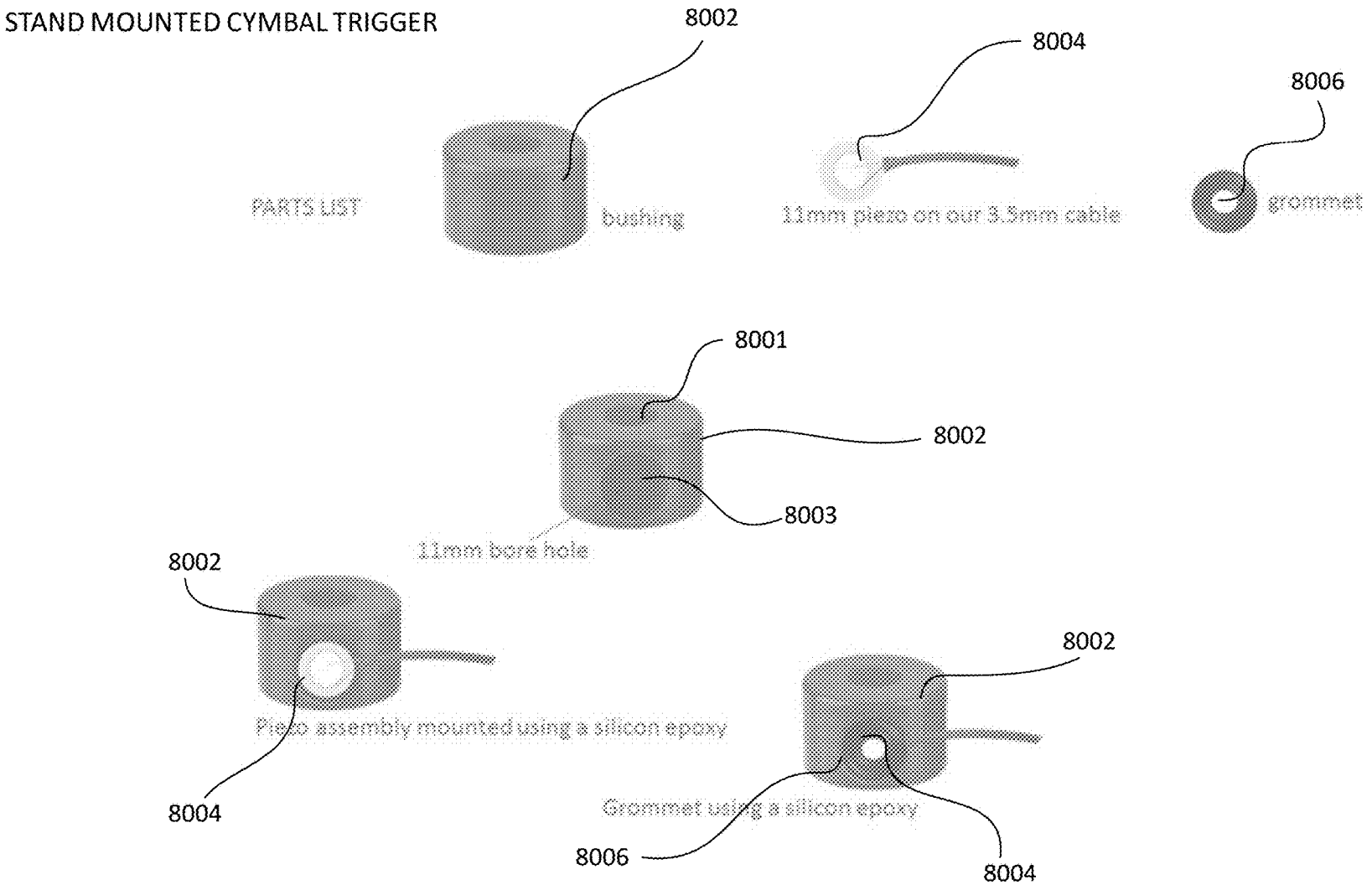
FIG. 53 provides various views of the bushing, piezoelectric transducer, and grommet for the transducer.
Figure 55:
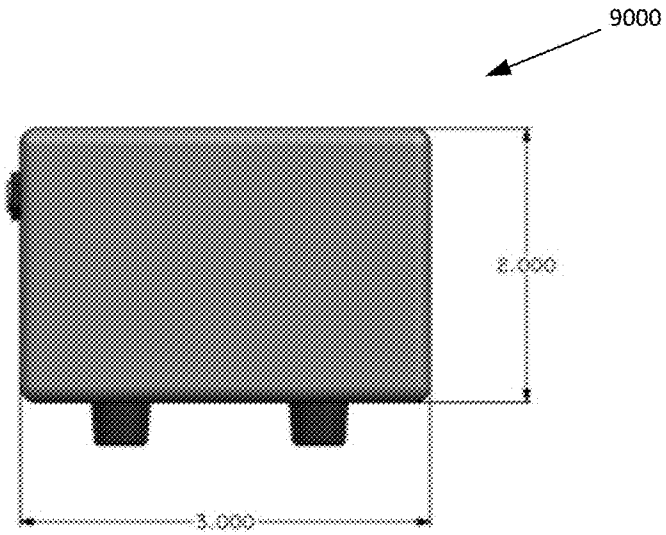
FIGS. 54-59 provide various views and diagrams of a digital electronic hi-hat controller according to an embodiment of the present invention.
Figure 57:
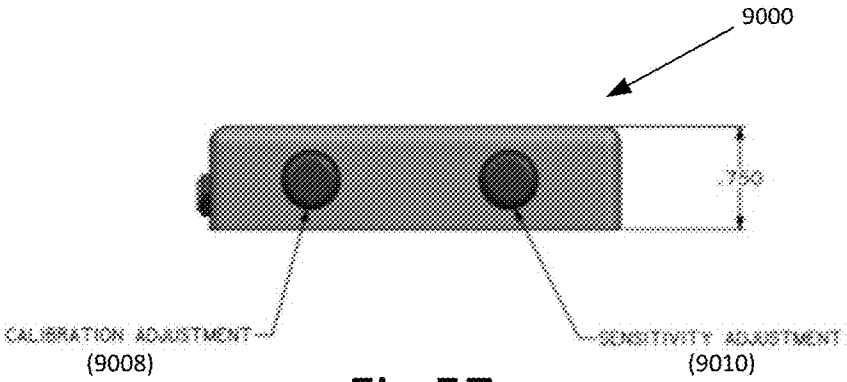
Figure 54:
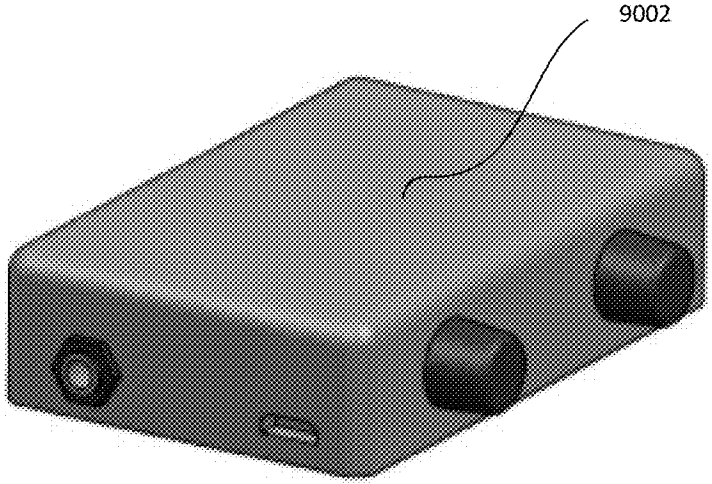
Figure 56:
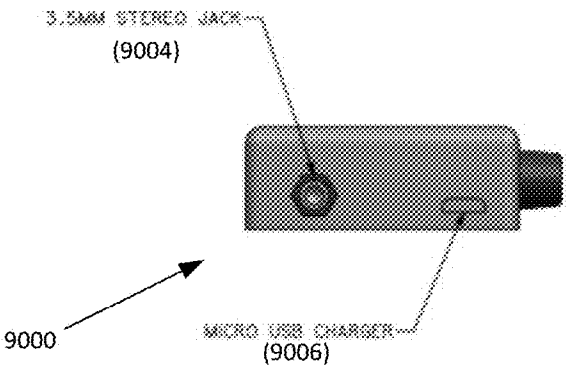
Figure 58:
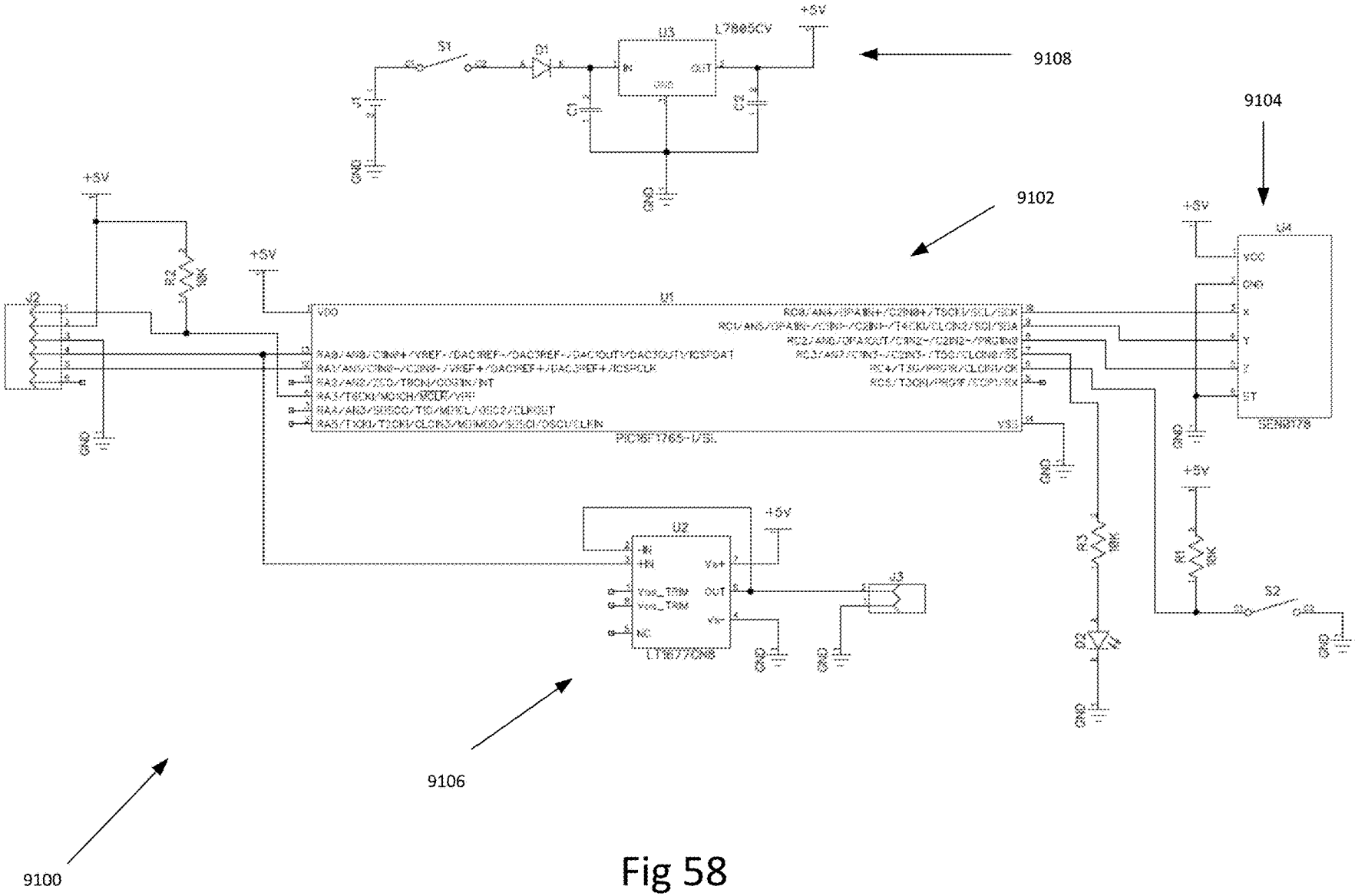
Figure 59:
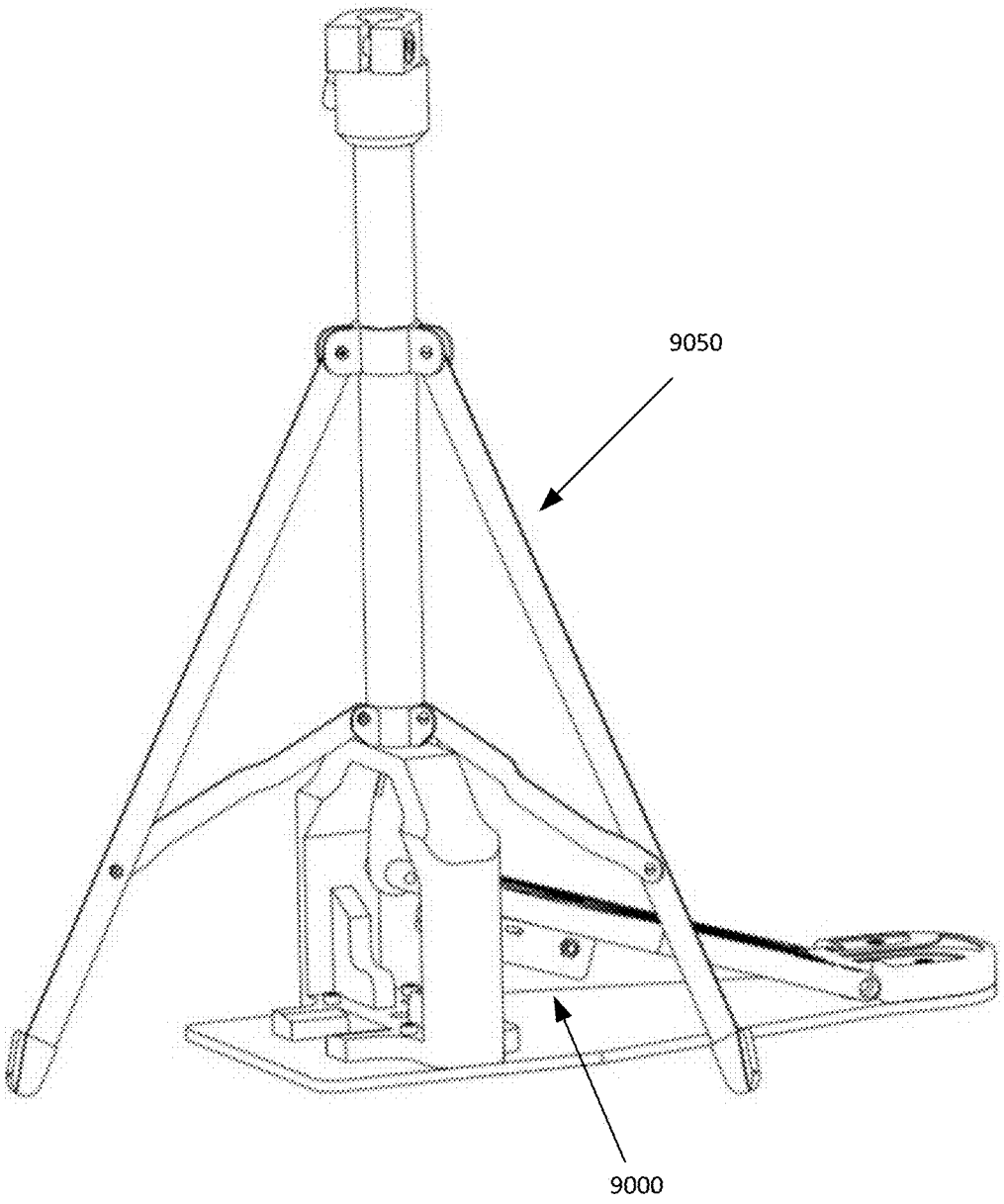

FIG. 52 provides a perspective view of a cymbal 7202 and stand mounted trigger assembly 8000. The trigger 8000 is placed on the cymbal stand 8050 underneath the cymbal 7202 and the cymbal 7202 is seated directly onto the trigger 8000 maintaining constant contact with the cymbal 7202—this does not preclude the use of a felt or other material intermediate the cymbal 7202 and the trigger assembly 8000. FIG. 53 provides various views of the bushing 8002, piezoelectric transducer 8004, and grommet 8006 for the transducer 8000. The piezoelectric transducer 8004 and the grommet 8006 may be installed or secured to the bushing 8002 by a silicon epoxy or similar adhesive.

FIGS. 54-59 provide various views and diagrams of a digital electronic hi-hat controller 9000 according to an embodiment of the present invention. Current electronic hi-hat controllers consist of an extra pedal separate from the hi-hat the triggered cymbals are mounted to. This method creates an additional item in an already cluttered footprint for any drummer. The method the pedal uses to send hi-hat articulations is outdated and unreliable. The pedal works like that of a sewing machine providing voltage that is regulated by some analog device capable of measuring and outputting resistance. A lower voltage read by the drum module corresponds to the hi-hat being seen as open. At a greater voltage output the module starts to close the hi-hat's audible articulation until completely closed. The digital electronic hi-hat controller 9000 of the present invention works fluidly with any existing hi-hat stand 9050 instead of adding extra unnecessary gear to the drummer's gear footprint. The controller 9000 works with an internal accelerometer 9104, which may be a four-axis accelerometer such as a SEN0178, to determine the acoustic hi-hat pedal position. Once calibrated by using the controls on the exterior of the case 9002 of the controller 9000, including the calibration adjustment potentiometer 9008 and sensitivity adjustment potentiometer 9010, on the unit or by Bluetooth output to an smart phone based application, the drummer simply plays the hi-hats as usual while the unit replicates the natural movement in real-time to include "foot splashes" and "chika" sound synonymous with the acoustic hi-hat. The controller 9000 may be charged via a USB port 9006 or other similar charging port, and its output 9004, which may be a 3.5 mm stereo jack, may be connected to other devices or modules. The controller 9000 may be controlled by an 8-bit controller 9102 such as a PIC16F1765 and may comprise an op-amp 9106 such as a LT1677CN8, and the voltage may be regulated by a voltage regulator 9108 such as a L7805CV. The controller 9000 may also comprise a rechargeable battery such as a lithium-ion or nickel-metal-hydride battery.

While the invention has been described by reference to certain preferred embodiments, it should be understood that numerous changes could be made within the spirit and scope of the inventive concept described. In implementation, the inventive concepts may be automatically or semi-automatically, i.e., with some degree of human intervention, performed. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. An electronically triggered cymbal set adapted to generate electronic signals representing mechanical vibrations when struck during operation of the cymbal set, the cymbal set comprising:

a plurality of cymbals having a set of perforations formed therein, each perforation extending from a top surface of a cymbal through to a bottom surface of a cymbal;

a set of electronic triggers respectively adapted to be securely attached to a cymbal, each electronic trigger of the set of electronic triggers comprising an electrical cable and a piezoelectric device adapted to convert mechanical vibrations into an electronic signal representative of the mechanical vibrations sensed by the piezoelectric device during operation of the respective cymbal, the electrical cable being connected at a first end to the piezoelectric device and having a second end providing an output adapted to communicate the electronic signal to a connected device; and a set of fasteners adapted to respectively mount the set of electronic triggers to the plurality of cymbals, each fastener from the set of fasteners comprising an elongated member configured to be received through a perforation formed in a cymbal and being adapted to securely affix an electronic trigger from the set of electronic triggers to a cymbal so as to enable accurate sensing of mechanical vibrations of the cymbal when struck during operation of the cymbal.

2. The cymbal set of claim 1, wherein the plurality of cymbals are of the low volume cymbal type with perforations formed therein to minimize the acoustic sound produced during operation of the cymbals.

3. The cymbal set of claim 1, wherein the plurality of cymbals comprises a hi-hat cymbal, a crash cymbal, and a ride cymbal.

4. The cymbal set of claim 1 further comprising a choke mounted to a cymbal and adapted to choke an electronic signal generated by an electronic trigger in association with operation of the cymbal.

5. The cymbal set of claim 1 comprising a hi-hat cymbal and a vibration baffle fixably secured to the hi-hat cymbal and being disposed between a top hat and a bottom hat of the hi-hat cymbal, the vibration baffle adapted to soften mechanical vibrations during a selected portion of the operation of the hi-hat cymbal.

6. The cymbal set of claim 1 further comprising a multi-zone adapter having at least two inputs and at least one output, the multi-zone adapter configured to receive and output an electronic signal from an electronic trigger.

7. The cymbal set of claim 1, wherein the set of electronic triggers generates a plurality of electronic signals respectively representing operation of an associated cymbal and wherein each of the set of electronic triggers has an output in electrical communication with a respective input of an electronic drum module to deliver a respective one of the plurality of electronic signals.

8. The cymbal set of claim 1, wherein the set of electronic triggers includes a pair of openings and the set of fasteners comprises two elongated members, and wherein the pair of openings is configured to align with a pair of perforations in the cymbal so as to enable the two elongated members to respectively pass through the pair of trigger openings and the pair of cymbal perforations.

9. The cymbal set of claim 8, wherein the set of fasteners further comprises a pair of threaded nuts and wherein each of the two elongated members are threaded at least in part and are configured to threadably engage with a threaded nut to secure the trigger to the cymbal.

10. A system for electronically triggering a percussion instrument set comprising a cymbal set and a drum set, the system being adapted to generate a set of electronic signals, each of the electronic signals representing mechanical vibrations associated with operation of the percussion instrument set, the system comprising:

a set of drums;

a set of electronic drum triggers, each one of the set of electronic drum triggers corresponding to a respective one drum from the set of drums and fixably secured to the respective one drum and adapted to sense mechanical vibrations from operation of the respective one drum and convert the mechanical vibrations into an electronic signal for output to a device;

a plurality of cymbals having a set of perforations formed therein, each perforation extending from a top surface of a cymbal through to a bottom surface of a cymbal;

a set of electronic cymbal triggers respectively adapted to be securely attached to a cymbal, each electronic cymbal trigger of the set of electronic cymbal triggers comprising an electrical cable and a piezoelectric device adapted to convert mechanical vibrations into an electronic signal representative of the mechanical vibrations sensed by the piezoelectric device during operation of the respective cymbal, the electrical cable being connected at a first end to the piezoelectric device and having a second end providing an output adapted to communicate the electronic signal to a connected device; and a set of fasteners adapted to respectively mount the set of electronic cymbal triggers to the plurality of cymbals, each fastener from the set of fasteners comprising an elongated member configured to be received through a perforation formed in a cymbal and being adapted to securely affix an electronic cymbal trigger from the set of electronic cymbal triggers to a cymbal so as to enable accurate sensing of mechanical vibrations of the cymbal when struck during operation of the cymbal.

11. The system of claim 10, wherein the plurality of cymbals are of the low volume cymbal type with perforations formed therein to minimize the acoustic sound produced during operation of the cymbals.

12. The system of claim 10, wherein the plurality of cymbals comprises a hi-hat cymbal, a crash cymbal, and a ride cymbal.

13. The system of claim 10 further comprising a choke mounted to a cymbal and adapted to choke an electronic signal generated by an electronic trigger in association with operation of the cymbal.

14. The system of claim 10 comprising a hi-hat cymbal and a vibration baffle fixably secured to the hi-hat cymbal and being disposed between a top hat and a bottom hat of the hi-hat cymbal, the vibration baffle adapted to soften mechanical vibrations during a selected portion of the operation of the hi-hat cymbal.

15. The system of claim 10 further comprising a multi-zone adapter having at least two inputs and at least one output, the multi-zone adapter configured to receive and output an electronic signal from an electronic trigger.

16. The system of claim 10, wherein the set of electronic triggers generates a plurality of electronic signals respectively representing operation of an associated cymbal and wherein each of the set of electronic triggers has an output in electrical communication with a respective input of an electronic drum module to deliver a respective one of the plurality of electronic signals.

17. The system of claim 10, wherein the set of electronic triggers includes a pair of openings and the set of fasteners comprises two elongated members, and wherein the pair of openings is configured to align with a pair of perforations in the cymbal so as to enable the two elongated members to respectively pass through the pair of trigger openings and the pair of cymbal perforations.

18. The system of claim 17, wherein the set of fasteners further comprises a pair of threaded nuts and wherein each of the two elongated members are threaded at least in part and are configured to threadably engage with a threaded nut to secure the trigger to the cymbal.

19. The system of claim 10, wherein each of the set of fasteners comprises at least two elongated members, a first retention component and a second retention component, the first and second retention components adapted to be disposed opposite one another on opposite sides of the cymbal with that at least two elongated members disposed therebetween when mounted on a cymbal, whereby when affixing the cymbal trigger device to a cymbal the at least two elongated members are disposed through respective ones of the predefined set of perforations, the first and second retention portions being secured to the cymbal and trigger device to affix the trigger device to the cymbal.

* * * * *